US005761600A

United States Patent [19]

Murata

[11] Patent Number: 5,761,600

[45] Date of Patent: Jun. 2, 1998

[54] SHEET STORAGE APPARATUS HAVING PLURAL SHEET STORAGE TRAYS WITH VARIABLE DISTANCE

[75] Inventor: Mitsushige Murata, Yokohama, Japan

[73] Assignee: Canon Kabushiki Kaisha, Tokyo, Japan

[21] Appl. No.: 915,930

[22] Filed: Aug. 21, 1997

Related U.S. Application Data

[63] Continuation of Ser. No. 683,451, Jul. 18, 1996, abandoned.

[30] Foreign Application Priority Data

Jul. 20, 1995 [JP] Japan ..... 7-184228

[51] Int. Cl.[6] ..... G03G 15/00

[52] U.S. Cl. ..... 399/403; 271/292; 399/405; 399/406

[58] Field of Search ..... 399/361, 381, 399/397, 403, 405, 406; 271/278, 279, 287, 292, 293, 294, 299

[56] References Cited

U.S. PATENT DOCUMENTS

| | | | |
|---|---|---|---|
| 4,502,776 | 3/1985 | Matsumoto et al. | 399/403 |
| 4,603,850 | 8/1986 | Horiuchi | 271/294 X |
| 4,843,434 | 6/1989 | Lawrence et al. | 271/293 |
| 5,090,688 | 2/1992 | Sasaki | 271/293 |
| 5,099,292 | 3/1992 | Hirose | 271/292 X |
| 5,338,017 | 8/1994 | Stemmle | 271/292 X |

*Primary Examiner*—Sandra L. Brase

*Attorney, Agent, or Firm*—Fitzpatrick, Cella, Harper & Scinto

[57] ABSTRACT

For reducing the curl of the sheets ejected from an electrophotographic printer to a sorter, which is so constructed as to increase the space between a tray currently subjected to sheet storage and an upper adjacent tray and to reduce the spaces of other trays, there is executed control, in response to the end or interruption of the printing operation of the printer, so as to increase the space of the trays not currently subjected to sheet storage operation and to decrease the space of the tray currently subjected to the sheet storage operation, thereby pressing the sheets present on the tray.

20 Claims, 49 Drawing Sheets

OPTICAL MOTOR DRIVER
702
RDF CONTROL UNIT
900
OPERATION UNIT
704
ROM
705
RAM
706
I/O
707
READER CONTROLLER
700
IMAGE PROCESSING UNIT
203
V3
LASER DRIVER
110
PRINTER CONTROLLER
701
ROM
750
RAM
751
A/D
752
D/A
753
I/O
754
TO FIG. 2B
SORTER CONTROL UNIT
1000

FIG. 19
TRANSFER DRUM CLEANING
1 CLEANING
2 OIL REMOVAL
3 GRIND CLEANING
FIG. 21A
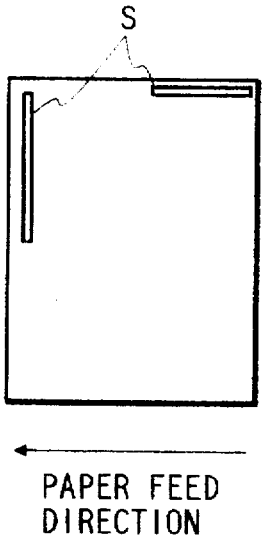
FIG. 21B
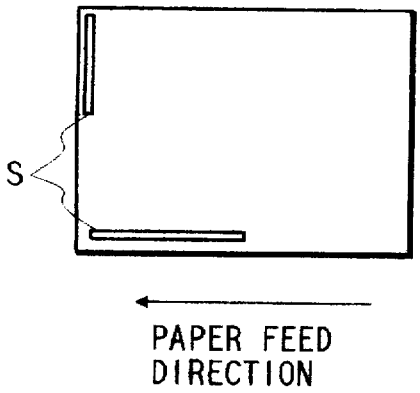

| PEPER SIZE | SLICE VALUE1 | SLICE VALUE2 |
|---|---|---|
| A3 VERTICAL | $S_{11}$ | $S_{12}$ |
| B4 VERTICAL | $S_{21}$ | $S_{22}$ |
| A4 VERTICAL | $S_{31}$ | $S_{32}$ |
| A4 HORIZONTAL | $S_{41}$ | $S_{42}$ |
| B5 VERTICAL | $S_{51}$ | $S_{52}$ |
| B5 HORIZONTAL | $S_{61}$ | $S_{62}$ |

| FIG. 28A | FIG. 28B |
|---|---|

N : NUMBER OF BINS OF SORTER
k : BIN NUMBER
k=1, ···, N
(ASSUME AS FIRST BIN, SECOND BIN, ···, Nth BIN IN ORDER FROM TOP)

BIN_POS : CURRENT BIN POSITION

ESC_BIN : ESCAPE POSITION (BIN POSITION)

RET_BIN : RETURN POSITION (BIN POSITION)

MOV_BIN : MOVING TARGET POSITION (BIN POSITION)

RET__BIN : RETURN POSITION (BIN POSITION)

MOV__BIN : MOVING TARGET POSITION (BIN POSITION)

BIN__POS : CURRENT POSITION OF BIN

MOV__BIN : MOVING TARGET POSITION (BIN POSITION)

BIN__CN : BIN POSITION COUNTER

VOL(BIN__CN) : STACK NUMBER OF TARGET BIN

ESC__BIN : ESCAPE POSITION (BIN POSITION)

SHEET STORAGE APPARATUS HAVING PLURAL SHEET STORAGE TRAYS WITH VARIABLE DISTANCE

This application is a continuation of application Ser. No. 08/683,451, filed Jul. 18, 1996, now abandoned.

BACKGROUND OF THE INVENTION

1. Field of the Invention

The present invention relates to a sheet storage apparatus having plural sheet storage trays with variable distance.

2. Related Background Art

As the sheet storage apparatus for storing sheets discharged from an image forming apparatus, there are already known a movable-bin sorter provided with plural movable bins, and a fixed-bin sorter in which the image-bearing sheets are stored in plural fixed bins.

However, such sorters have been associated with the following drawbacks in case the image forming apparatus, to which such sorter is connected, is a color copying apparatus.

The original copied on such color copying apparatus is generally an image such as a photograph, so that the sheet, having received the image transfer and having passed the fixing station, bears the fixed toner over the entire surface of the sheet. The toner, thermally dilated immediately after the image fixation, is cooled with the lapse of time and shrinks on the sheet, thereby generating significant curl in the sheet. The amount of curling of the sheet increases as the sheet becomes cooler. When thus curled sheet is discharged from the color copying apparatus to a bin of the sorter, the rear end of the sheet tends to block the sheet discharge aperture of the sorter, thus leading to sheet jamming.

SUMMARY OF THE INVENTION

An object of the present invention is to provide a sheet storage apparatus in which the above-mentioned drawback is solved.

Another object of the present invention is to provide a sheet storage apparatus capable of preventing the curl in the sheet.

Still other objects of the present invention, and the features thereof, will become fully apparent from the following description, which is to be taken in conjunction with the attached drawings.

BRIEF DESCRIPTION OF THE DRAWINGS

FIG. 19 is a schematic plan view showing an example of display of the display panel in the service mode in the color image forming apparatus shown in FIG. 1;

FIGS. 21A and 21B are plan views of an OHP sheet usable in the color image forming apparatus shown in FIG. 1;

DESCRIPTION OF THE PREFERRED EMBODIMENTS

Figure 1:
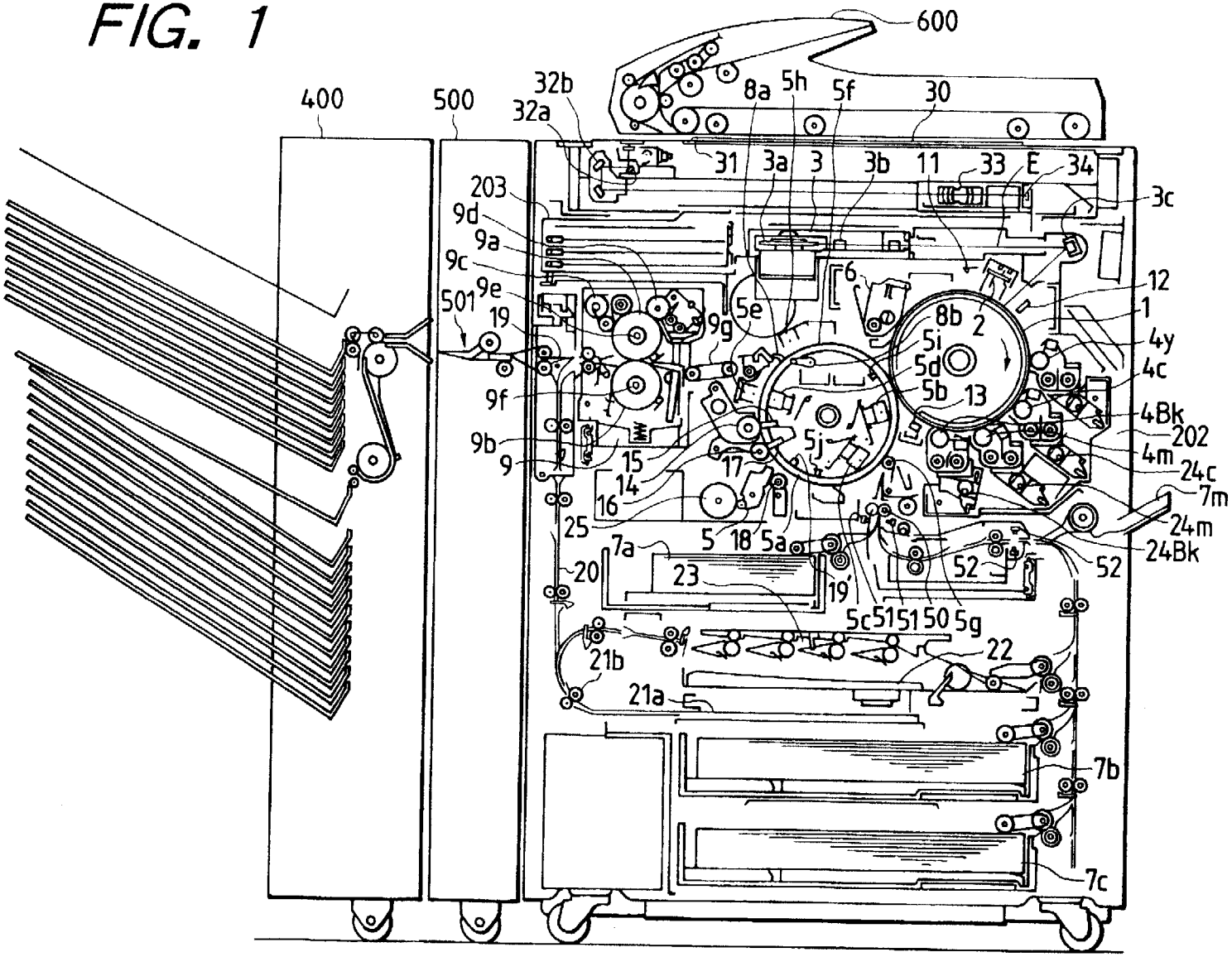
FIG. 1 is a schematic cross-sectional view of a color image forming apparatus embodying the present invention.

FIG. 1 is a schematic cross-sectional view of a color image forming apparatus constituting an embodiment of the present invention.

In the present embodiment, there are provided a digital color image reader unit 201 (hereinafter simply called reader unit) in the upper part, a digital color image printer unit 202 (hereinafter simply called printer unit) in the lower part, and an image process unit 203 therebetween.

In the reader unit 201, an original 30 is placed on an original supporting glass 31 and is scanned with an exposure lamp 32. The light reflected from the original 30 is guided by mirrors 32*a* to 32*c* and a lens 33 and concentrated on a full-color sensor 34 bearing integrated RGB color separating filters, to obtain color-separated analog image signals. These signals are guided through an unrepresented amplifying circuit, then digitized, further processed in an image process unit 203 and supplied to the printer unit 202.

In the printer unit 202, a photosensitive drum 1 constituting an image bearing member is rotatably supported and is rotated in a direction indicated by an arrow, and, around the photosensitive drum 1, there are provided a pre-exposure lamp 11, a corona charger 2, a laser exposure optical system 3, a potential sensor 12, a developing device 4 (developing units 4*y*, 4*c*, 4*m*, 4*Bk*), an on-drum light amount sensor 13, a transfer unit 5 and a cleaning unit 6.

In the laser exposure optical system 3, the image signal from the reader unit 201 is converted in a laser unit (not shown) in an optical signal, and the obtained laser light is reflected by a polygon mirror 3*a*, then guided through a lens 3*b* and a mirror 3*c* and projected onto the photosensitive drum 1.

At the image formation in the printer unit 202, the photosensitive drum 1 is rotated in the direction of arrow, then the photosensitive drum 1 is subjected to the charge elimination by the pre-exposure lamp 11 and is uniformly charged by the charger 2, and is irradiated with an optical image E of each separated color to form a latent image.

Subsequently the latent image on the photosensitive drum 1 is developed by a predetermined developing unit, thereby forming an image with toner composed principally of a resinous material, on the photosensitive drum 1. The developing units are selectively brought close to the photosensitive drum 1, by the function of eccentric cams 24*y*, 24*c*, 24*m*, 24*Bk*.

The toner image developed on the photosensitive drum 1 is transferred onto a recording material, which is supplied from one of recording material cassettes 7*a*, 7*b*, 7*c*, an intermediate tray 22 or a recording material tray 7*m* through a transport system and the transfer device 5 to a position opposed to the photosensitive drum 1. The transfer device of this embodiment is provided with a transfer drum 5*a* serving as means for supporting the recording material, a transfer charger 5*b*, an attraction charger 5*c* for electrostatically attracting the recording material, an attraction roller 5*g* opposed thereto, an internal charger 5*d*, and an external charger 5*e*, and a recording material supporting sheet 5*f* consisting of a dielectric material is cylindrically formed, in integral manner, on the peripheral aperture of the transfer drum 5*a* which is rotatably supported. The recording material supporting sheet 5*f* (hereinafter called transfer sheet 5*f*) is formed with a dielectric sheet, such as a polycarbonate film.

As the present embodiment employs electrostatic attraction in the recording material supporting means, the image formation is possible simultaneously on two recording materials, if the length thereof does not exceed ½(250 mm) of the entire periphery of the transfer sheet 5*f*. The simultaneous image formation on the two recording sheets will hereinafter called "two-sheet applying control", and the image formation on a recording material attracted electrostatically on the transfer sheet 5*f* will be called "one-sheet applying control".

Along with the rotation of the drum-shaped transfer device, or the transfer drum 5*a*, the toner image on the photosensitive drum 1 is transferred, by the function of the transfer charger 5*b*, onto the recording material supported by the transfer sheet 5*f*. Thus a full-color image is formed by the transfer of color images of a desired number onto the recording material attracted and transported by the transfer sheet 5*f*. In case of forming a full-color image, the recording material after the transfer of the toner images of four colors is separated from the transfer sheet 5*f* by the function of a separating finger 8*a*, a separating push-up roller 8b and a separation charger 5*h*, then guided through a heat roller fixing unit 9, further subjected to curl correction control in a curl correction unit 500 to be explained later, and supplied to a discharged sheet post-process unit (sorter) 400 for post processes such as page alignment and stapling.

On the other hand, the photosensitive drum 1 after the image transfer is subjected, in a cleaning unit 6, to the elimination of the surfacially remaining toner, and is used again in the image forming process.

In case of forming images on both sides of the recording material, after the recording material subjected to the image formation on one side thereof is discharged from the fixing unit 9, the transport path switching guide 19 is activated to guide the recording material into a reverse path 21*a* through a vertical transport path 20, and a reversing roller 21*a* is reversed to advance the recording material in an opposite direction, starting from the trailing end at the introduction into the reverse path, and to store the recording material in the intermediate tray 22. Subsequently the above-explained image forming process is executed to form an image on the other side. In such formation of the images on both sides of the recording material, the first side of the recording material on which the image is formed at first is called "first side in two-side mode", and the second side on which the image is formed next is called "second side in two-side mode".

For avoiding the scattered deposition of the power onto the recording material supporting sheet 5*f* of the transfer drum 5*a* and the oil deposition, to be explained later, onto the recording material, a cleaning operation is conducted with a fur brush 14 and a fur back-up brush 15 which are opposed across the recording material supporting sheet 5*f*, with an oil cleaning roller 16 and an oil cleaning back-up brush 17 which are opposed across the recording material supporting sheet 5*f* and with a grinding roller 18 and a grinding roller back-up brush 19, which are opposed across the recording material supporting sheet 5*f*. Such cleaning operation is conducted prior to or after the image formation, and also in case of sheet jamming.

In the present embodiment, the space between the recording material supporting sheet 5*f* and the photosensitive drum 1 can be arbitrarily selected, by the activation of an eccentric cam 25 at a desired timing, thereby moving a cam follower 51 which is integral with the transfer drum 5*a*. Thus the space between the transfer drum 5*a* and the photosensitive drum 1 is made larger during a stand-by state or when the power supply is turned off.

In the following there will be explained the toner density control in the developing device 4. As the toners in the magenta developing unit 4*m*, the cyan developing unit 4*c* and the yellow developing unit 4*y* reflect the near infrared light of a wavelength of ca. 960 nm, such reflected light is detected by a developer density detecting unit 780 (cf. FIG. 2B) provided in each developing unit and is converted by an A/D converter 752 (cf. FIG. 2A) into a toner density signal, in response to which the toner is replenished to each developing unit from an unrepresented hopper.

On the other hand, as the black toner absorbs the near infrared light of ca. 960 nm, the detection of the toner density is not conducted in the black developing unit 4*Bk*. Instead, the black toner image developed on the photosensitive drum 1 is irradiated with the near infrared light of ca. 960 nm, then the developed black toner density is detected from the ratio of the reflecting component of the photosensitive drum 1 and the absorbed component by the black toner, and the toner density in the developing unit is calculated from this ratio.

A sensor 13 for detecting the light amount on the drum is positioned between the black developing unit 4*Bk* and the transfer charger 5*b* to detect the black toner image developed by the black developing unit 4*Bk* prior to the image transfer, thereby avoiding the fluctuation in the toner density by the transfer operation.

In the following there will be given a detailed explanation on the heat roller fixing unit 9, which is provided with an upper fixing roller 9*a*, a lower fixing roller 9*b*, a fixing web 9*c* and a fixing oil applicator 9*d*.

The heat roller fixing unit 9 fuses the toner on the recording material by the thermal energy of the fixing rollers 9*a*, 9*b* and fixes the fused toner to the recording material by the pressure between the fixing rollers 9*a*, 9*b*. The upper and lower fixing rollers 9*a*, 9*b* are independently controlled to optimum surface temperatures by upper and lower fixing heaters 9*e*, 9*f* provided at the approximate centers of these rollers and upper and lower fixing thermistors 781, 782 for detecting the surface temperature of the respective rollers.

The fixing web 9*c* is brought into contact with the upper fixing roller 9*a*, when required, in order to remove the stain or the offset toner on the upper fixing roller 9*a*. In this operation, a new portion of the fixing web 9*c* is contacted with the upper fixing roller 9*a* by a widening device incorporated in the fixing web 9*c*, in order to increase the cleaning performance. Also a fixing oil application roller 9*d* is provided for supplying silicone oil onto thus cleaned surface of the upper fixing roller 9*a*, whereby silicone oil is applied onto the upper fixing roller 9*a* when required, in order to prevent adhesion of the toner from the recording material onto the upper fixing roller 9*a*.

Figures 2, 2A, 2B:
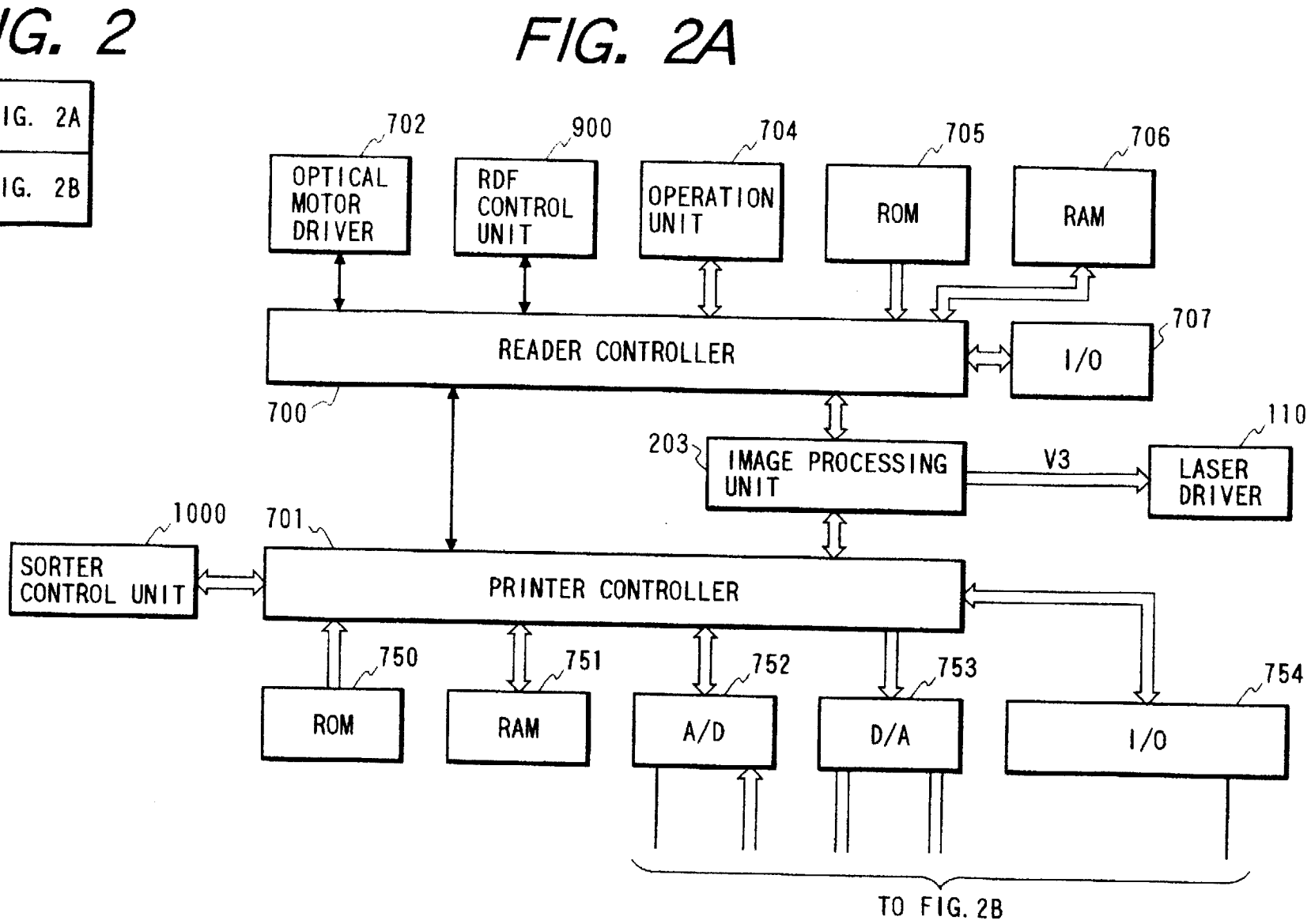
FIG. 2 is comprised of FIGS. 2A and 2B showing block diagrams of the control system of the color image forming apparatus shown in FIG. 1.
Figure 2B:
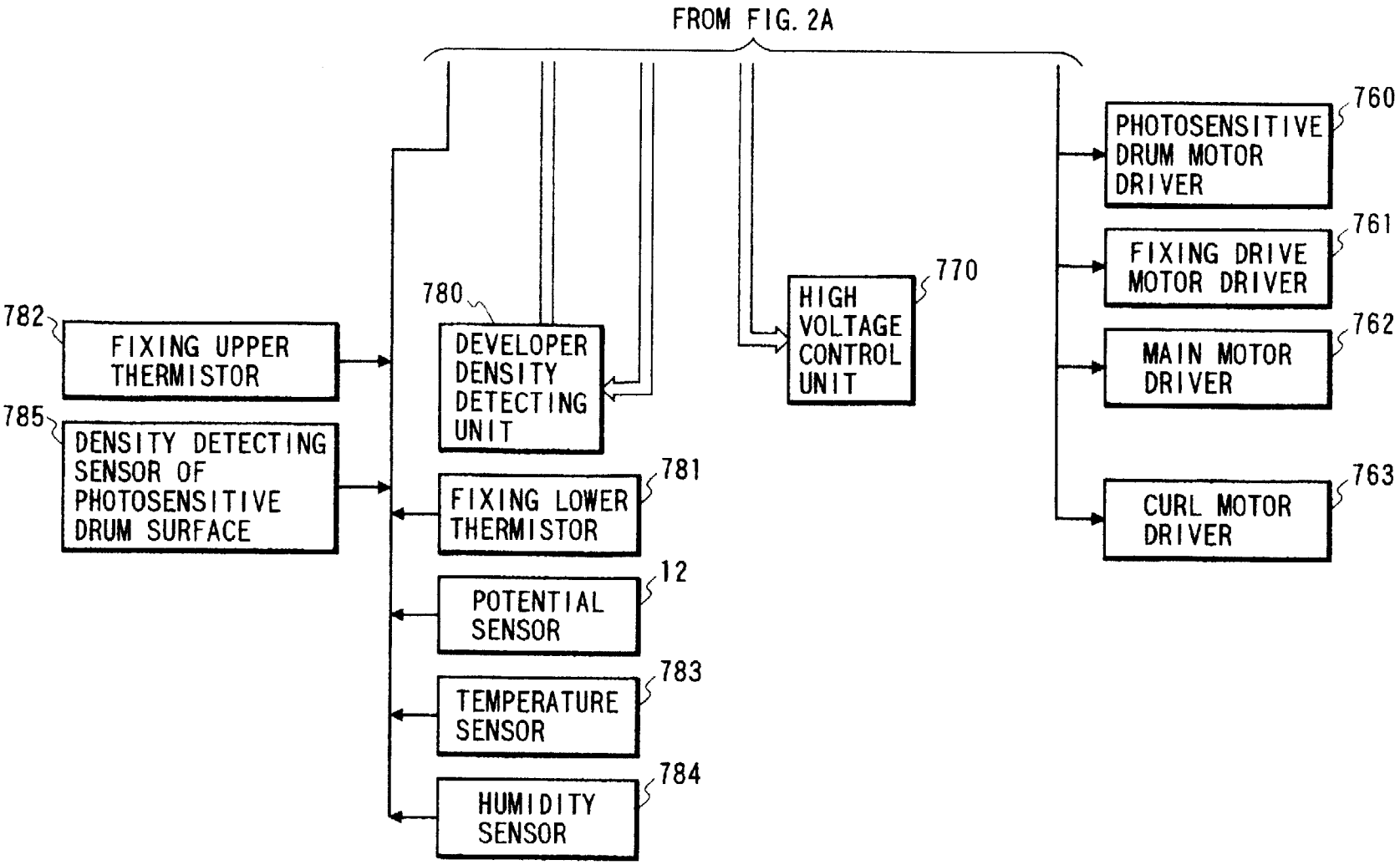

In the heat roller fixing unit 9, the fixing rollers 9*a*, 9*b* and a recording material transport unit 9*g* are driven by a fixing drive motor not shown in FIG. 1 and driven by a fixing motor driver 761 (FIG. 2B). In the present embodiment, in order to eliminate the difference in the fixing ability depending on the kind of the recording material, there are provided fixing speeds corresponding to the recording materials of four kinds.

In consideration of the peripheral speed VP (process speed) of the photosensitive drum 1 at the image formation, the fixing speed VFN for the ordinary speed is equal to VP. The fixing speed VFD for the second side in the two-side mode is smaller than VFN, while the fixing speed VFT for the thick paper is smaller than VFD, and the fixing speed VFO for the OHP sheet is smaller than VFT. Consequently there stands a relationship VP=VFN>VFD>VFT>VFO, and the fixing motor driver 761 (FIG. 2B) is so constructed as to realize these four fixing speeds. The transport speed of the recording material transport unit 9*g* is selected equal to the peripheral speed of the fixing rollers 9*a*, 9*b*. The fixing speed VFD for the second side in the two-side mode is used for the second side in the two-side mode when toners of two or more colors are fixed. It is however not used, even in the second side in the two-side mode, in the single-color mode utilizing the toner of only one color, and the fixation in such case is conducted with the fixing speed VFN for the ordinary paper.

In the following there will be explained the curl correction unit 500. It is already known that curling is generated in the sheet when an electrophotographically formed toner image is fixed thereon and that such curling detrimentally affects the sheet alignment in the post process after the sheet discharge. For this reason, in the present embodiment, the curl correction unit 500 corrects the curling, in order to prevent the detrimental effect in the discharged sheet process unit 400.

Figure 22:
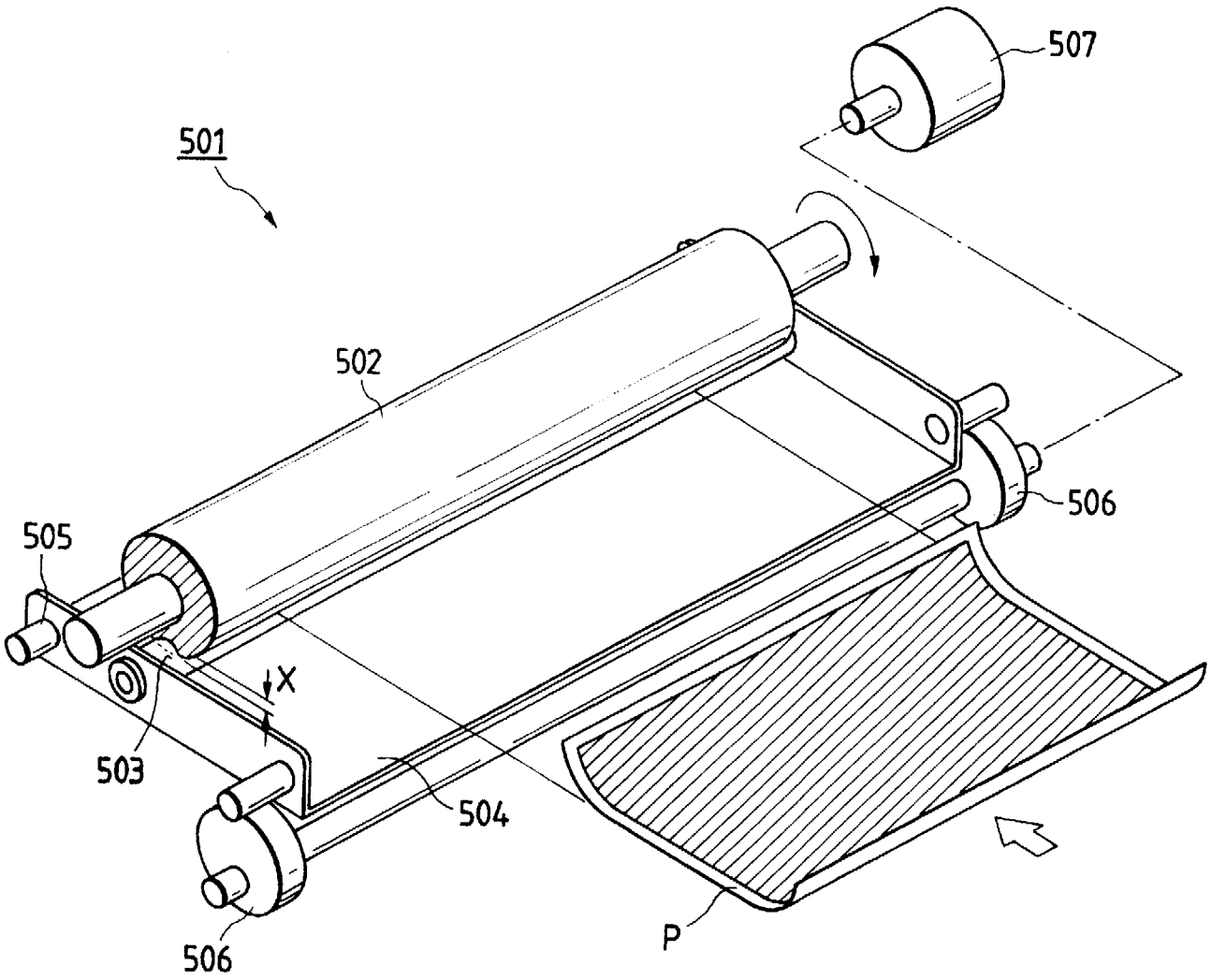
FIG. 22 is a view of a curl correction unit.

FIG. 22 illustrates the principal parts of the curl correction unit 500 shown in FIG. 1. A curling unit 501 is composed of an upper roller 502 of a larger diameter composed of an elastic material such as silicone sponge, and a lower roller 502 of a smaller diameter composed of a metal.

By pressing the lower metal roller 503 to the upper elastic roller 502, there is formed a nip convex to the above along the periphery of the lower metal roller 503, thereby correcting the positive curl (convex to the below of the sheet) P passing through the nip.

The curl correcting ability is adjustable by varying the amount x of penetration of the lower metal roller 503 into the upper elastic roller 502, and such penetration amount x is varied by moving, about a supporting shaft 505, a pressurizing arm 504 supporting the lower metal roller 502 by means of the rotation of an eccentric cam 506, which is driven by an eccentric cam motor 507 composed for example of a stepping motor.

A. Recycling document feeder (600) (RDF)

Figure 25:
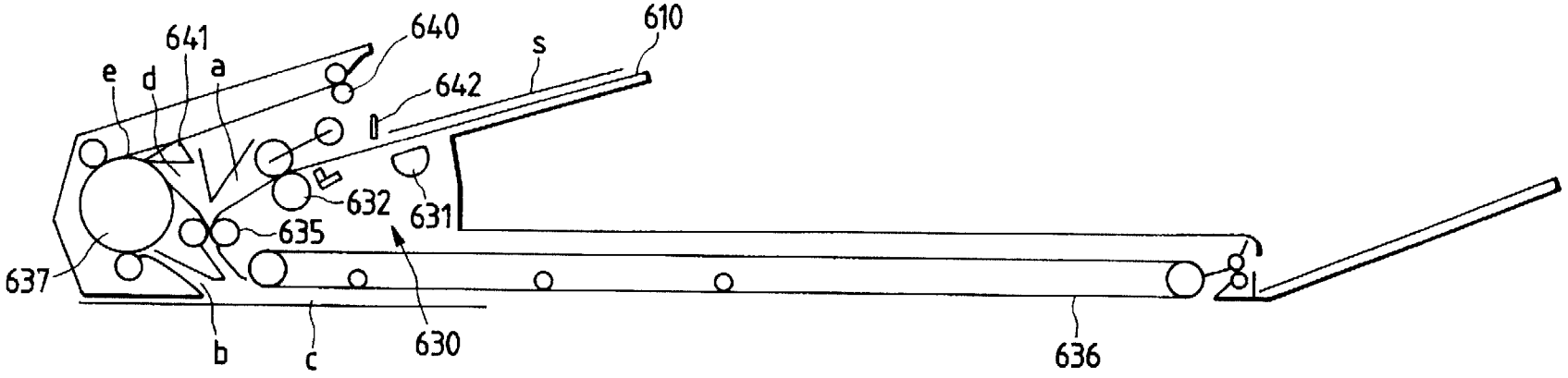
FIG. 25 is a cross-sectional view showing the configuration of an automatic original feeding device.

As shown in FIG. 25, the RDF 600 is provided with a stacking tray 610, serving as a first original tray for setting a stack S of the originals. The stacking tray 610 is provided with feed means 300, constituting a part of original feed means. The feed means is provided with a semicircular roller 631, a separating feed rollers 632, a separation motor SPRMTR (not shown), registration rollers 635, a belt 636, a belt motor BELTMTR (not shown), a larger feed roller 637, a feed motor FEEDMTR (not shown), ejecting rollers 640, a flapper 641, a recycling lever 642, a sheet feed sensor ENTS, a reverse sensor TRNS, an eject sensor EJTS (not shown), etc.

The semicircular roller 631 and the separating feed rollers 632 are rotated by the separating motor SPRMTR to separate the sheets, one by one, from the bottom of the stacked sheets S on the stacking tray 610.

The registration roller 635 and the full-width belt 636 are driven by the belt motor BELTMTR to feed the separated original to an exposure position on the original supporting glass (sheet path c) through sheet paths a, b. The larger feed roller 637 is rotated by the feed motor FEEDMTR to feed the original, present on the original supporting glass 31, from the sheet path c to a path e. The original fed to the sheet path e is returned, by the ejecting rollers 640, onto the stacked originals S on the stacking tray 610.

The recycle lever 642, for detecting a cycle of the originals, is placed on the stacked originals S at the start of the original feeding, and drops by its weight when the trailing end of the last original passes through the recycle lever 642, whereby a cycle of the originals is detected.

In case of handling two-side originals in the feed means 630 explained above, the original is guided at first from the sheet paths a, b to the path c, then the larger feed roller 637 is activated and the flapper 641 is shifted to guide the front end of the original into a sheet path d. Then the original is guided through the sheet path b by the registration rollers 635 and is guided to and stopped on the original supporting glass 31 by the belt 636. In this manner the original is inverted through the paths c, d and b.

The number of the originals can be counted by feeding the stacked originals S, one by one, through the sheet paths a, b, c, d and e, until a cycle of the originals is detected by the recycle lever 642.

B. Sheet post-processing apparatus (sorter unit) (400)

Figure 26:
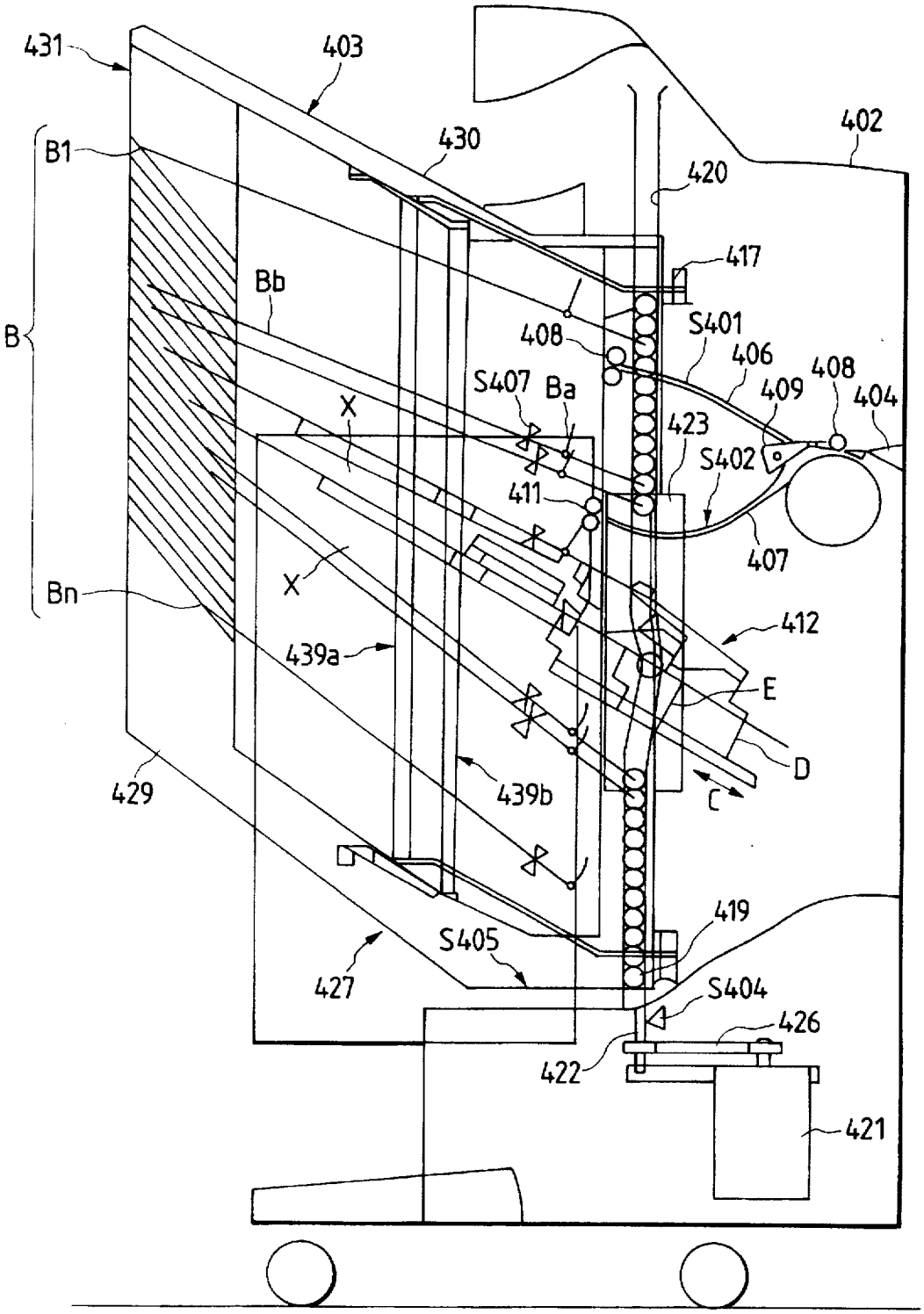
FIGS. 26 and 27 are views showing the configuration of a sorter unit.
Figure 27:
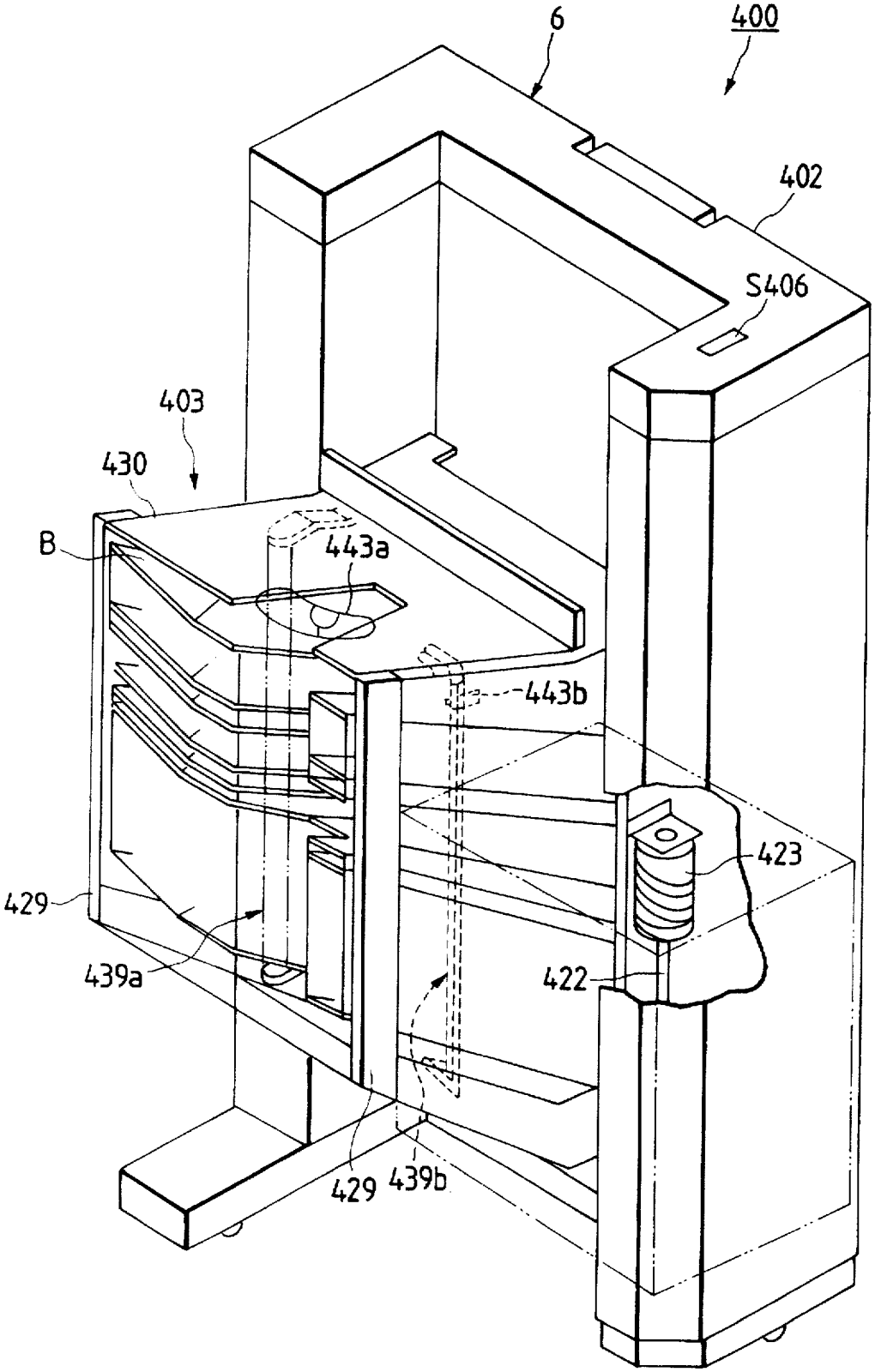

In the following there will be explained the sorter unit with reference to FIGS. 26 and 27. The sorter unit 400 is composed of a body 402 and a bin unit 403. The body 402 is provided, in the vicinity of a sheet inlet 404, with paired introduction rollers 405, and, at the downstream side thereof, there is provided a flapper 409 for switching the sheet feed direction either to a feed path 406 or 407. The feed path 406 extends substantially horizontally and is provided with paired feed rollers 408 at the downstream side thereof, while the other feed path 406 extends downwards and is provided at the downstream side with paired feed rollers 411, in the vicinity of which there is provided a stapler 412 (a, b).

The paired introduction rollers 406 and the paired feed rollers 408, 411 are driven by a feed motor 413 (not shown). The above-mentioned feed path 406 is provided with a nor-sort path sensor S401 for detecting the passing sheet, while the feed path 407 is provided with a sort path sensor S402. At the downstream side of the paired feed rollers 408, 411 there is provided the bin unit 403 provided with a plurality of bins B and supported vertically movably by a spring of which an end engages with a hook of the bin unit 403 and the other end is fixed to the body 402.

At the upper and lower parts at base end side of the bin unit 403, there are rotatably provided guide rollers 417, 419 in such a manner as to rotate in guide grooves 402, extending vertically in the body 402, thereby guiding the bin unit 403. The body 402 is also provided with a shift motor 421. A rotary shaft 422 rotatably supported by the body 402 is provided with a lead cam 423. A chain 426 engages with the output shaft of the shift motor 421, whereby the rotation thereof is transmitted, through the chain 426, to the rotary shaft 422.

The bin unit 403 is provided with a unit main body 421 consisting of a bottom frame 427 consisting of an inclined portion and a vertical portion, paired frames 429 provided vertically at the front and rear sides of the front end of the bottom frame 427, and a cover 430 supported the frames 429. At the front side of the unit main body 431, there is provided a reference plate which can align the sheets S by contact therewith.

At the rear side of the base end of the bottom frame 427, there is rotatably supported an unrepresented lower arm a, which is rotated by the aligning motor. Also in a position in the cover 430, opposed to the above-mentioned lower arm a, an upper arm a is fixed on a shaft rotatably supported by the cover 430, and a shaft a is provided at the centers of rotation of the upper and lower arms a. An aligning bar **439*a*** is supported by the ends of the upper and lower arms a and can be rotated by the aligning motor, thereby aligning the sheets S on the bins B toward the front side.

Similarly, at the front side of the base end of the bottom frame 427, there is rotatably supported an unrepresented lower arm b, which is rotated by the aligning motor. Also in a position in the cover 430, opposed to the above-mentioned lower arm b, an upper arm b is fixed on a shaft rotatably supported by the cover 430. An aligning bar **439*b*** is supported by the ends of the upper and lower arms b and can be rotated by the aligning motor, thereby aligning the sheets S on the bins B toward the rear side.

The above-mentioned aligning motors a, b are composed of stepping motors, whereby the positions of the aligning bars **439*a*, 439*b* can be exactly controlled by the number of pulses supplied to the stepping motor. There are also provided aligning bar home sensor S403*a*, S403*b* (not shown) for detecting the positions of the aligning bars 439*a*, 439*b***, whereby the positions thereof can be controlled by these sensors and the number of pulses supplied to the aligning motors a, b.

Each bin B is provided, at the front and rear sides at the front end, with engaging plates, which engage with supporting plates provided on the inner sides of the frames 429, thereby supporting the front end of the bin B. The bin B is further provided, at a predetermined distance from the shaft a, with a wide elongated aperture **443*a* which is longer than the rotating distance of the aligning bar 439*a* and sufficiently wider than the width thereof, and, at a predetermined distance from the shaft b, with a wide elongated aperture 443*b* which is longer than the rotating distance of the aligning bar 439*b* and sufficiently wider than the width of the aligning bar 439*b*. The base portion Ba of the bin stands vertically from a sheet storing surface Bb. The bin B is inclined, with the front end positioned higher, by a predetermined angle to the body 402**, and, because of this inclination, the sheets B slide on the sheet storage surface Bb and impinge at the rear ends of the sheets on the base portion Ba, thereby being aligned in the longitudinal direction.

The bin B is further provided with a notch in a position of entry of the stapler 412, in order to prevent interference therewith. In the elongated apertures **443*a* of the bins B1, B2, . . . there is inserted the aligning bar 439*a*, which can rotate in the apertures 443*a* to align the sheets S on the bins B toward the front side. Also the aligning bar 439*b* is inserted in the elongated apertures 443*b*** of the bins B1, B2, . . . and can rotate therein to align the sheets S on the bins B toward the rear side.

The above-mentioned lead cam 423 engages with a part of each bin, whereby the bin unit moves vertically along the grooves **423*a* by the rotation of the lead cam 423. Each turn of the lead cam 423 is detected by a lead cam sensor S404 provided in the vicinity thereof. Also the position of the bin unit 403 is detected by a bin home position sensor S405**.

Also the presence of the sheets S on the bin B is detected by a tray paper sensor S407 (sheet post process position selecting means).

In the vicinity of paired lower eject rollers 411, there is provided an electric stapler 412, for stapling the sheets S in each bin S, so as to be movable, by drive means, in a position perpendicular to the introducing direction of the sheets S. In the ordinary state, the stapler is retracted to a position D, so as not to hinder the vertical movement of the bins B, but is moved to a position E in the stapling operation of the sheets S. After the stapling operation, the electric stapler returns to the position D by the unrepresented drive means.

The electric stapler 412 effects the stapling operation by the rotation of an unrepresented motor, and, in case of stapling the sheets S of the plural bins B, after the stapling operation of the sheets S in a bin B, the bin unit 403 is moved to another bin position for stapling the sheets S in another bin B.

A manual stapling key S406 is used for effecting the stapling operation, when it is depressed after the sheet sorting.

Also the sheets S on the bins can be pushed out to the front side by the rotation of the rear aligning rod **439*a***.

FIGS. 2A and 2B are block diagrams of the control system of the color image forming apparatus embodying the present invention. The control system of the apparats can be divided into two blocks, one being a reader controller 700 for principally controlling the reader unit 201 and the image process unit 203, and the other being a printer controller 701 for controlling the printer unit 202.

There are also provided an optical motor driver 702 for driving an unrepresented optical motor for moving the scanning mirrors 32*a*, 32*b*, 32*c* and the exposure lamp 32; an RDF control unit 703 for controlling the RDF 600 for automatically changing the originals; an operation unit 900 for setting the operation mode of the color image forming apparatus; a RAM 705 storing the control programs of the reader controller 700; a RAM 706 for storing various data such as control values; and an I/O unit for driving the loads such as the exposure lamp 32. The RAM 706 is backed up with a battery so as to retain the data even when the power supply is cut off.

The printer controller 701 is provided with a ROM 750 storing the control programs of the printer controller 701; a RAM 751 for storing various data such as control values; an A/D converter 752 for converting analog signals for example from the potential sensor 12 and the on-drum light amount sensor 13 into digital data; a D/A converter 753 for sending analog set values to a high-voltage control unit 770 etc.; and an I/O unit 754 for driving loads such as motors and clutches.

C. RDF control unit (900)

Figures 28, 28A:
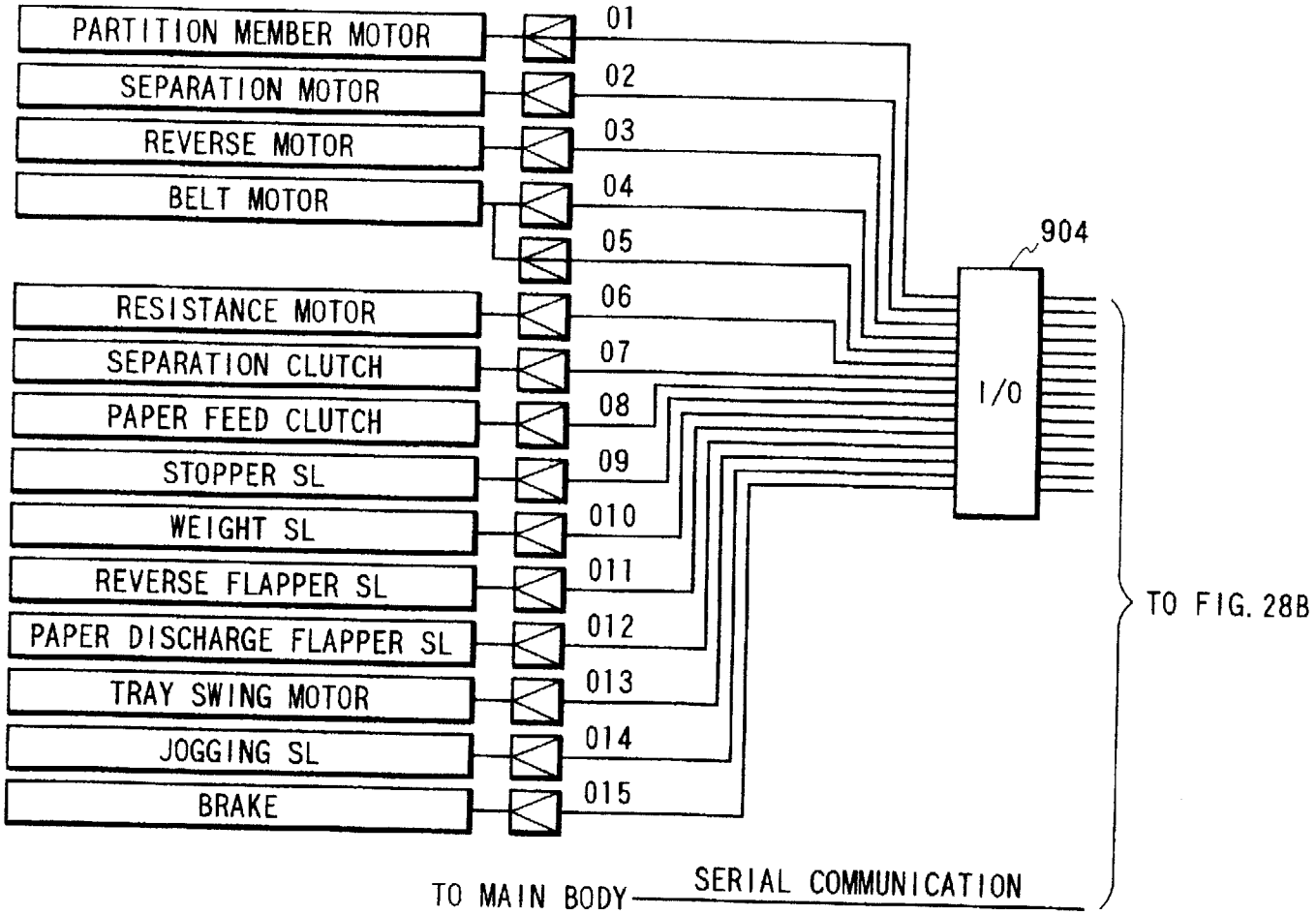
FIG. 28 is comprised of FIGS. 28A and 28B showing block diagrams of an RDF control unit.
Figure 28B:
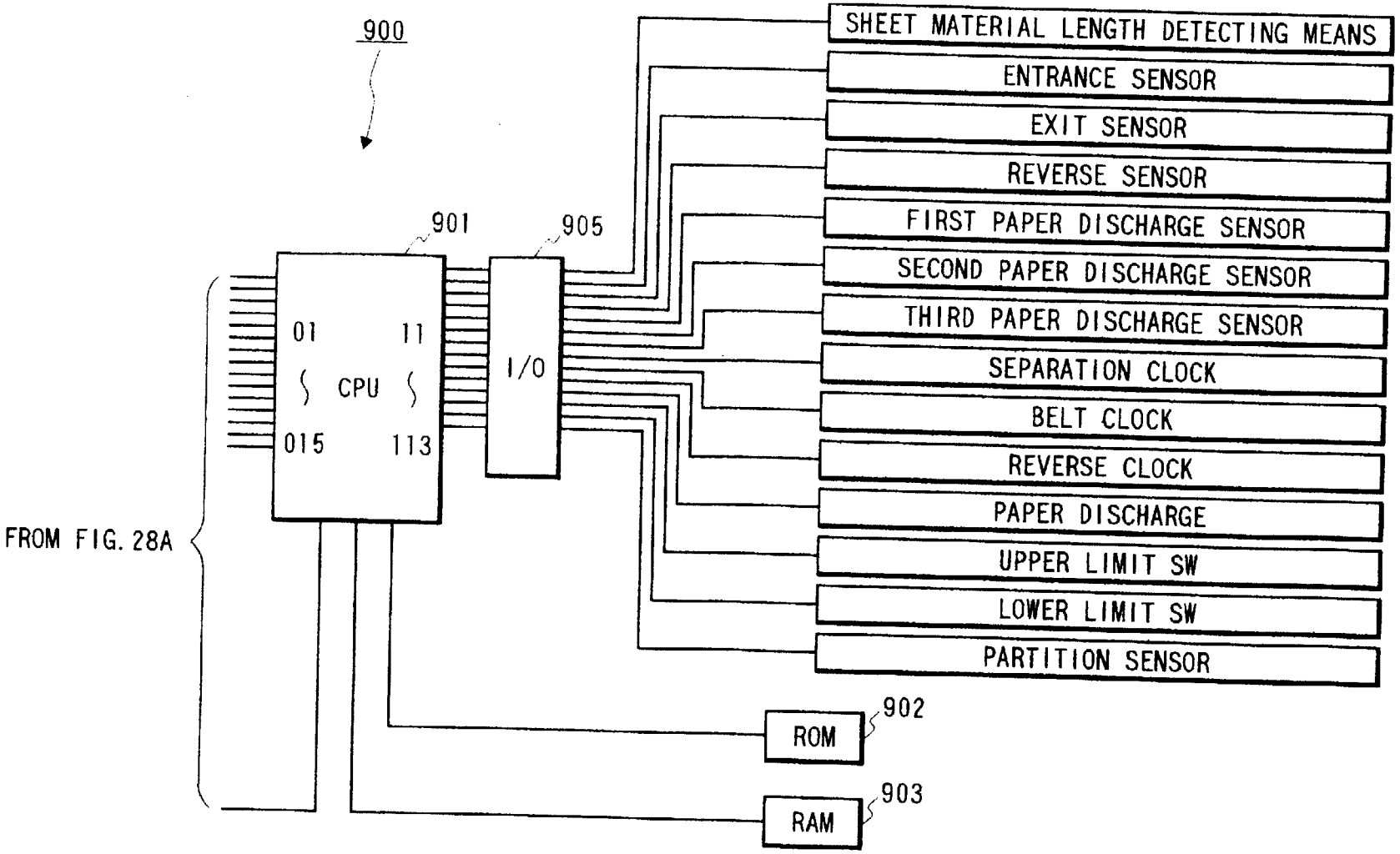

FIGS. 28A and 28B are block diagrams showing the circuit configuration of the RDF control unit 900, which is provided with a central processing unit (CPU) 901, a ROM 902, a RAM 903, an output port 904, an input port 905, etc. The ROM 902 stores the control programs, and the RAM 903 is used for storing input data and work data. The output port 904 is connected to the motors, such as the aforementioned separation motor, and solenoid drive means, while the input port 905 is connected to the sheet feed sensor, etc., and the CPU 901 controls the various units connected through a bus, according to the control programs stored in the ROM 902. The CPU 901 is provided with a serial interface function and effects serial communication with the CPU of the reader control unit 700, thereby exchanging the control data therewith. The data transmitted from the RDF control unit 900 to the reader control unit 700 include, for example, a sheet feed completion signal, indicating the completion of original feeding onto the original supporting glass.

D. Sorter control unit (1000)

Figure 29:
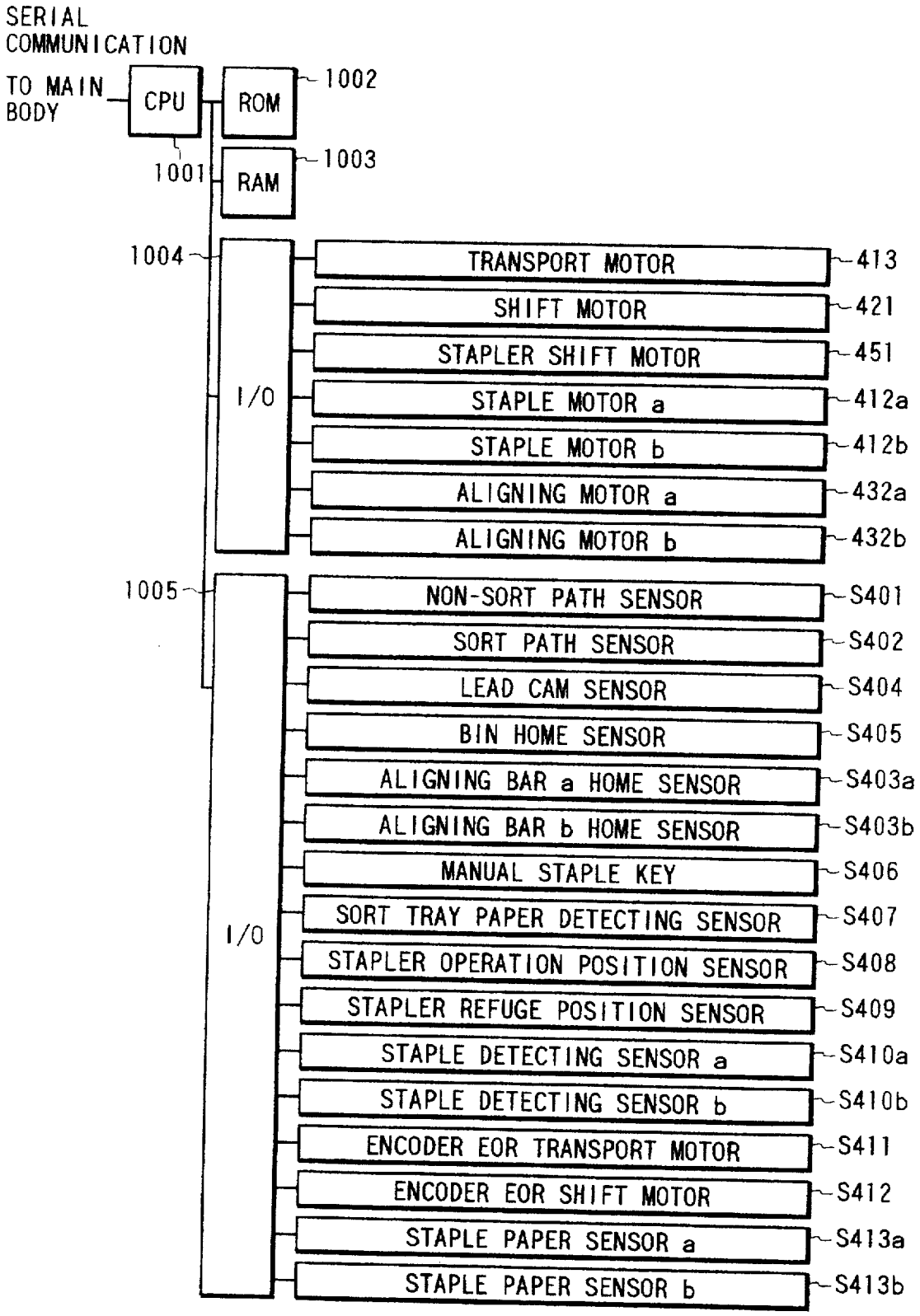
FIG. 29 is a block diagram of a sorter control unit.

FIG. 29 is a block diagram showing the circuit configuration of a sorter control unit 1000, which is provided with a central processing unit (CPU) 1001, a ROM 1002, a RAM 1003, an output port 1004, an input port 1005. The ROM 1002 stores the control programs, and the RAM 1003 is used for storing input data and work data. The output port 1004 is connected to various motors such as the aforementioned shift motor 416, while the input port 1005 is connected to the sensors S401 to S406, including the non-sort path sensor S401, and various switches, and the CPU 1001 controls the various units connected through a bus, according to the control programs stored in the ROM 1002. The CPU 1001 is provided with a serial interface function and effects serial communication with the CPU of the printer control unit 701, thereby controlling the various units according to the signals from the printer control unit 701.

Figure 46:
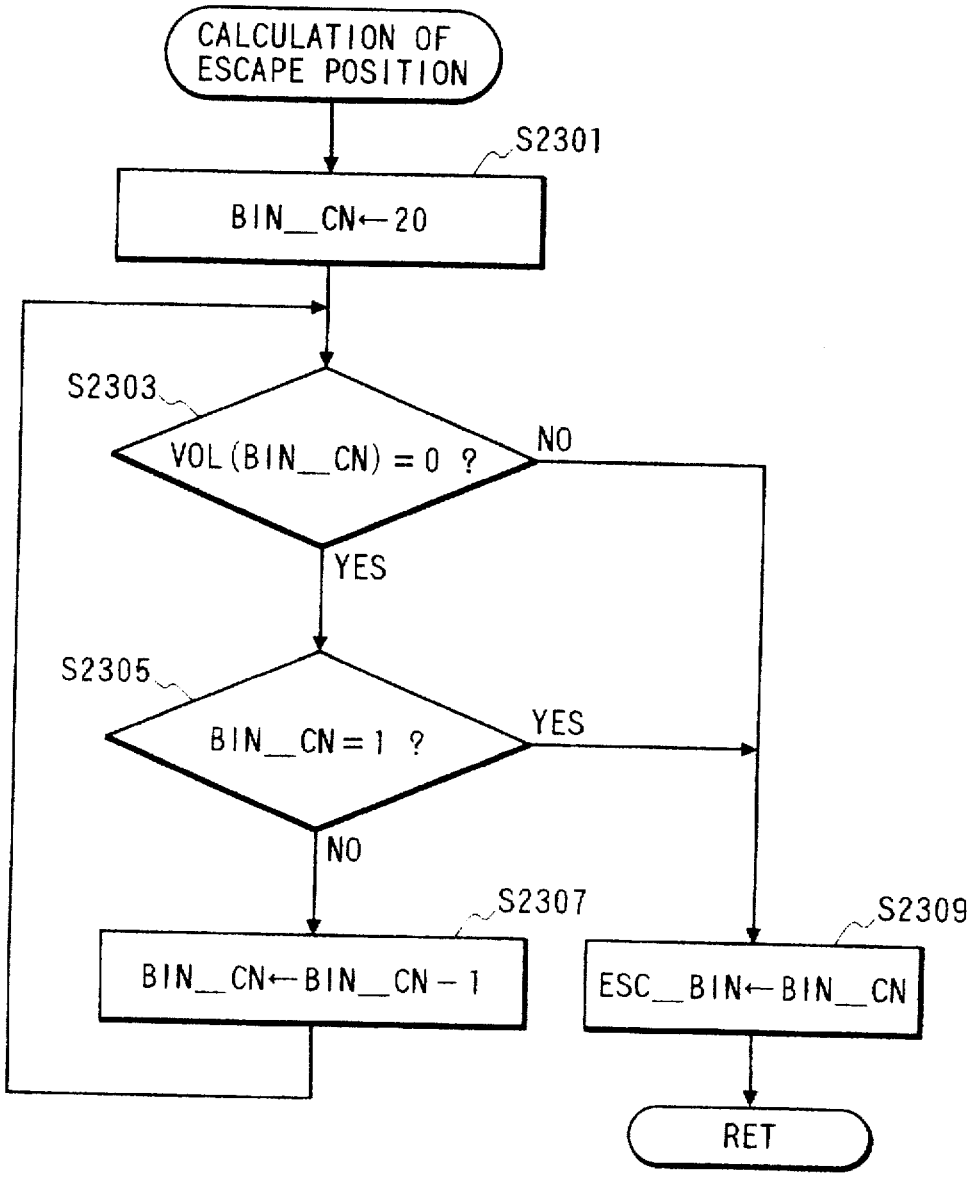
Figure 47:
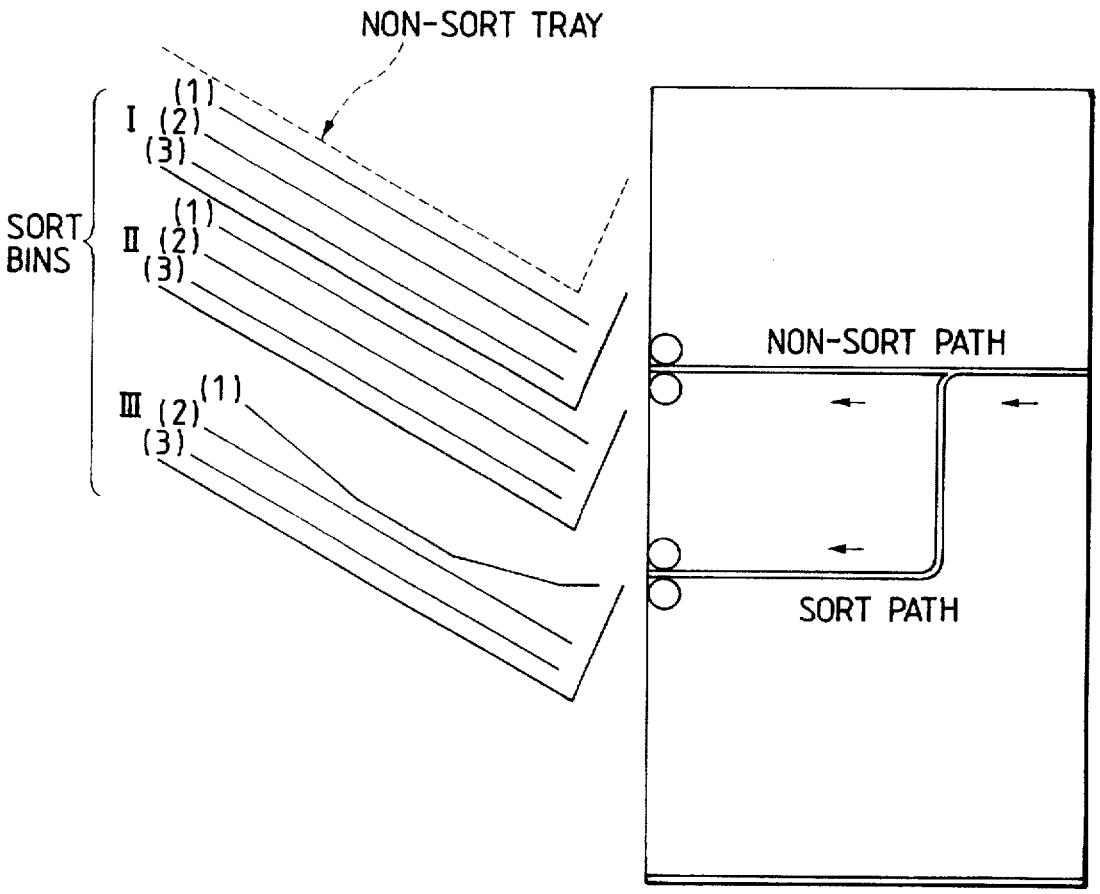
FIGS. 47 and 48 are views showing the principle of control.

In the following there will be explained the control sequence in the sorter control unit 1000 in the present embodiment, with reference to flow charts in FIGS. 30 to 46 and to FIGS. 47 and 48.

(1) Mode processing

Figure 30:
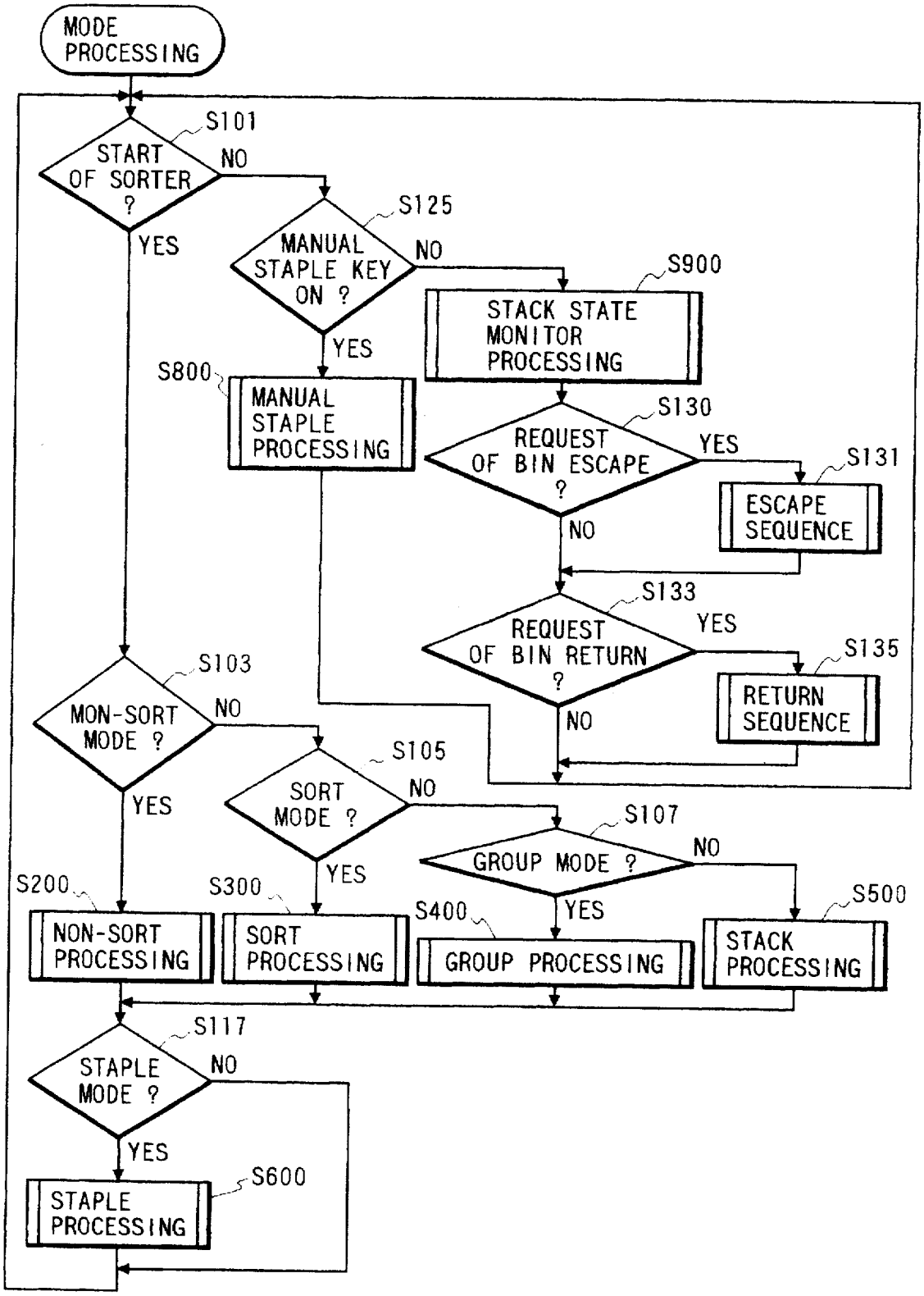
FIGS. 30 to 46 are control flow charts.
Figure 31:
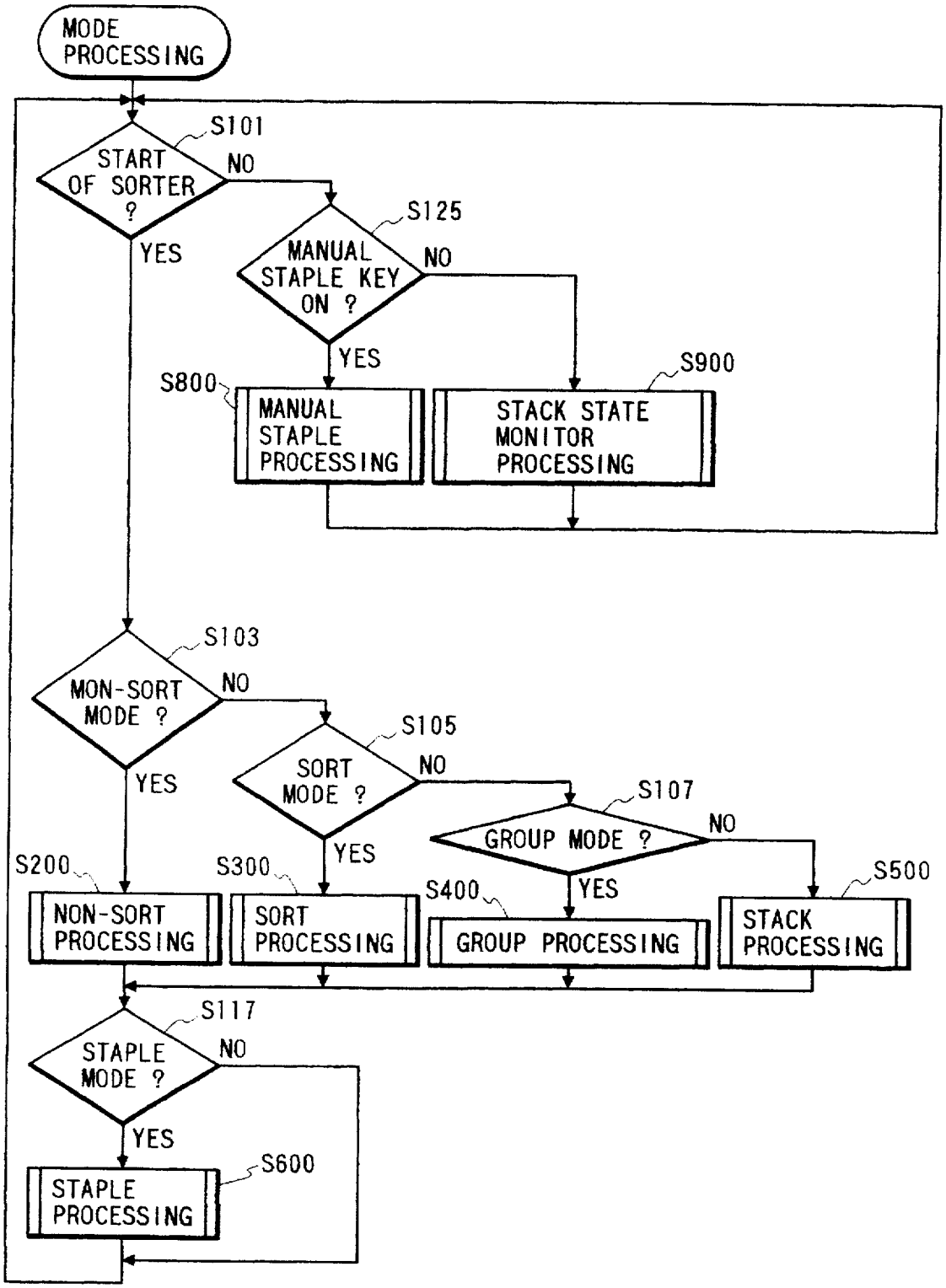
Figure 38:
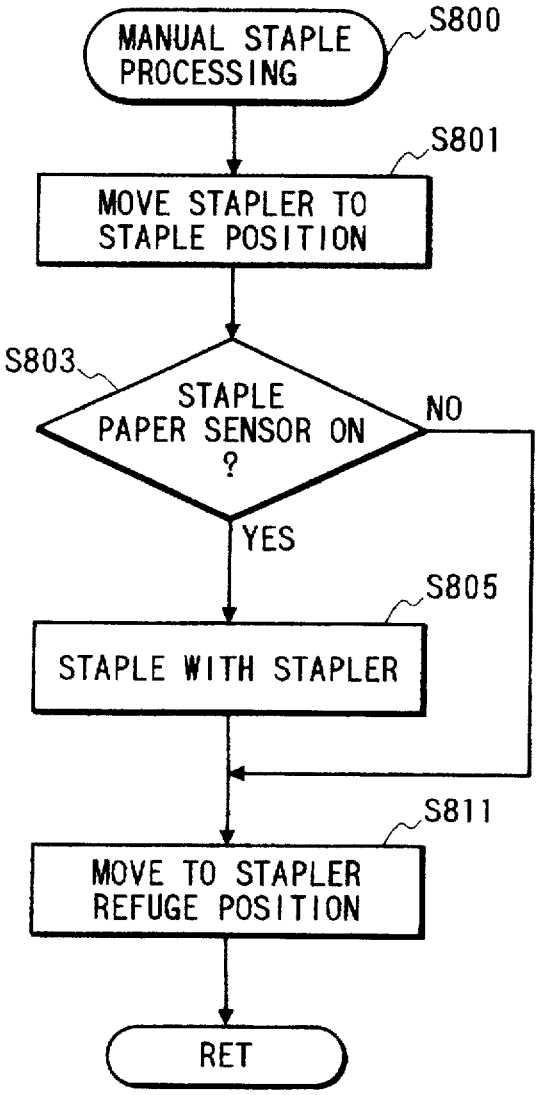
Figure 39:
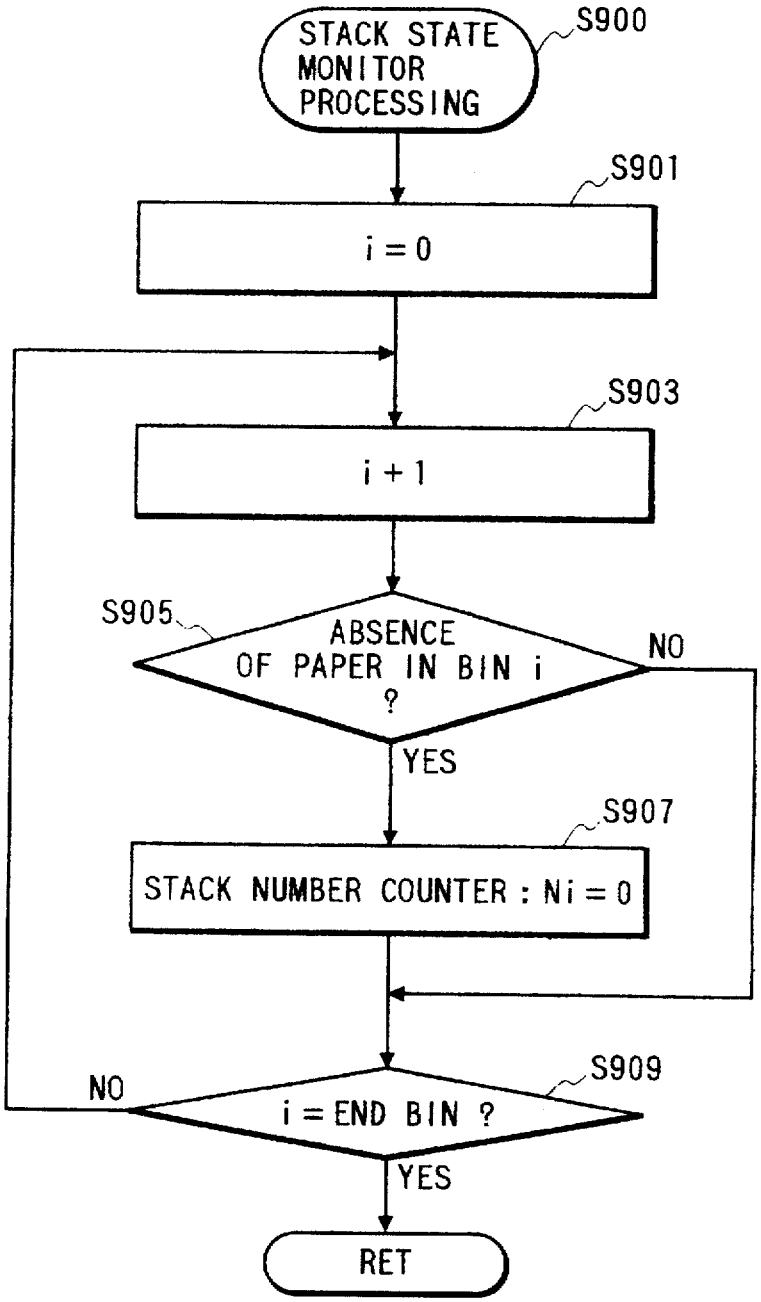

At first reference is made to FIG. 30 for explaining a mode processing which is the entire process of the present embodiment. A step S101 discriminates the presence of a "sorter start signal" indicating the start of sheet ejection from the main body of the copying apparatus, and, if present, the sequence proceeds to a step S103. If absent, a step S125 discriminates whether the manual staple key has been turned on, and, if on, there is executed a manual stapling process (step S800; to be explained later: FIG. 38). If off, a step S900 executes a stack state monitoring process (to be explained later: FIG. 39). Then there is checked a request for bin retraction (step S130), and, if the request is present, there is executed a retraction sequence (step S131). Also there is checked a request for bin returning (step S133), and, if the request is present, there is executed a returning sequence (step S135). Subsequently the sequence returns to the step S101. The bin retracting request in the step S130 is given after the end of the copying operation in the copying apparatus, at the abnormal stopping therein, or at the interruption of the copying operation of the copying apparatus. Also the bin returning request in the step S133 is given at the start of the copying operation in the copying apparatus.

Steps 130 to 107 judge the modes relating to the storage of the sheets discharged from the copying apparatus and the sequence branches accordingly. More specifically, in case of a non-sort mode, there is executed a non-sort process to be explained later (steps 103, 200). In case of a sort mode there is executed a sorting process to be explained later (steps 105, 300). Also in case of a group mode, there is executed a group process to be explained later (steps 107, 400), and, otherwise, the sequence proceeds to a stack process to be explained later (step S500). After the respective process, if a stapling mode is identified (step S117), there is executed a stapling process to be explained later (step S600), and the sequence returns to the step S101.

(2) Non-sort process

Figure 32:
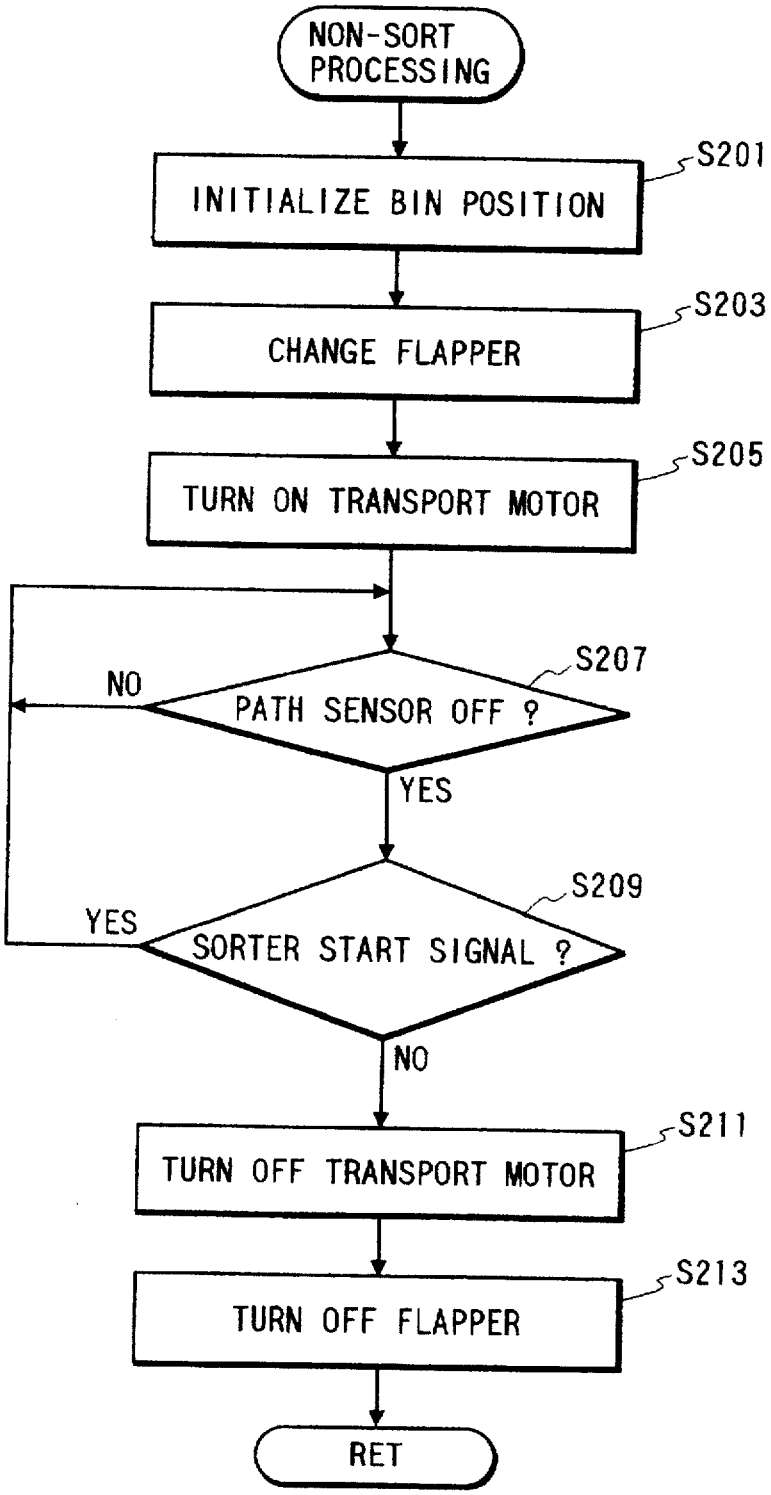
Figure 40:
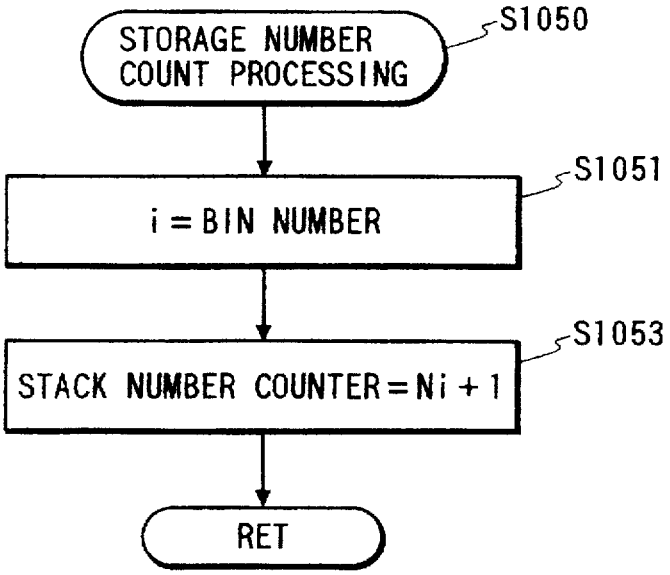
Figure 41:
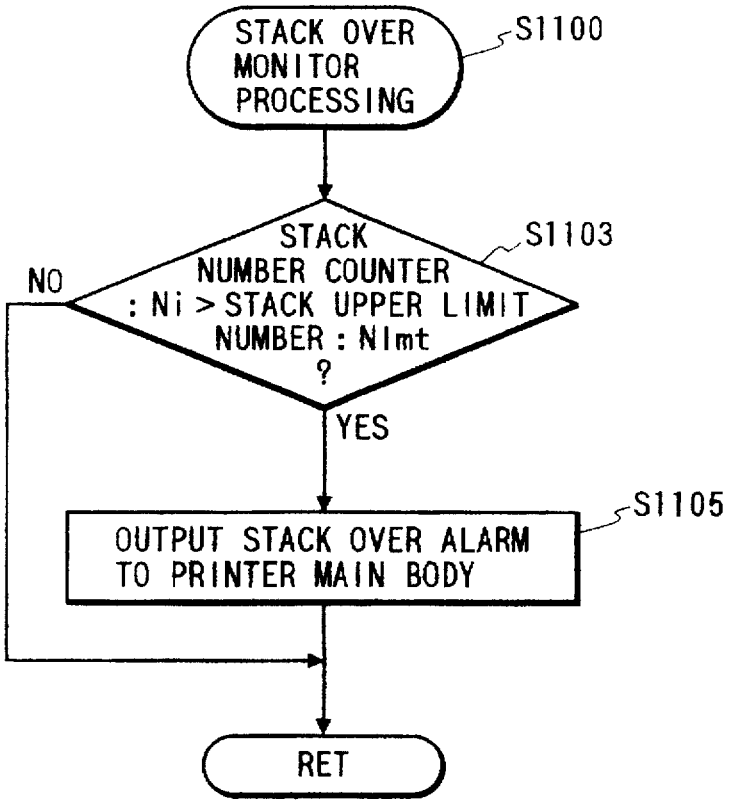

The operations of the above-mentioned non-sort mode will be explained with reference to FIG. 32. At first, for storing the sheet in the uppermost bin, the bin unit is lowered, as the initialization, to a non-sort home position (step S201). Then, the flapper 409 is switched to select a sheet feed path 406 in the sorter (step S203). The flapper 409 is provided with a driving solenoid (not shown), and is so constructed as to select a feed path 407 or 406 respectively when the solenoid is turned off or on. Subsequently a step S205 turns on the feed motor for sheet feeding, then a step S207 checks the on-off state of the path sensor, and the sequence proceeds to a step S1050 (FIG. 40) for counting the number of the stored sheets. This process is to count the number of the sheets passing through the feed path for storage in the bins. Then, after an overstocking monitoring process (step S1100; to be explained later; FIG. 41), there is checked the presence of the "sorter start signal" (step S209). If the signal is on, the sequence returns to the step S207, but, if off, a step S211 stops the feed motor, and a step S213 turns off the above-mentioned solenoid, thereby terminating the non-sort process.

(3) Sorting process

Figure 33:
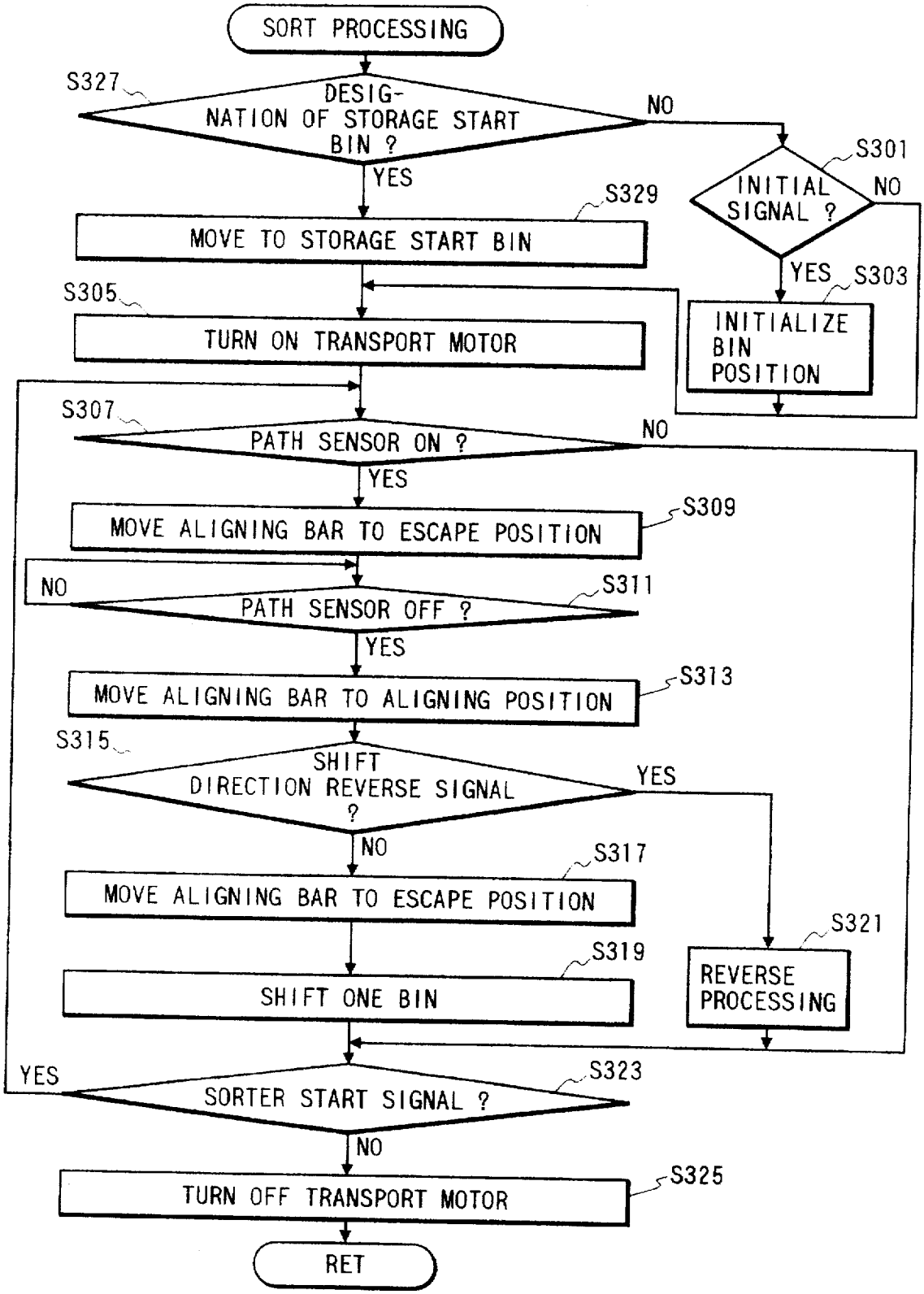

The operations of the sorting mode will be explained with reference to FIG. 33. At first there is discriminated whether a starting bin position is designated (step S327), and, if designated, the bin unit is moved to such designated position (step S329). If not designated, there is checked the presence of a "bin initial signal" for effecting the sheet storage from the uppermost bin (step S301), and the sequence proceeds to a step S303 or S305 respectively if the signal is present or absent. The step S303 lowers the bin unit, as the initialization, to the non-sort home position. The step S305 turns on the feed motor, and a next step S307 checks whether the path sensor is turned on. If it is off the sequence proceeds to a step S323, but, if on, a step S309 effects retraction of the aligning bars, for aligning the ejected sheets afterwards. Subsequently, when the turning-off of the path sensor is detected, there are executed an alignment of the stored sheets (step S313), a sheet number counting process (step S1050; FIG. 40) and an overstacking monitoring process (step S11O0; FIG. 41). Then a step S315 discriminates the presence of a shift direction reversing signal, and, if present, there is executed a reversing process (step S321), but, if absent, there are executed a retraction of the aligning bars (step S317) and a 1-bin shift (step S319). The reversing process does not effect the bin shift but reverses the bin shifting direction thereafter. Then a step S323 discriminates the on-off state of the "sorter start signal", and, if on, the sequence returns to the step S307, but, if off, a step S325 stops the feed motor and terminates the sorting process.

(4) Group process

Figure 34:
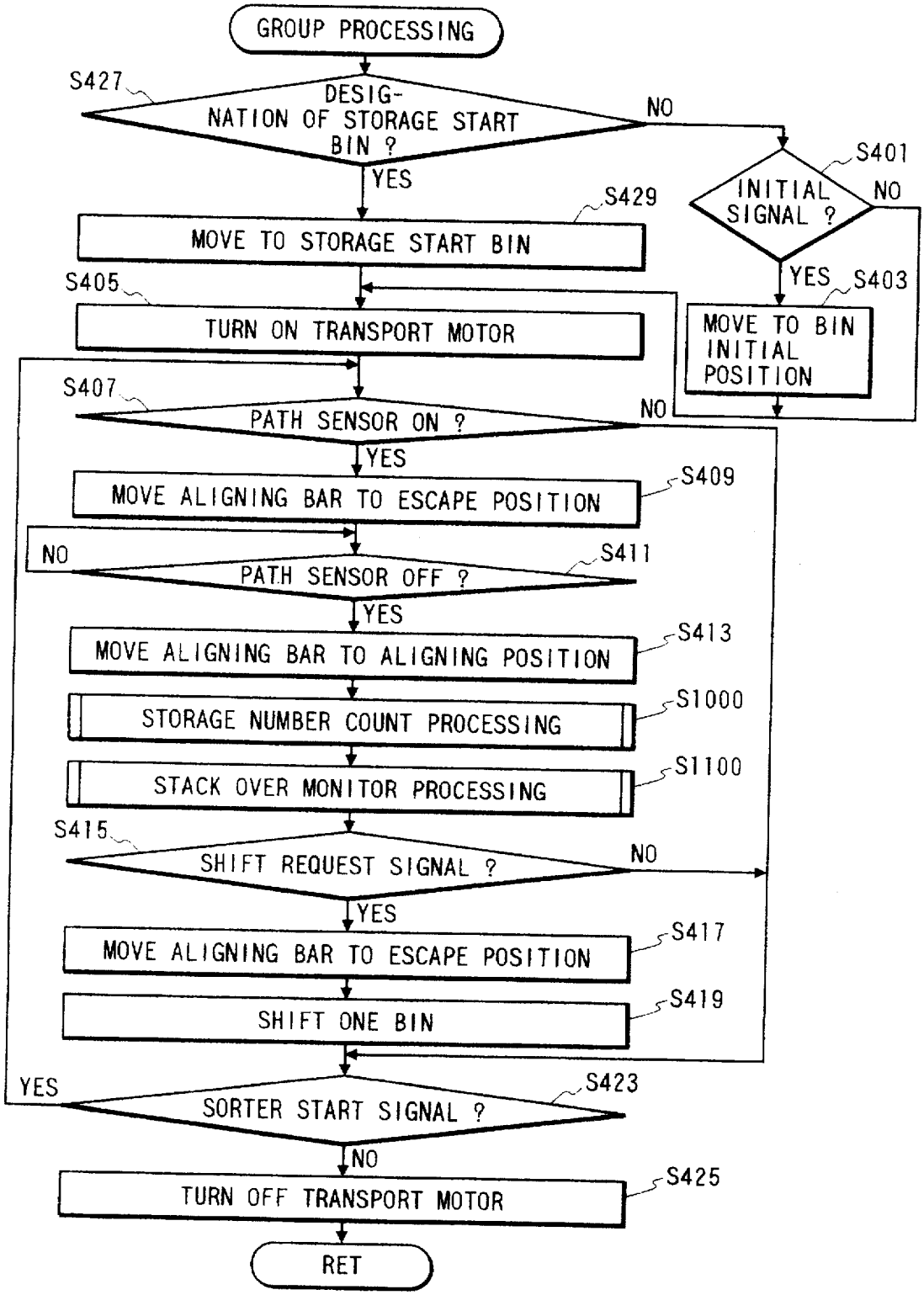

The operations of the group mode will be explained with reference to FIG. 34. At first there is discriminated whether a starting bin position is designated (step S427), and, if designated, the bin unit is moved to such designated position (step S429). If not designated, there is checked the presence of a "bin initial signal" for effecting the sheet storage from the uppermost bin (step S401), and the sequence proceeds to a step S403 or S405 respectively if the signal is present or absent. The step S403 lowers the bin unit, as the initialization, to the non-sort home position. The step S405 turns on the feed motor, and a next step S307 checks whether the path sensor is turned on. If it is off the sequence proceeds to a step S423, but, if no, a step S409 effects retraction of the aligning bars, for aligning the ejected sheets afterwards. Subsequently, when the turning-off of the path sensor is detected, there are executed an alignment of the stored sheets (step S413), a sheet number counting process (step S1050; FIG. 40) and an overstocking monitoring process (step S1100; FIG. 41). Then a step S415 discriminates the presence of a bin shift signal, and, if present, there are executed the retraction of the aligning bars (step S417) and the 1-bin shift operation (step S419), but, if absent, the sequence proceeds to a step S423. The step S423 discriminates the state of the "sorter start signal", and, if on, the sequence returns to the step S407, but, if off, a step S425 turns off the feed motor and terminates the group process.

(5) Stack process

Figure 35:
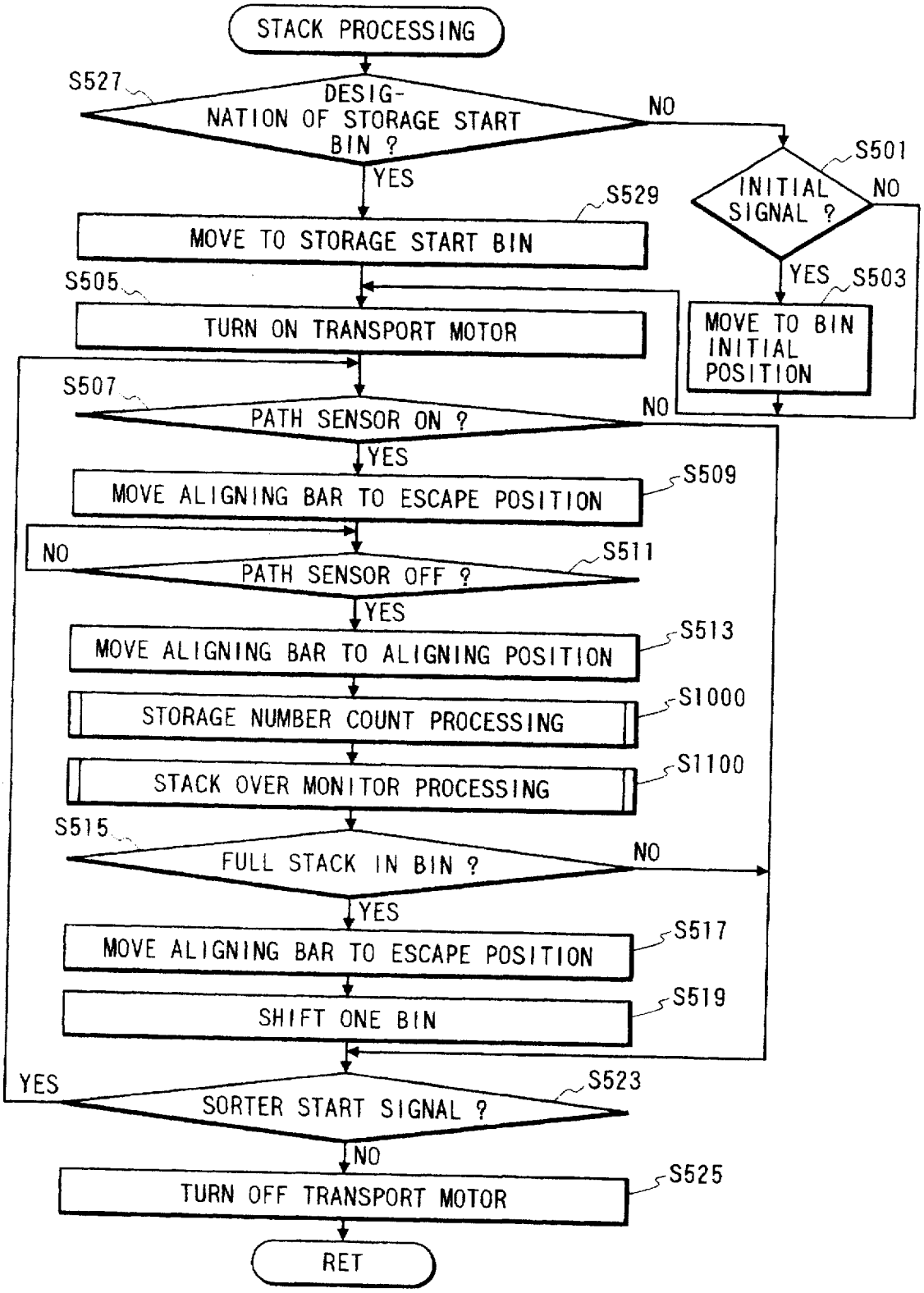

The operations of the stack mode will be explained with reference to FIG. 35. At first there is discriminated whether a starting bin position is designated (step S527), and, if designated, the bin unit is moved to such designated position (step S529). If not designated, there is checked the presence of a "bin initial signal" for effecting the sheet storage from the uppermost bin (step S501), and the sequence proceeds to a step S503 or S505 respectively if the signal is present or absent. The step S503 lowers the bin unit, as the initialization, to the non-sort home position. The step S505 turns on the feed motor and a next step S507 checks whether the path sensor is turned on. If it is off the sequence proceeds to a step S523, but, if on, a step S509 effects retraction of the aligning bars, for aligning the ejected sheets afterwards. Subsequently, when the turning-off of the path sensor is detected, there are executed an alignment of the stored sheets (step S511), a sheet number counting process (step S1050; FIG. 40) and an overstocking monitoring process (step S1100; FIG. 41). Then a step S515 discriminates whether the number of sheets stored in a bin currently in the storing operation has reached an upper limit number, and, if not, the sequence proceeds to a step S523, but, if reached, there are executed the retraction of the aligning bars (step S517) and the one-bit shift operation (step S519). Then a step S523 discriminates the state of the "sorter start signal", and, if it is on, the sequence returns to the step S507, but, if off, a step S525 turns off the feed motor and terminates the stack mode.

(6) Stapling process

Figure 36:
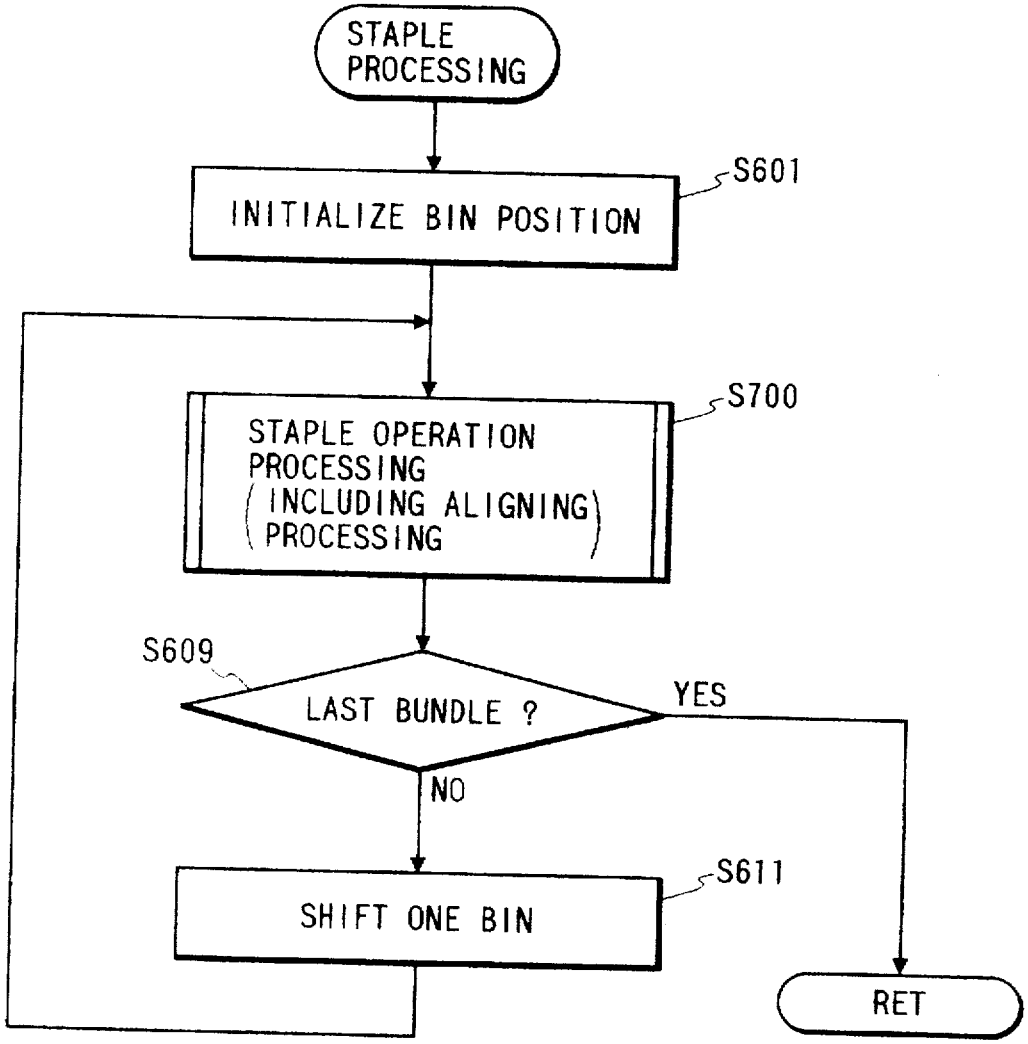

In the following the operations of the stapling mode will be explained with reference to FIG. 36, which is a flow chart showing the control sequence of the stapling mode. At first a step S601 initializes the bin position for the stapling process. The initialized bin position is the uppermost or lowermost one among the bins used. After the bin movement, there is selected a downward or upward shifting direction respectively in case of the upper or lower bin position. Then the sequence proceeds to a step S700 for effecting the stapling process, as will be explained later in more details. After the stapling process, the sequence proceeds to a step S609 to discriminate whether the stapled bundle is the last one in a series of stapling process, and, if so, the stapling process is terminated, but, if not, the sequence returns, after a one-bin shift operation, to the step S700 to continue the process.

Figure 37:
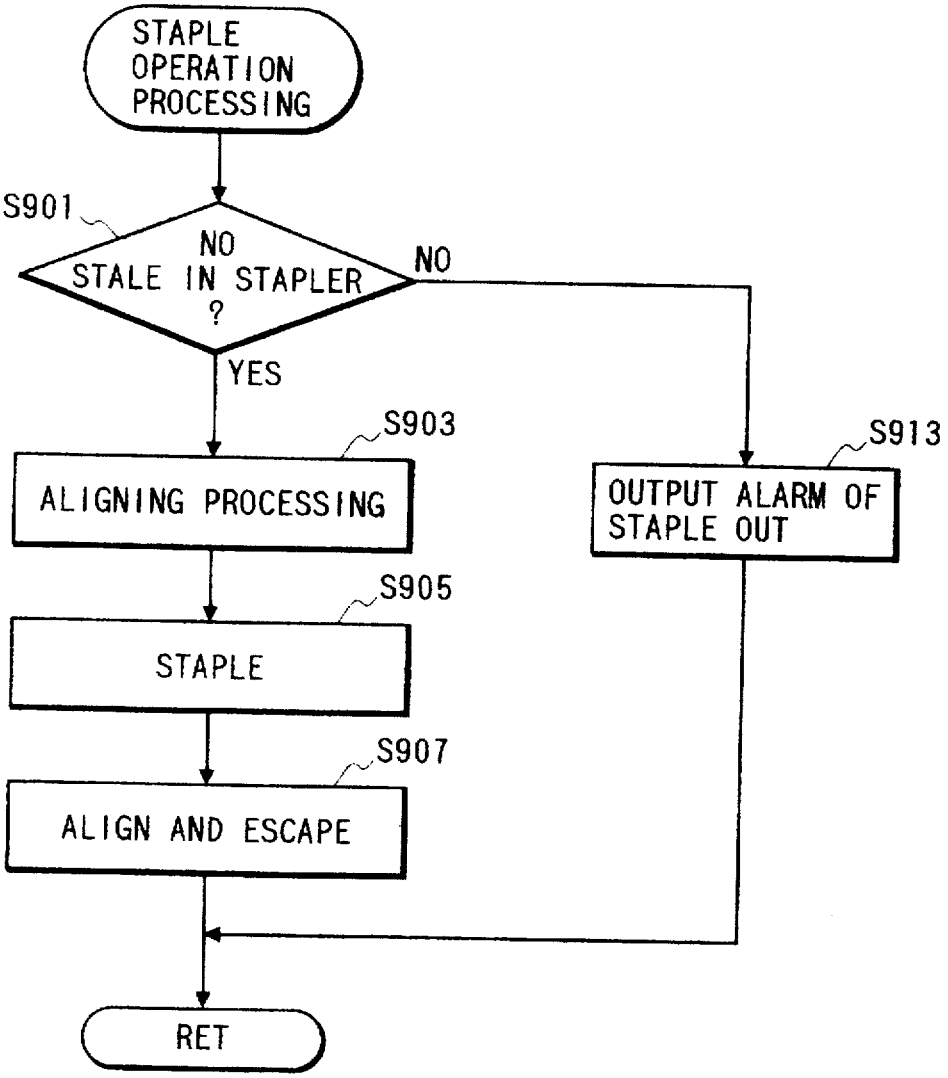

Now the details of the stapling process will be explained with reference to FIG. 37. At first a step S901 discriminates whether the stapler contains a staple, and, if the staple is present, the sequence proceeds to a step S903 and the bundle of sheets is supported by the aligning bars. Then a step S905 effects the stapling operation, and a step S907 retracts the aligning bars to complete the one-spot stapling process. On the other hand, if the step S901 identifies the absence of the staple, a step S913 sends a no-staple alarm to the main body and the process is terminated.

(7) Manual stapling process

The operations of the manual stapling process will be explained with reference to FIG. 38. The manual stapling mode is to staple a bundle of sheets already present on a bin or inserted into a bin by the user, and effects the stapling only for a bin. At first a step S801 moves the stapler to the stapling position. After the movement, a stapler paper sensor a, provided in the vicinity of the stapler, discriminates whether sheets are present in a position corresponding to the stapler (step S803). If present, the sequence proceeds to a step S805 to effect stapling by the stapler a. When the stapler 803 identifies absence of sheets corresponding to the stapler a or after the stapling in the step S805, the sequence proceeds to a step S811 to retract the stapler, whereby the process is terminated.

(8) Stack state monitoring process

In the following there will be explained a stack state monitoring process with reference to FIG. 39. At first a program counter i is cleared (step S901). Then a step S903 effects an increment of the counter, and a step S905 checks the sheet sensor in an i-th bin from the top. If sheet is present, the sequence proceeds to a step S909, but, if sheet is absent, a stacked sheet number counter Ni, provided for each bin, is cleared to 0 (step S907). Subsequently similar processes are conducted for all the bins (steps S903 to S909), and the process is terminated after the process for the last bin (step S909).

Now reference is made to FIG. 40 for explaining a stored sheet number counting process. At first a step S1001 sets the program counter i to a bin number in which the sheet ejection is to be made, then a step S1003 effects an increment in the stacked sheet number counter corresponding to the number i.

In the following explained is an overstocking monitoring process, with reference to FIG. 41. A step S1103 discriminates whether the number of sheets currently stored in the bin exceeds a predetermined upper limit number, and, if not, the process is terminated, but, if exceeding, an overstocking alarm is sent to the printer body (step S1105). This overstacking alarm is communication data, to the printer, indicating that a number of sheets exceeding a predetermined number are stored in the sorter, and, in response to such data, the printer immediately terminates the sheet feeding for image formation, thereby terminating the sheet ejection to the sorter. (The operation is continued after the alarm state is resolved.)

Figure 42:
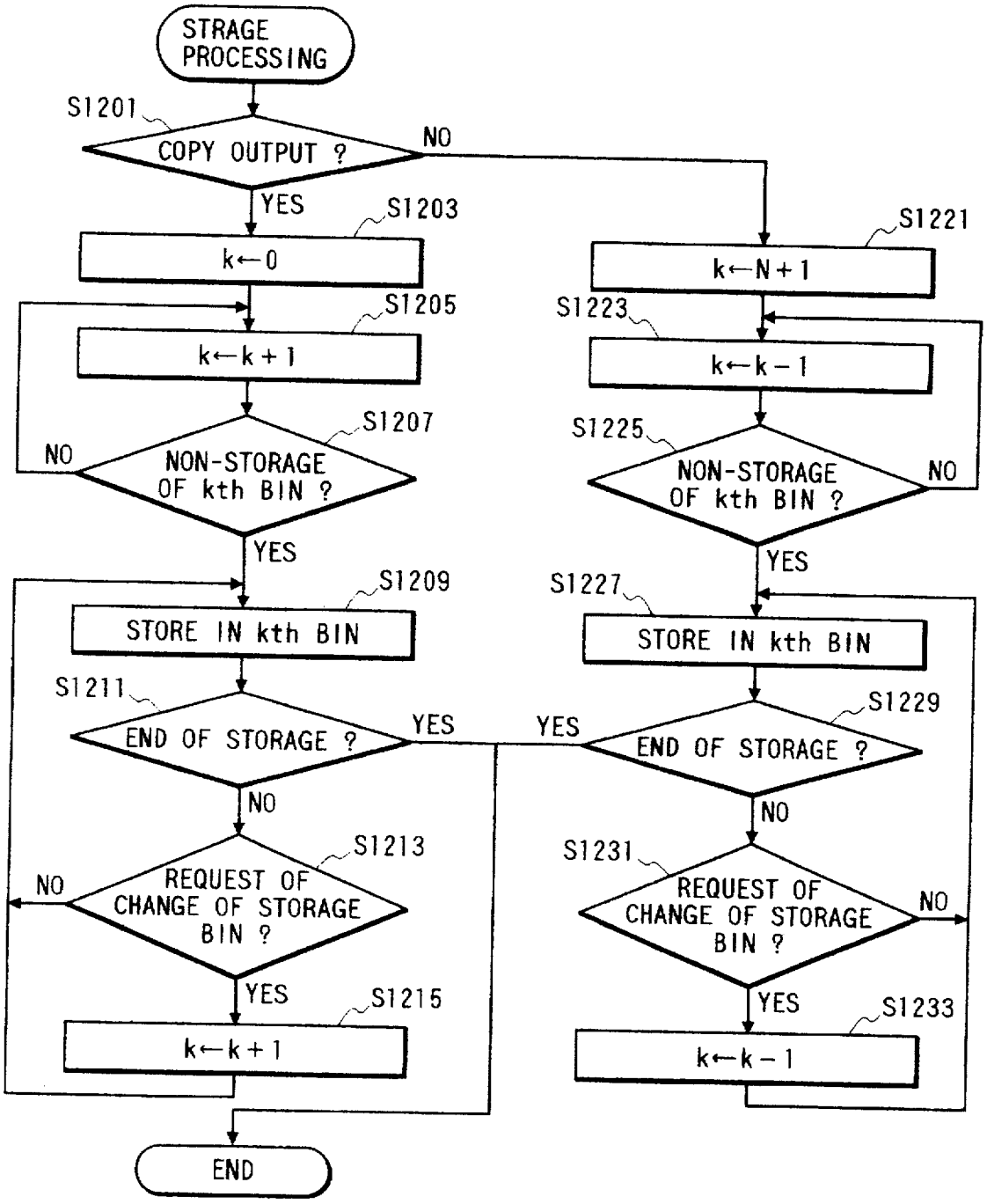

In the following there will be explained a storage process with reference to FIG. 42. At first a step S1201 discriminates whether the output is obtained by a copying operation, and the sequence proceeds to a step S1203 or S1221 respectively if the result of discrimination is affirmative or negative. The step S1203 initializes a bin counter k to 0. Then a step S1205 effects an increment of the counter k, and a step S1207 discriminates whether a k-th bin stores a sheet. If stored the sequence returns to the step S1205, but, if not, a step S1209 stores a sheet in the k-th bin. If the stored sheet is the last sheet, the process is terminated, but, if not, there is discriminated the presence of a request for changing the storage bin (step S1213), and, if absent, the sequence returns to the step S1209, but, if present, a step S1215 effects an increment of the bin counter k and the sequence returns to the step S1209.

Then, a step S1221 initializes the bin counter k to N+1. Then a step S1223 effects a decrement of the counter k, and a step S1225 discriminates whether a sheet is stored in the k-th bin. If stored, the sequence returns to the step S1223, but, if not, a step S1227 stores the sheet in the k-th bin. The process is terminated is the stored sheet is the last sheet, but, if not, a step S1231 discriminates the presence of a request for changing the storage bin. If the request is absent, the sequence returns to the step S1227, but, if present, a step S1233 effects a decrement of the bin counter k and the sequence returns to the step S1227.

Figure 43:
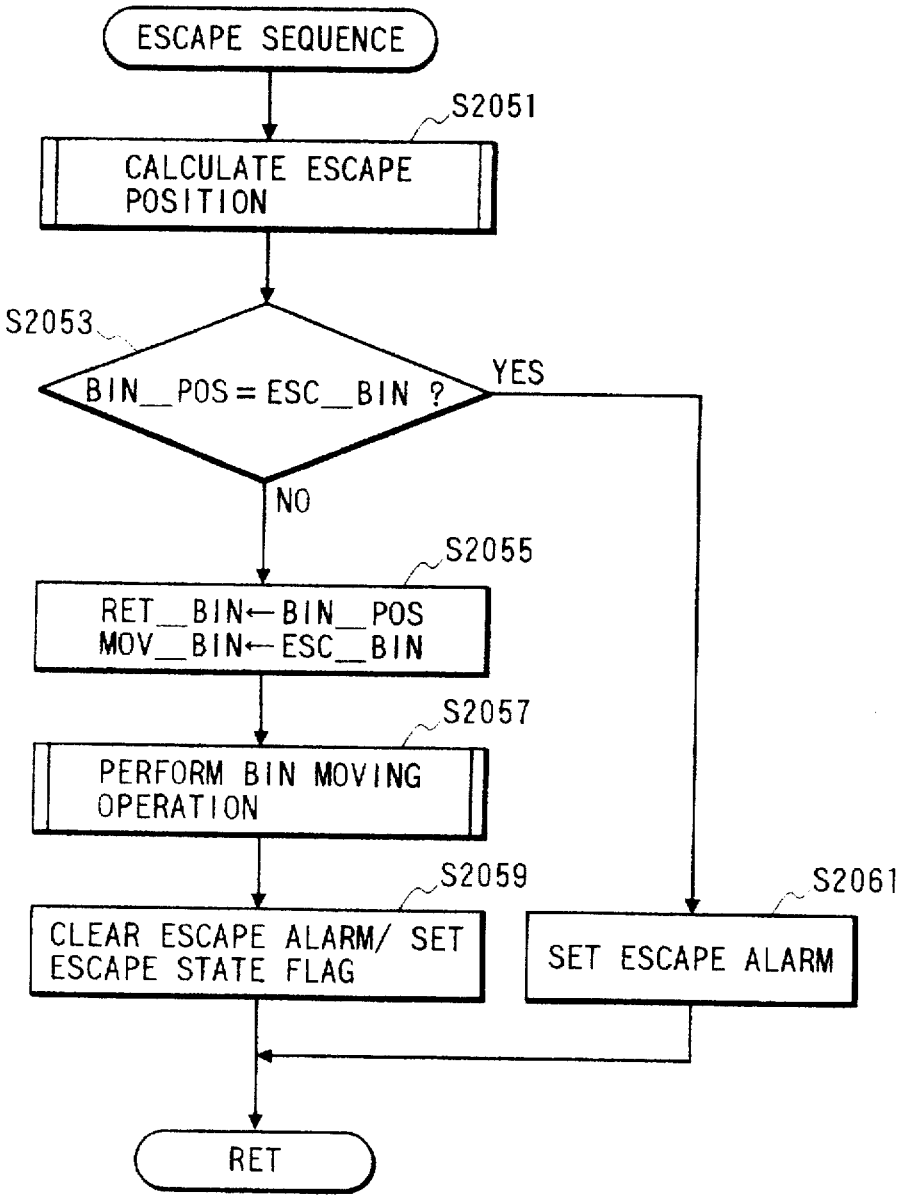
Figure 44:
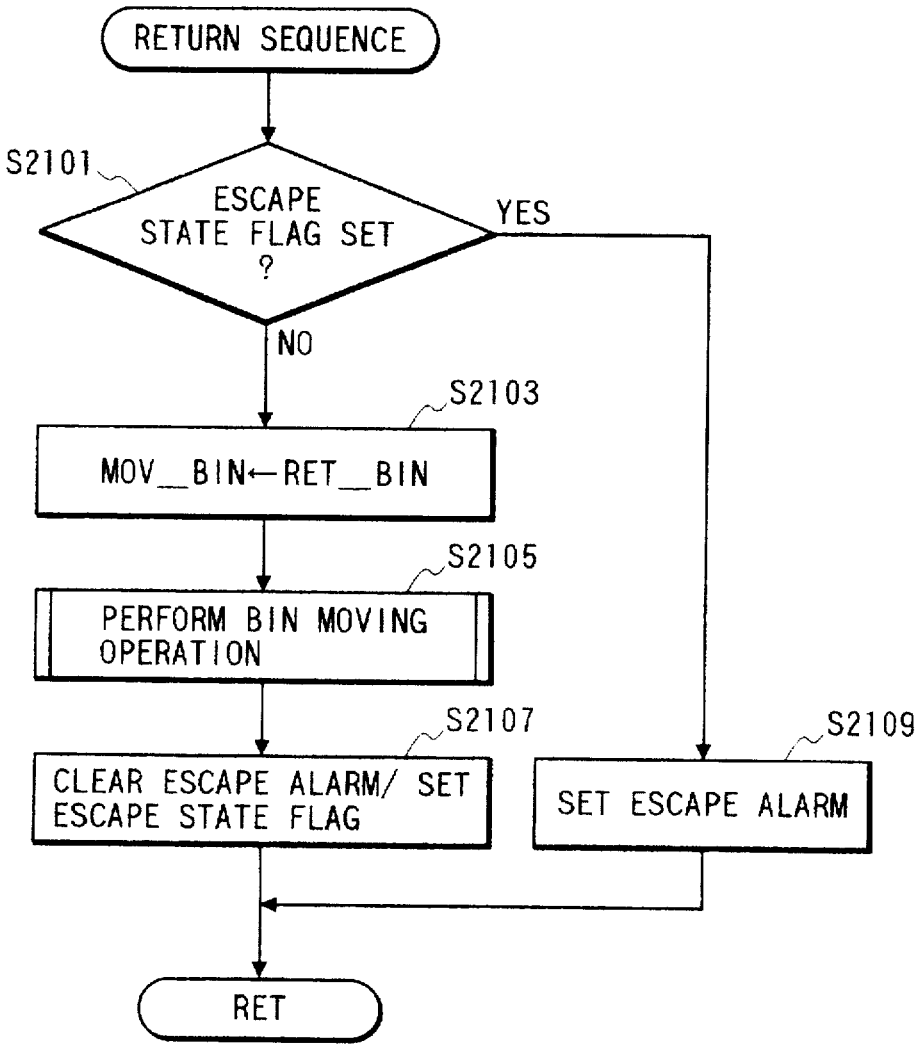

Then, an escape sequence will be explained with reference to FIG. 43. A step S2051 calculates a target escape position by a process to be explained later, and, if a step S2053 identifies that the result of the calculation is same as the current bin, there is no need for escape, so that a step S2061 sets an escape alarm and the process is terminated. On the other hand, if the result of calculation is different, a step S2055 stores the current bin position (BIN_POS) in a returning position (RET_BIN), and a step S2057 effects a bin movement to the escape position (ESC_BIN). After the bin movement, the escape alarm is cleared, and an escape state flag is set (step S2059).

In the following there will be explained a return process with reference to FIG. 44. At first a step S2101 discriminates whether an escape state is present, and, if not, there is no need for the returning operation, so that an escape alarm is set (step S2109) and the process is terminated. If the escape state is present, there is executed a bin movement to the return position (RET_BIN) (steps 2103, 2105). Then the escape alarm is cleared and an escape state flag is set (step S2107).

Figure 45:
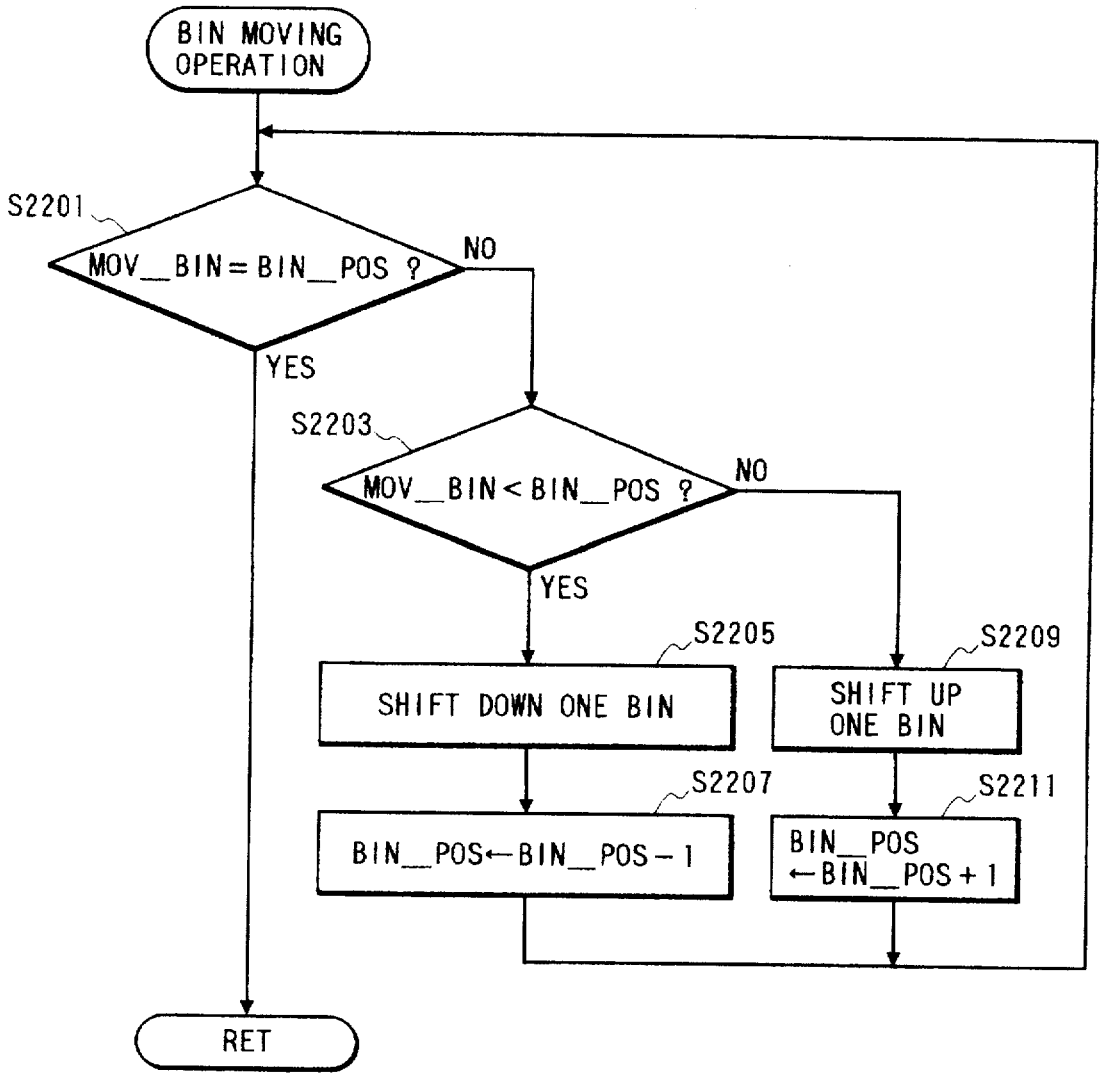

In the following there will be explained a bin moving operation, with reference to FIG. 45. At first the current bin position (BIN_POS) is compared with the destination (MOV_BIN) (step S2201), and the process is terminated if they are same, but, if they are different, the sequence proceeds to a step S2203, which discriminates the magnitude relationship of the current bin position (BIN_POS) and the target position of movement. If the target bin is smaller, a 1-bin downshift operation is executed (step S2205) and a decrement is made in the current position counter (step S2207). If the target bin is larger, a 1-bin upshift operation is executed (step S2209), and an increment is made in the current position counter (step S2211).

In the following there will be explained the calculation of the escape position, with reference to FIG. 46. At first a number "20" (indicating the position of the lowermost bin in the present embodiment) is set in a bin position counter (BIN_CN) (step S2301).

There is confirmed the number of sheets (VOL: (BIN_CN)) in a bin indicated by the bin position counter (BIN_CN), and, if the number is 0, the sequence proceeds to a step S2309 and the count of the bin position counter (BIN_CN) is stored as the escape position (ESC_BIN). If the above-mentioned number is not zero, there is confirmed whether the count of the bin position counter is "1" (step S2305), and, if not "1", there is executed a decrement of the bin position counter (BIN_CN) and the sequence is continued from the step S2303. If it is "1", the sequence proceeds to a step S2309 and the calculation process is terminated.

In the following the escape sequence will be schematically explained with reference to FIGS. 47 and 48. In the following there will be explained the sorting mode with 3 originals and 3 copies. FIG. 47 shows the state of bins and stacked sheets when the process of the sorting mode has just been completed, wherein a bin space II-III between a bin which has received the last sheet III-(l) and an upper bin is larger than the bin space I-II. Consequently, the above-mentioned sheet III-(l) does not receive a pinching force by the bins II and III. For this reason, the sheet becomes curled in the course of cooling of the heated toner.

Figure 48:
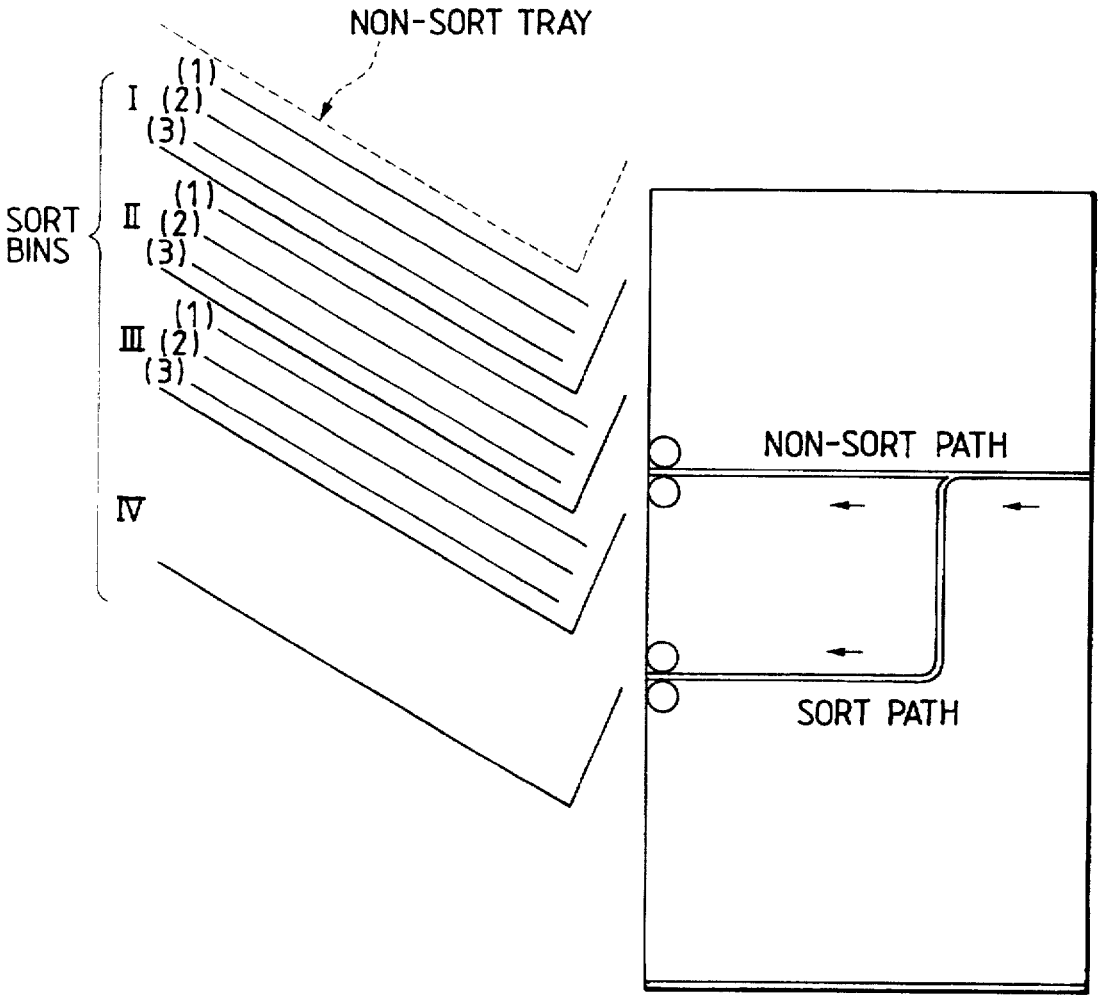

On the other hand, FIG. 48 shows the state of bins and stacked sheets when the escape sequence is executed, wherein the bins have a same bin space and are in a position to pinch the sheets. Thus the curl generation can be suppressed as the sheets are pressed in the cooling process of the toner.

A curl motor driver 763 drives the curl motor of the curl correction unit 500 and the eccentric cam motor 507 shown in FIG. 22.

In the following there will be given a detailed explanation on the control of the curl correction unit 500 and the sorter 400 in the present embodiment. At first there will be outlined the curl correction control in the curl correction unit 500, and the details of the control will then be explained with reference to a flow chart.

The sheet bearing the image on one side is often ejected from the heat roller fixing unit 9, with a positive curl (convex downwards) as shown in FIG. 22. It is already known that such positive curl of the sheet is caused by the contraction, by air cooling after sheet ejection, of the toner which has been heated and fused in the heat roller fixing unit 9, and that the amount of such curl is variable depending on and is correlated with the image density (amount of toner), the kind of paper (material, rigidity, thickness, size, direction of paper making, etc.), and the ambient conditions of temperature and humidity.

The present invention realizes an improvement in the quality of the output sheet in the final form thereof, by comprehensively judging the operation mode of the sorter 400, the presence or absence of the stapling operation and the local image density (amount of toner) in addition to the above-mentioned factors, thereby effecting optimum current correction control.

At first there will be explained the method of calculating the local image density (toner amount) in the present embodiment. For the purpose of simplicity, there will be explained an example of determining the local image density by dividing the image into two areas in the sheet feeding direction, and the penetration amount x in FIG. 22, determining the amount of curl correction, is assumed to be switchable in three levels.

Figure 23:
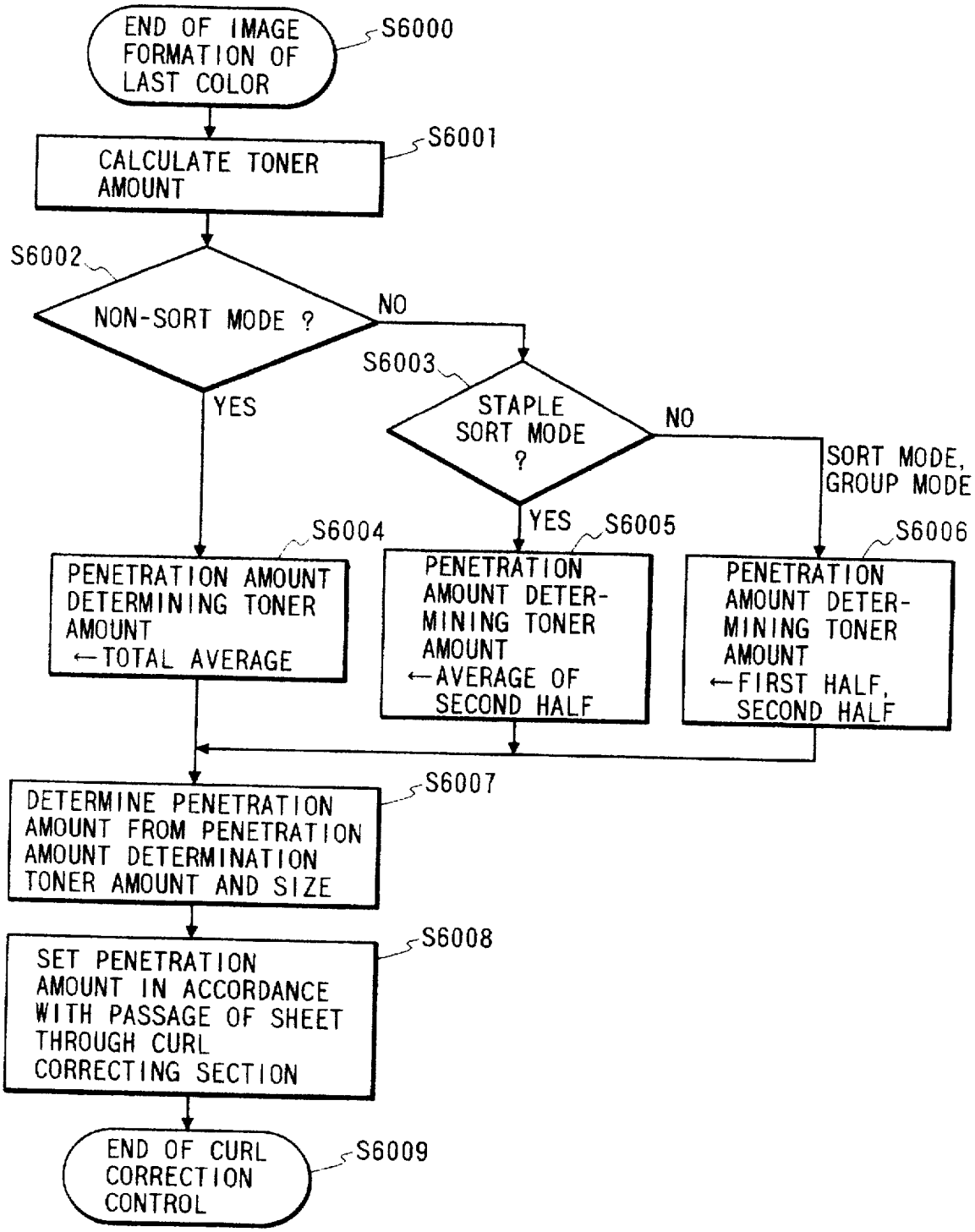
FIG. 23 is a flow chart of curl correction.
Figure 24:
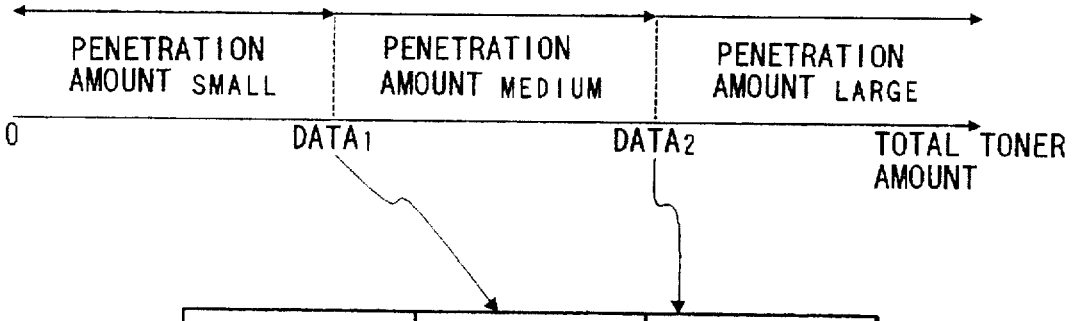
FIG. 24 is a view showing the principle of curl correction control.

Now reference is made to a flow chart in FIG. 23 and also to FIG. 24. The control of the curl correction control unit, according to the flow chart shown in FIG. 23, is started when the image formation with the last color is completed.

The image density is measured by sampling the potential at the image formation by the potential sensor 12. The measured potential is averaged and then converted into the toner amount, based on the experimentally obtained relationship between the potential and the toner amount. The above-mentioned toner amount means that per a unit area and remains same regardless of the sheet size, if the image density is uniform. In case of a color image (four colors), the toner amount is represented by the sum of the amount of magenta toner, cyan toner, yellow toner and black toner.

This toner amount calculating operation is conducted after the last image formation with the black color, and there are calculated three toner amounts, i.e. a front-half average toner amount TNRtop, a rear-half average toner amount TNRbottom and a total average toner amount TNRtotal (S6001).

Then thus calculated toner amounts are selectively used, according to the stacking mode of the sorter 400. In case of the non-sort mode (S6002), not involving the aligning operation, the emphasis is more given to the stacking amount than to the quality of stacking, so that the total average toner amount TNRtotal is used for determining the penetration amount (S6004).

In case of the stapling and sorting mode in which the sheets are sorted and also stapled after the end of the job (S6003), as the stapling is done in the rear half of the sheets, the rear-half average toner amount TNRbottom is used for determining the penetration amount (S6005).

In case of the sorting mode or the group mode, in order to improve the quality of stacking, the larger one of the front-half average toner amount TNRtop and the rear-half average toner amount TNRbottom is used for determining the penetration amount (S6006). Such method significantly improves the level of curl correction, in comparison with the case of using the total average toner amount TNRtotal, particularly if the toner amount is deviated to either side.

The toner amount for determining the penetration amount, determining the curl correcting performance, is selected in the above-explained manner. Now reference is made to FIG. 24, for explaining the method for determining the penetration amount x based on thus selected toner amount. In the present embodiment, the penetration amount x is switchable in three levels, small, medium and large. Since the curl amount is proportional to the toner amount as explained in the foregoing, there exist, in the total toner amount, data 1 for switching the penetration amount between the small and medium levels, and data 2 for switching the penetration amount between the medium and large levels. As the curl amount also depends on the sheet size and the direction of paper making, the data 1 and the data 2 are determined for each sheet size, as shown in FIG. 24. As the curl amount also depends on the kind and thickness of the sheet, table data as shown in FIG. 24 are prepared for each kind of sheet, such as the ordinary paper, OHP sheet or thick paper.

The data for switching the penetration amount are thus determined for each sheet size, and the penetration amount is then determined from the above-mentioned toner amount (S6006).

Figure 3:
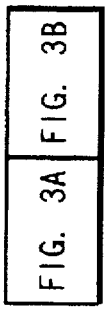
FIG. 3 is comprised of FIGS. 3A and 3B showing block diagrams of the control system of an image formation process unit shown in FIG. 2.
Figure 3A:
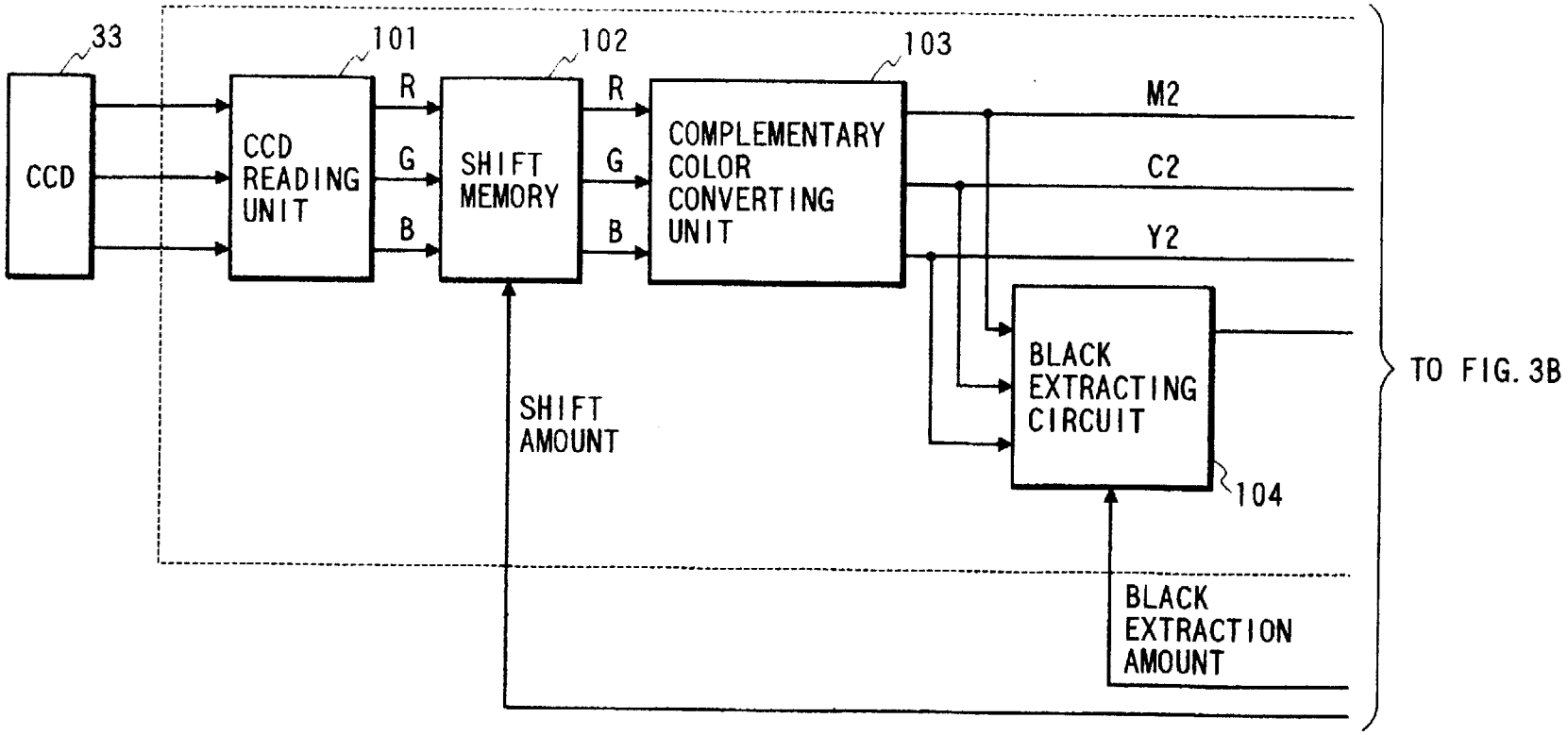
Figure 3B:
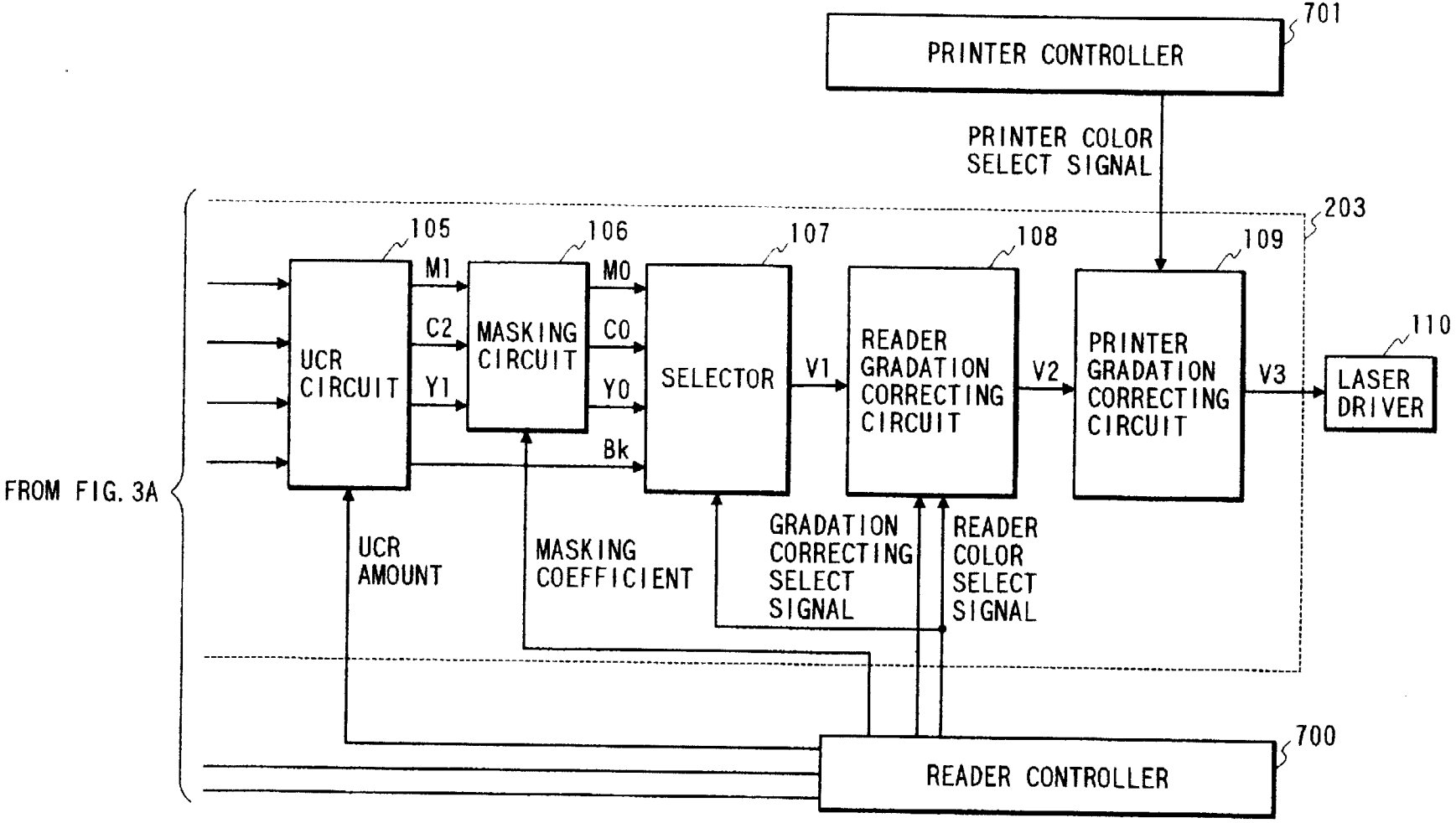

FIGS. 3A and 3B are block diagrams showing an example of configuration of the image process unit 203 in the present embodiment. A CCD reading unit 101 is for example composed of amplifiers for respectively amplifying the analog RGB signals entered from the aforementioned full-color sensor 34 (cf. FIG. 1), A/D converters for converting the analog RGB signals into digital signals for example of 8 bits, and a shading correction circuit for effecting already known shading correction, and releases digital RGB image signals corresponding to the original image.

A shift memory 102 corrects the aberrations between the colors and the pixels in the RGB image signals entered from the CCD reading unit 101, according to a shift amount control signal from the reading controller 700. A complementary color converting unit 103 converts the RGB image signals, entered from the shift memory 102, into MCY image signals. A black extraction circuit 104 extracts a black color area of the image from the MCY (magenta, cyan, yellow) image signals entered from the complementary color converting unit 103, based on a black extraction signal from the reader controller 700, and releases a Bk (black) image signal corresponding to thus extracted black color area.

A UCR circuit 105 effects an undercolor removal (UCR) process on the MCY image signals entered from the complementary color converting unit 103, based on the Bk image signal from the black extraction circuit 104 and a UCR amount control signal from the reader controller 700. In this manner the black extraction circuit 104 and the UCR circuit 105 realize image formation of the extracted black color area with the black toner instead of superposing the toners of three colors, thereby improving the quality of color reproduction.

The Bk image signal obtained from the black extraction circuit 104 is given by the following equation (1):

$$BK=A\cdot\min(C2, Y2, M2) \tag{1}$$

wherein A is a black extraction coefficient, and, C2, Y2 and M2 are the MCY image signals released from the complementary color converting unit 103. The black extraction coefficient A is determined by a black extraction control signal supplied from the reader controller 700.

Also the MCY image signals released from the UCR circuit 105 are given by the following equation (2):

$$\begin{aligned} M1&=B1\cdot(M2-D1\cdot Bk)\\ C1&=B2\cdot(C2-D2\cdot Bk)\\ Y1&=B3\cdot(Y2-D3\cdot Bk) \end{aligned} \tag{2}$$

wherein M2, C2 and Y2 are the MCY image signals released from the complementary color converting unit 103; M1, C1 and Y1 are the MCY image signals released from the UCR circuit 105; and coefficients B1, B2, B3, D1, D2 and D3 are determined by the UCR amount control signal from the reader controller 700.

A masking circuit 106 effects a masking process on the MCY image signals entered from the UCR circuit 105, according to a masking coefficient control signal supplied from the reader controller 700, for the purpose of elimination of the turbidity components of the toners used and correction of the RGB filter characteristics of the CCD. The MCY image signals released from the masking circuit 106 are given by the following equation (3):

$$\begin{vmatrix} M0 \\ C0 \\ Y0 \end{vmatrix} = \begin{vmatrix} a11 & a12 & a13 \\ a21 & a22 & a23 \\ a31 & a32 & a33 \end{vmatrix} \begin{vmatrix} M1 \\ C1 \\ Y1 \end{vmatrix} \quad (3)$$

wherein a11–a33 are masking coefficients, M1, C1 and Y1 are the MCY image signals released from the UCR circuit 105, and M0, C0 and Y0 are the MCY image signals released from the masking circuit 106. The masking coefficients all–a33 are determined by a masking coefficient control signal supplied from the reader controller 700.

A selector 107 releases an image signal V1 by selecting one of the M, C, Y, Bk image signals, supplied from the masking circuit 106 and the black extraction circuit 104, according to a color selection signal entered into a selection terminal S from the reader controller 700.

Figure 4:
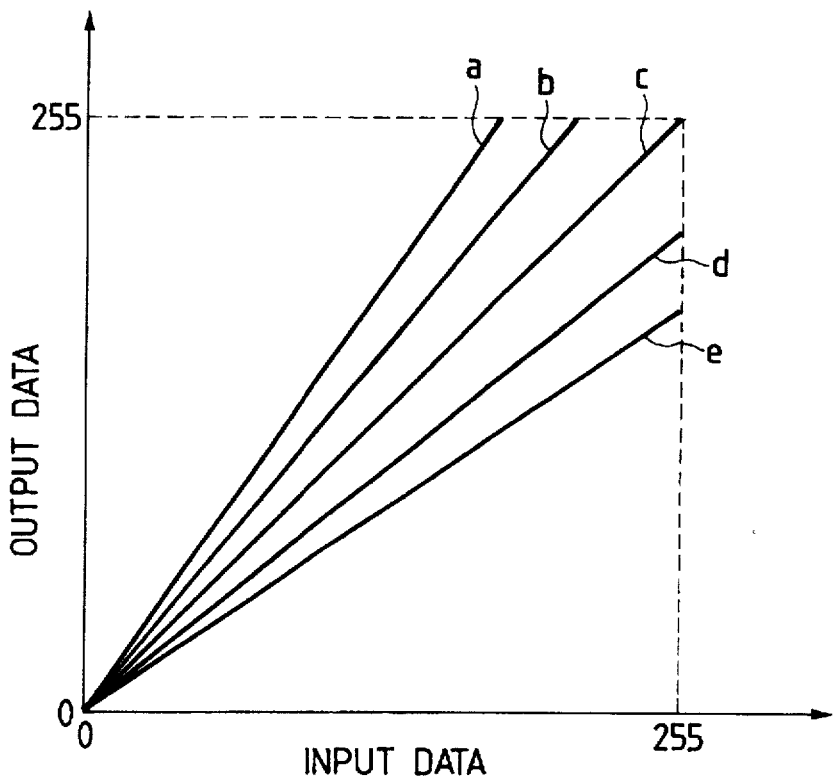
FIGS. 4 and 5 are charts showing gradation correction characteristics and representing examples of the input/output signals in a reader gradation correction circuit shown in FIG. 3.

A reader gradation correction circuit 108 applies a gradation control as shown in FIG. 4, on the image signal V1 supplied from the selector 107, thereby releasing an image signal V2. For example the reader gradation correction circuit 108 applies a density control on the image signal, according to one of the conversion characteristics a to e shown in FIG. 4, selected according to the gradation correction selecting signal from the reader controller 700. The setting of this reader gradation correction circuit 108 is determined by a setting of the image density on the operation panel to be explained later.

Figure 5:
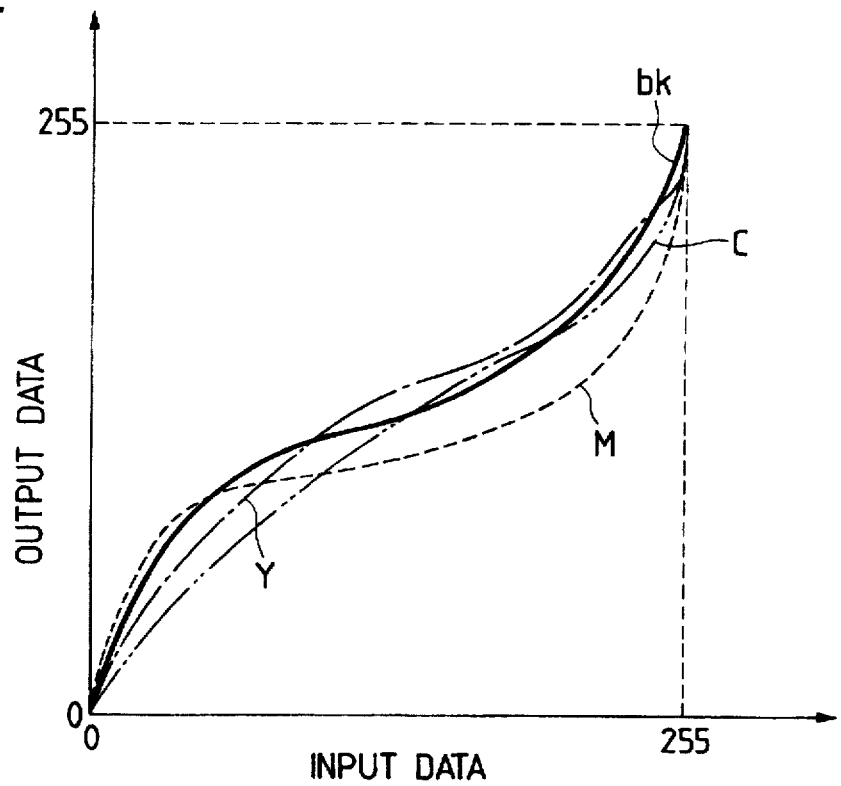

A printer gradation correction circuit 109 applies a correction on the image signal by selecting one of the gamma conversion characteristics m, c, y, bk as exemplified in FIG. 5, according to a printer color selection signal entered from the printer controller 701, in order to obtain linear output characteristics for each color in the printer unit 202.

A laser driver 110 is included in the aforementioned laser exposure optical system 3 (cf. FIG. 1), and modulates a semiconductor laser according to an image signal V3 entered from the printer gradation correction circuit 109, thereby forming a latent image on the photosensitive drum 1.

Figure 6:
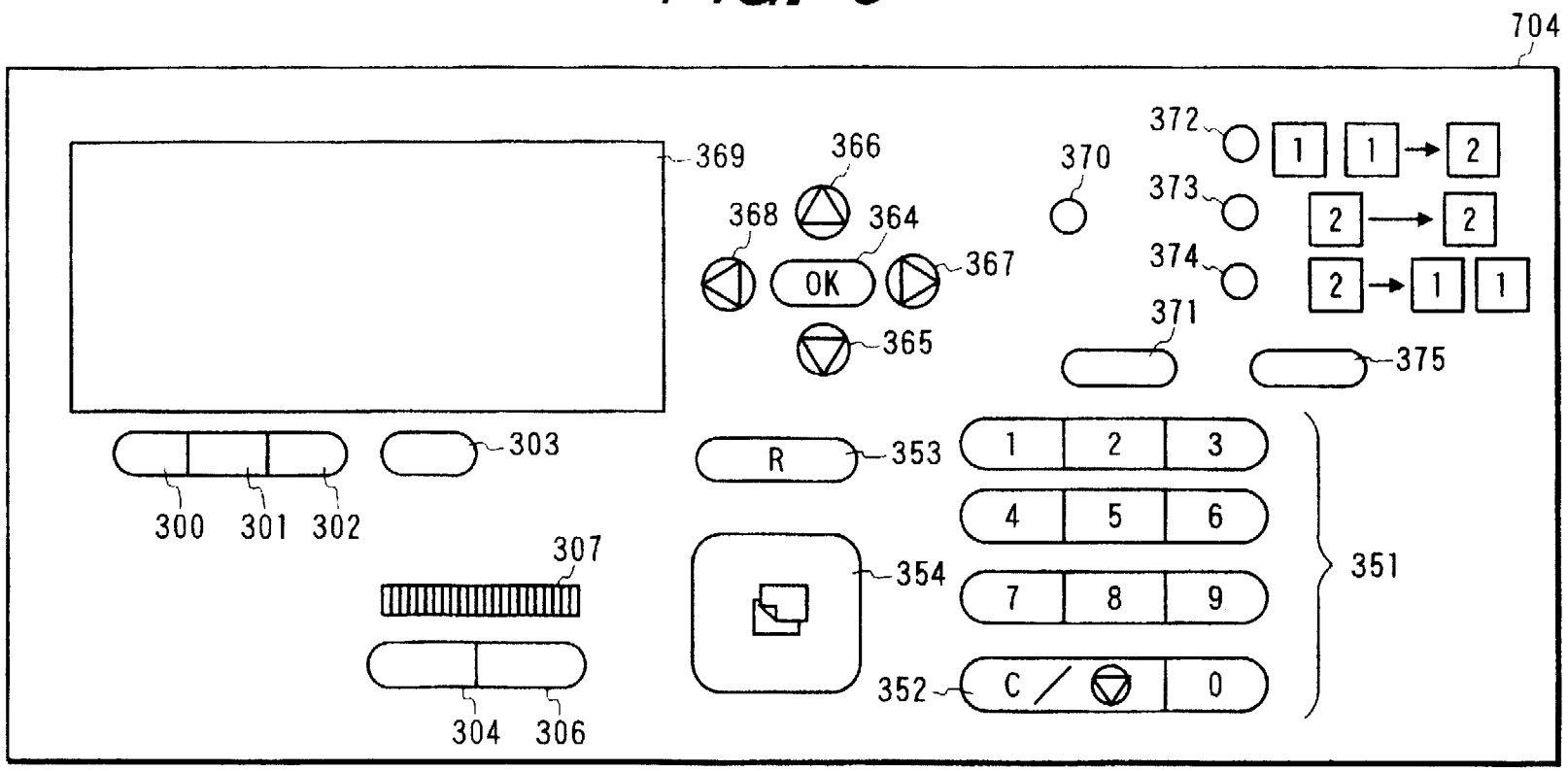
FIG. 6 is a schematic plan view of an operation unit shown in FIG. 2.

FIG. 6 illustrates an operation unit of the color image forming apparatus of the present invention, wherein shown are numeral keys 351 for setting the number of image formations and entering numerical data in the mode setting; a clear/stop key 352 for clearing the set number of image formations and stopping the image forming operation; a reset key 353 for resetting the set number of image formations and the operation modes to predetermined states; and a start key 354 for starting the image forming operation.

A display panel 369, composed for example of a liquid crystal display panel, varies the content of display according to the set mode, in order to facilitate detailed mode setting. In the present embodiment, a cursor on the display panel 369 is moved by cursor keys 366 to 368, and the setting is determined by an OK key 364. Such setting method may also be realized with a touch panel.

A paper kind setting key 371 is used in case of image formation on a recording material thicker than ordinary. An LED 370 is turned on when the thick paper mode is set by the key 371. Although the present embodiment has the thick paper mode only, the function may also be expanded so as to enable setting of other modes for example for the OHP sheet and other special paper.

A two-side mode setting key 375 is used for selecting one of the following four modes, namely "one/one mode" for forming one-side copies from one-side originals, "one/two mode" for forming two-side copies from one-side originals, and "two/two mode" for forming two-side copies from two-side originals, and "two/one mode" for forming one-side copies from two-side originals. LED 372 to 374 are turned on according to the selected mode. They are all turned off in the "one/one mode", and LED 372, 373 or 374 alone is turned on respectively in the "one/two mode", "two/two mode" or "two/one mode".

(Example of image formation)

In the following there will be explained, as a specific example, a 4-color image forming operation on an ordinary paper, without setting of the thick paper mode, in the "one/one mode" without the use of the RDF 600.

In this case, since the image formation is made on the ordinary paper, the fixing motor driver 761 is set at a speed VFN equal to the image forming speed (process speed) VP of the photosensitive drum 1.

After the setting of the number of image formations with the numeral keys 351, the operator selects the paper feed unit by the paper selection key 303 and actuates the start key 354, whereupon the printer controller 700 activates the drivers for the motors required in the image formation, such as the drum motor, fixing motor, paper feed motor and main motor. Then, after the driving state of these motor is stabilized, the feeding operation of the recording material P is started from the designated paper feed unit (cassette 7*a*, 7*b*, etc.). Approximately simultaneously, the reader unit 201 sets the aforementioned shift amount, black extraction amount, UCR amount, reader color selection signal etc. in the units of the image process unit 203, in order to generate the image signal of magenta color which is the first color in the four-color image formation. Also the reader gradation correction circuit 108 selects one of the conversion characteristics a to e shown in FIG. 4, corresponding to the actuation of the density keys 304, 306 on the operation unit 704. Also the printer gradation correction circuit 109 selects the conversion characteristics m shown in FIG. 5.

The recording material P fed from the designated paper feed unit is forwarded, by the registration rollers 50, in synchronization with the optical scanning operation in the reader unit 201, and is attracted on the transfer sheet 5*f*, by the function of the attraction charger 5*c* and the attraction roller 5*g* constituting a counter electrode.

The original information read by the reader unit 201 is processed in the image process unit 203, and is converted into a laser beam irradiating the photosensitive drum 1, uniformly charged with the charger 2, thereby forming a latent image which is at first developed with the magenta developing unit 4*m*. Thus developed image information is transferred onto the attracted recording material P, by the function of the transfer charger 5*b*. The image forming operation, including the magenta image reading, latent image formation, development and transfer, is executed during one turn of the photosensitive drum 1 and the transfer drum 5*a*, and the image forming operations are similarly executed thereafter for the remain three colors C, Y and Bk. The setting of the image process unit 203 is conducted for each image forming operation.

The recording material P, having received the transferred images of four colors, is separated from the transfer sheet 5*f*, by attenuating the attractive force between the transfer sheet 5*f* and the recording material P by means of the separating charger 5*h*, deforming the transfer sheet 5*f* by the separating push-up roller 8*b* and peeling off the recording material P from the transfer sheet 5*f* by means of the separating finger 8*a*.

The recording material P thus separated is transported, by the recording material feed unit 9g effecting the feeding operation with a speed same as that (VP) of the transfer drum 5a, to the heat roller fixing unit 9, then fixing therein with a fixing speed VFN=VP, further subjected to curl correction in the curl correction unit 500 and ejected to the sorter 400.

In the following there will be given a detailed explanation on the control for the oil cleaning member. Since the oil cleaning control varies according to the fixing speed, there will be at first explained the oil cleaning control for the ordinary paper.

In the beginning there will be explained the non-operating state of the oil cleaning member (when the oil cleaning is not executed) in the ordinary paper mode, and then there will be explained the control in the operating state of the oil cleaning member (when the oil cleaning is executed) in the ordinary paper mode.

(Control when the oil cleaning is not executed in ordinary paper mode)

Figure 7:
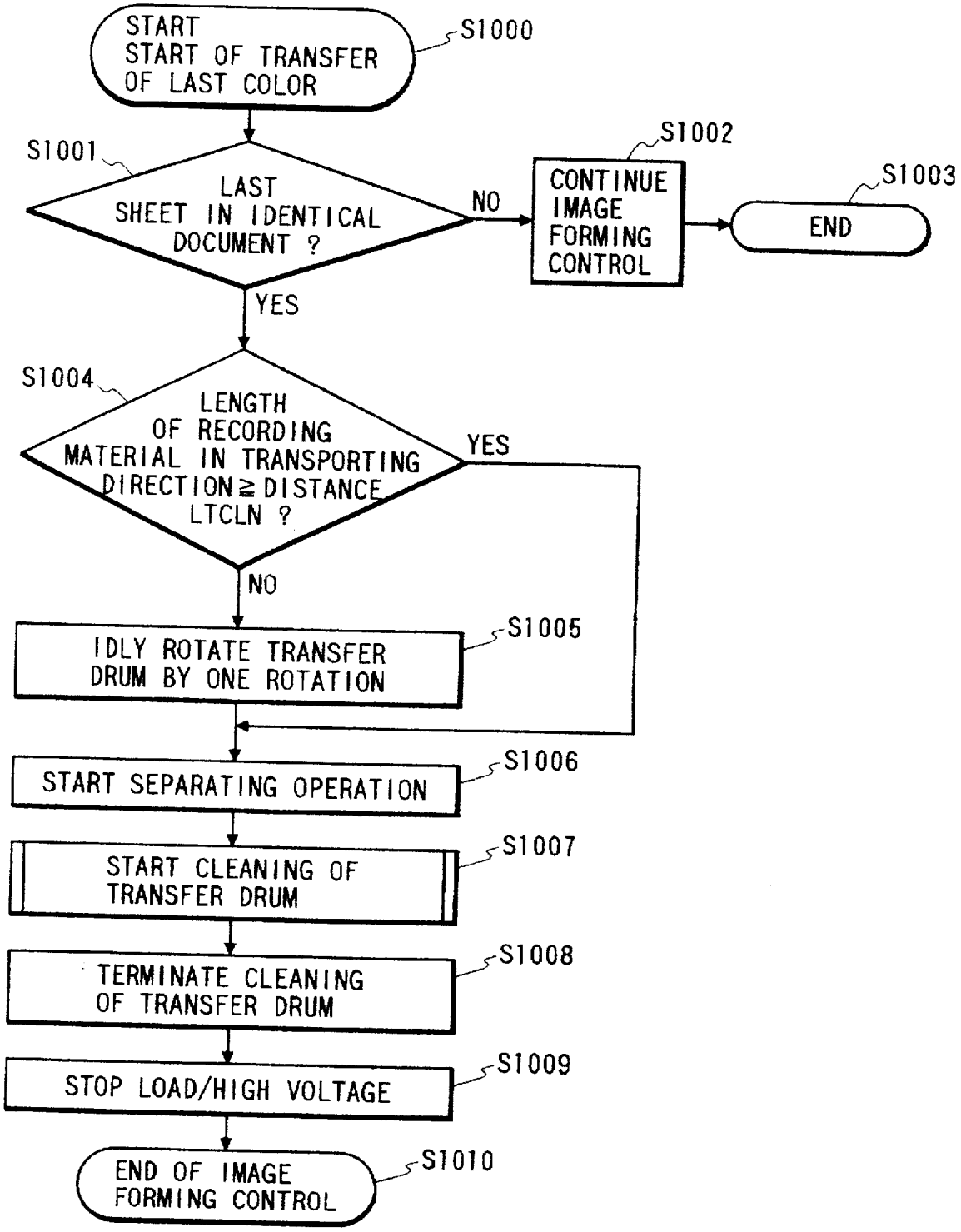
FIG. 7 is a flow chart showing the process from the start of last color transfer to the termination of the image forming operation for a last sheet in the color image forming apparatus shown in FIG. 1.

FIG. 7 is a flow chart showing the control from the start of the transfer operation for the last color on the last sheet (last one among plural sheets on which the image of a same original are to be formed) to the end of the image forming operation. Such control is usually called "post-rotation control". Such post-rotation control executes "ordinary cleaning control" of the transfer drum 5a constituting the recording material support means. Such ordinary cleaning control is ordinary cleaning control, utilizing the fur brush 14 and the fur backup brush 15 as will be explained in the following.

Figure 8:
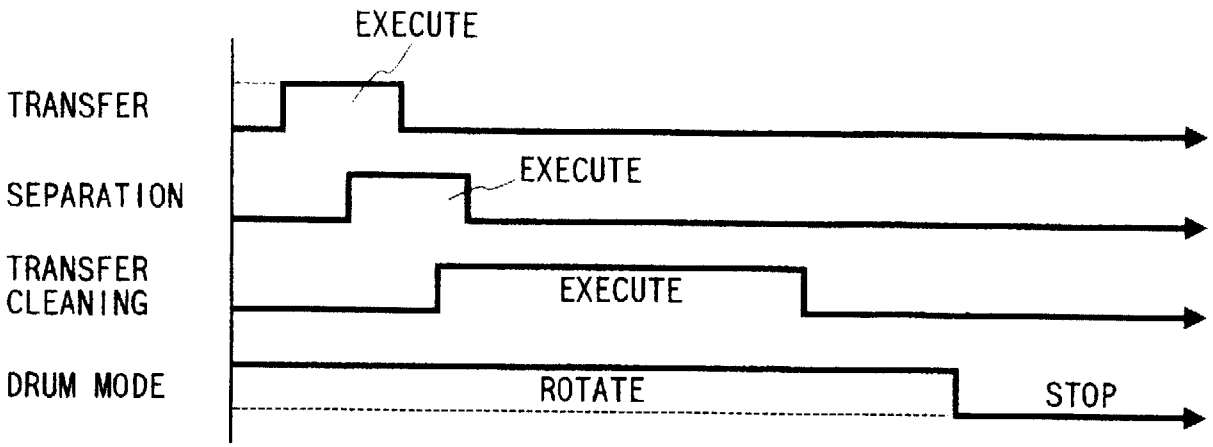
FIG. 8 is a timing chart in case of one-sheet applying control by fixing (N) rotation control in the flow chart shown in FIG. 7.
Figure 9:
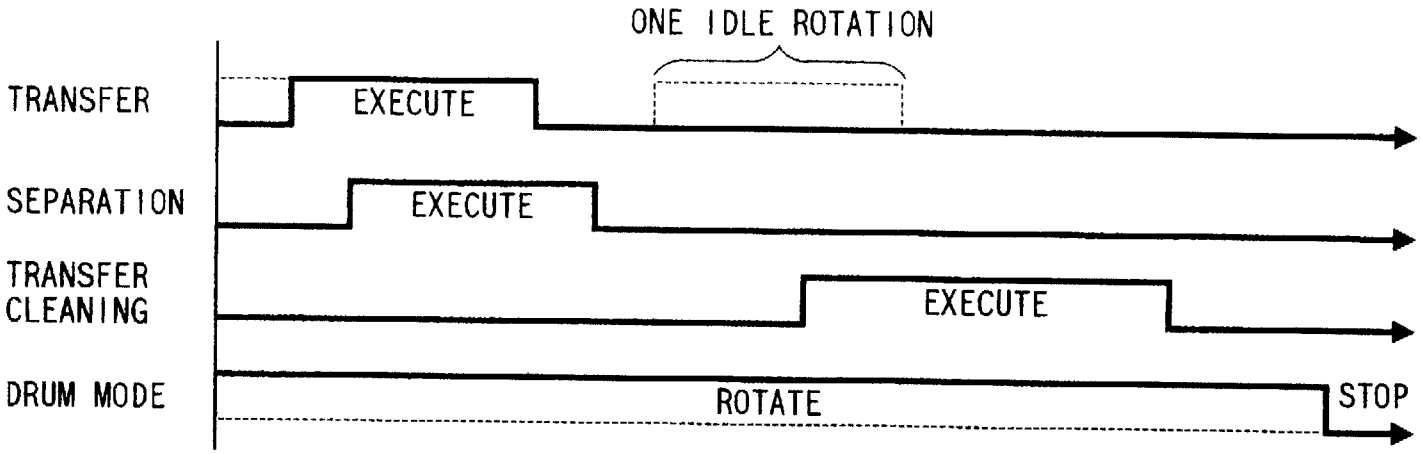
FIG. 9 is a timing chart in case of one- or two-sheet applying control by fixing (N+1) rotation control in the flow chart shown in FIG. 7.

FIG. 8 is a timing chart in the one-sheet attraction control with the "fixing (N) rotation control" to be explained later, in case the transfer drum 5a has a size allowing the two-sheet attraction control in the flow chart shown in FIG. 7, and FIG. 9 is a timing chart in the one- or two-sheet attraction control with the "fixing (N+1) rotation control" to be explained later, in the flow chart shown in FIG. 7.

Referring to the flow chart of the post-rotation control in FIG. 7, when the transfer of the last one of the image forming colors determined by the color mode is started (step S1000), there is discriminated whether the sheet is the last one for the same original (S1001), in order to judge whether the post-rotation control is to be executed after the transfer operation. If the image formation is not that for the last sheet (hereinafter called "last image formation"), the image forming operation is continued (S1002) and this control process is terminated (S1003).

If the last image formation is identified, the size of the recording material in the feeding direction is compared with a distance LTCLN from the transfer position to the transfer sheet cleaning position (S1004). This is for preventing the destruction of the image, generated by cleaning the transfer drum 5a or separating the recording material during the transfer operation thereon, in case the recording material extends over the transfer position and the transfer sheet cleaning position (the distance LTCLN therebetween is 250 mm in the present embodiment). If the recording material extends over the transfer position and the transfer sheet cleaning position, the transfer drum 5a is made to effect an idle turn (S1005) for completing the transfer operation, prior to the separating operation (S1006) and the cleaning operation (S1008).

The ordinary cleaning control in the step S1007 is achieved by rotating the fur brush 14 with an unrepresented motor and activating the fur backup brush 15, opposed to the fur brush 14, thereby bringing the fur brush 14 into contact with the transfer sheet 5f. In this control, the transfer sheet 5f is cleaned for the entire periphery of the transfer drum 5a, regardless whether the one- or two-sheet attraction control is adopted, and the cleaning operation for the transfer sheet 5f is then terminated (S1009). Subsequently the loads such as motors in operation and the high voltage supply are turned off (S1009), and the image forming operation is terminated (S1010).

(Control when the oil cleaning is executed in the ordinary paper mode)

In case of forming monochromatic images on both sides of an ordinary paper, the following oil cleaning operation is conducted on the transfer sheet 5f, at the image formation for the second side in the two-side mode (hereinafter called "second side image formation in the two-side mode on ordinary paper").

The recording material, fed from any of the cassettes and bearing the image on the first side, is re-fed after storage in the intermediate tray 22, and is supported on the transfer drum 5a for the image formation on the second side. In this state the transfer sheet 5f is in contact with the image-bearing first side of the recording material, so that the oil, deposited in the fixing unit 9 at the first image formation is re-deposited onto the transfer sheet 5f. It is necessary to avoid the deposition of such oil onto the photosensitive drum 1, and, for this purpose, at the passing of the transfer sheet 5f through the transfer position in the course of image formation for the second side in the two-side mode, it is necessary to effect oil cleaning in advance of the transfer sheet 5f passing the transfer position or to position the recording material between the transfer sheet 5f and the photosensitive drum 1. In the image formation on the second side in the two-side mode on the ordinary paper, in which the fixing speed is same as the process speed, the recording material is always present between the transfer sheet 5f and the photosensitive drum 1 at the transfer position in the course of continuous image formation on the plural recording materials, so that the oil cleaning needs to be conducted only in the aforementioned post-rotation control.

The recording material for the image formation on the second side in the two-side mode may be fed from the intermediate tray 22 or from the recording material tray 7m, in case the user sets the recording material, already subjected to image formation on one side, on the tray 7m for the purpose of image formation on both sides. In such case the control is executed for the recording material having the image on the first side and used for the image formation on the second side in the two-side mode, in the same manner as the case of feeding from the intermediate tray 22.

In the following there will be given a detailed explanation on the oil cleaning control, with reference to a flow chart shown in FIG. 10, which shows an example of effecting the oil cleaning and the ordinary cleaning for the second side in the two-side mode and effecting the ordinary cleaning only in other cases.

At first the cleaning of the transfer drum is started (step S1500). If the paper feed position is either the intermediate tray 22 or the recording material tray 7m, a step S1501 identifies the image formation on the second side in the two-side mode. For effecting the oil cleaning operation, the oil cleaning backup brush 17 is activated (S1503), and the oil cleaning roller 16 is driven and brought into contact with the transfer sheet 5f (S1503). The oil cleaning roller 16, composed of a material capable of oil absorption, eliminates the oil deposited on the transfer sheet 5f upon contact therewith. Then, for effecting the ordinary cleaning, the fur backup brush 15 is activated (S1504), and the fur brush 14 is driven and brought into contact with the transfer sheet 5f

(S1505), whereupon the cleaning operation is terminated (S1506). If the step S1501 identifies that the paper feed position is not the intermediate tray 22 nor the recording material tray 7m, the oil cleaning is not required, so that the fur brush 14 alone is driven to effect the ordinary cleaning control (S1504, S1505).

Figure 10:
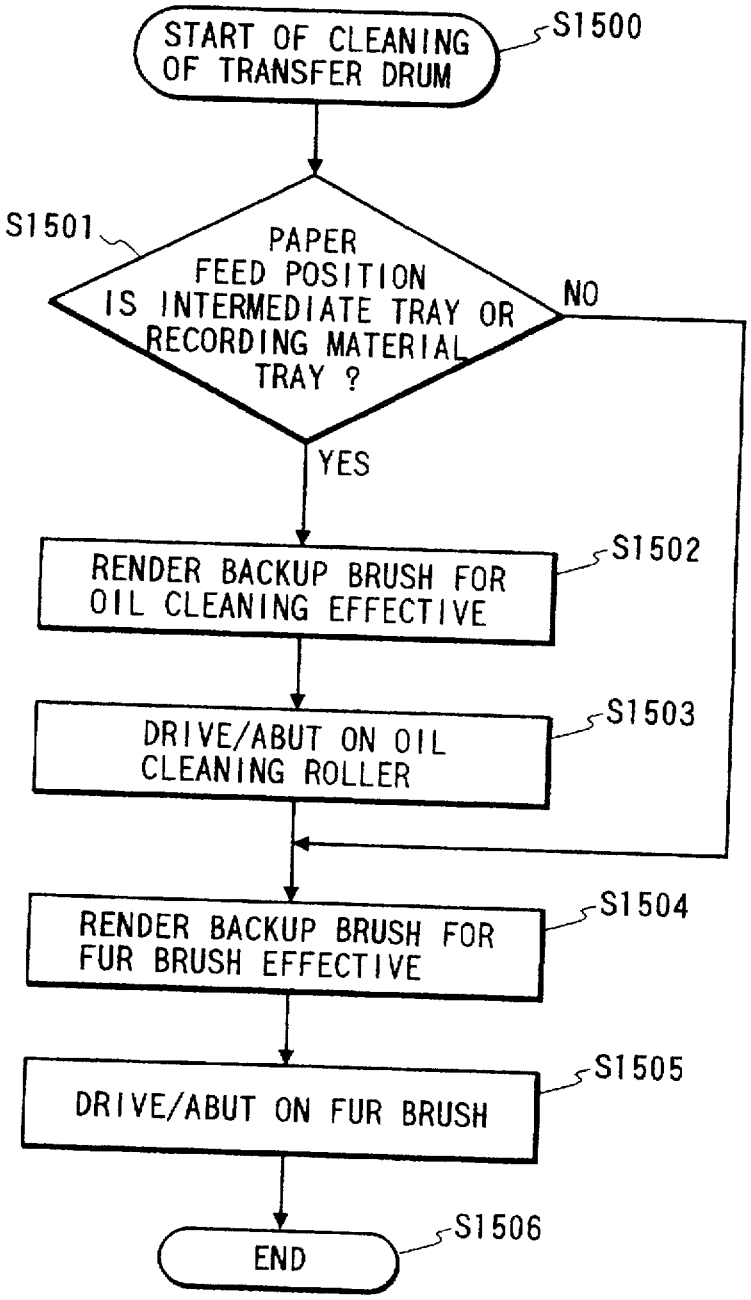
FIG. 10 is a flow chart showing a transfer drum cleaning operation applicable in the flow chart shown in FIG. 7.

In case the steps S1500 to S1506 shown in FIG. 10 are executed in the transfer drum cleaning control (S1007) shown in FIG. 7, the oil cleaning may be executed, if necessary, in the post-rotation control. Also in case the steps S1500 to S1506 in FIG. 10 are executed between the steps S1001 and S1002 in FIG. 7, the oil cleaning and the ordinary cleaning may be executed, if necessary, at each separation of the recording material from the transfer drum 5a. Furthermore, in case the steps S1500 to S1503 in FIG. 10 are executed between the steps S1001 and S1002 in FIG. 7, the oil cleaning alone may be executed, if necessary, at each separation of the recording material from the transfer drum 5a.

(Special fixing speed in thick paper mode)

For fixing the toner on a thick paper, there is required a larger energy in comparison with the case of ordinary paper. Therefore, the toner fixation in such case is ensured by reducing the fixing speed in comparison with the case of ordinary paper, thereby increasing the energy per unit area or per unit time. For this purpose, there is conventionally employed a distance from the separation finger 8a to the contact position of the upper and lower fixing rollers 9a, 9b larger than the maximum image forming size on the thick paper, thereby reducing the speed of the recording material in the recording material feed unit 9g to a fixing speed VF different from the speed of the transfer drum 5a, utilizing the recording material feed unit 9g as a speed converting area, while maintaining the peripheral speed of the transfer drum 5a constantly at the process speed VP. For this purpose there is required the recording material feed unit 9g of a size corresponding to the maximum image forming size of the thick paper, inevitably resulting in a larger dimension of the apparatus.

Consequently, in the present embodiment, the speed of the transfer drum 5a is rendered variable, like the fixing speed, and, in case the fixing speed VF has to made lower than the image forming speed VP, the speed of the transfer drum 5a is lowered to the fixing speed after the transfer of the final color, whereby the recording material feed unit 9g need not have the size as the speed converting area and the increase in the dimension of the apparatus can be avoided.

However, if the size of the recording material in the feeding direction is larger than the distance LTC from the transfer position shown in FIG. 1 to the front end of the recording material feed unit 9g, the speed reduction of the transfer drum 5a to the fixing speed cannot be made in time for the separation of the next recording material. In such case, therefore, the transfer drum 5a is rotated by an additional turn and the recording material is separated at the next timing of separation. Such control of effecting an additional turn of the transfer drum 5a after the transfer of the last color in the thick paper mode, prior to the separation and the fixation, is hereinafter called the "thick paper fixing (N+1) rotation control". Also the control in case the distance LTC from the transfer position to the front end of the recording material feed unit 9g, or the recording material feed unit 9g, can be used as the speed converting area, namely in case the transfer drum 5a does not require the additional one turn, will be hereinafter called the "thick paper fixing (N) rotation control".

For the purpose of simplicity, the control in the thick paper mode is conducted in the following manner, depending on the recording material size, in case the distance LTC from the transfer position shown in FIG. 1 to the front end of the recording material feed unit 9g is 250 mm:

one-sheet application mode with the A4 sheet size fed laterally (210 mm in the feeding direction) : thick paper fixing (N) rotation control;

one-sheet application mode with the A4 sheet size fed longitudinally (297 mm in the feeding direction) thick paper fixing (N+1) rotation control;

one-sheet application mode with the A3 sheet size fed longitudinally (420 mm in the feeding direction) thick paper fixing (N+1) rotation control;

two-sheet application mode with the A4 sheet size fed laterally (210 mm in the feeding direction) : thick paper fixing (N+1) rotation control.

(Special oil cleaning in the thick paper mode)

In the following there will be explained the oil cleaning control in the thick paper mode, requiring the reduction of the fixing speed.

In the oil cleaning control in the ordinary paper mode, the speed of the transfer drum 5a is not changed after the image formation as explained in the foregoing, so that the image formation operation can be executed continuously and the oil cleaning control needs to be executed only after the image forming operation for the last sheet for an original.

On the other hand, in the thick paper mode, the speed of the transfer drum 5a and of the photosensitive drum 1 is changed same as the fixing speed VFT for the fixing control. Consequently the above-mentioned speed has to be returned to the original speed VP for the image formation for a next sheet, and the continuous image forming operation cannot be executed if the recording material becomes different. Consequently, in the course of image formation for the second side of the thick paper, the oil present on the transfer sheet 5f becomes deposited onto the photosensitive drum 1 at the transfer position, so that the oil cleaning control becomes necessary at the end of each transfer operation of the last color for each recording material. Therefore, in the image formation in the thick paper mode, the oil cleaning control is conducted at the end of the transfer operation for the last color for each recording material, in the following manner.

(Image formation control in the thick paper mode)

In the following there will be explained, with reference to flow charts shown in FIGS. 11A and 11B, the color image formation control in the thick paper mode. The flow charts in FIGS. 11A and 11B covers all the recording materials in the thick paper mode, the ordinary paper mode and the OHP mode. Consequently, in FIGS. 11A and 11B, control processes corresponding the thick paper fixing (N+1) rotation control and the thick paper fixing (N) rotation control are defined respectively as the fixing (N+1) rotation control and the fixing (N) rotation control, corresponding to all the recording material.

As explained in the foregoing, the operations of latent image formation, development and transfer including the sheet feeding and sheet attraction (step S2000) are repeated until the transfer of the last color (S2001). After the transfer of the last color, the fixing speed VF is compared with the image forming speed VP_(S2002). In the thick paper mode, the fixing speed VF is a lower fixing speed VFT for the thick paper different from the image forming speed VP, so that the sequence proceeds to a step S2003.

The step S2003 discriminates whether there is selected a mode for supporting plural recording materials on the transfer sheet 5f. The present embodiment, utilizing electrostatic attraction for supporting the recording material, is capable of image formation simultaneously on two recording materials, if the length thereof does not exceed ½ of the entire periphery of the transfer sheet 5f. In the present embodiment, in case of simultaneous image formation on two recording materials (two-sheet attraction mode), such two recording materials including the space therebetween are handled as a single recording material. Consequently the distance LTC from the transfer position to the front end of the recording material feeding unit 9g becomes smaller than the size of such single recording material in the feeding direction thereof, so that such distance LTC can no longer be used as the speed converting area. Consequently, in such case, there is executed the "fixing (N+1) rotation control" (step S2006).

In case of the image formation with one recording material supported on the transfer sheet 5f (one-sheet attraction mode), the distance LTC from the transfer position to the front end of the recording material feeding unit 9g is compared with the size PX of the recording material in the feeding direction thereof (S2004). If the size PX is larger than the distance LTC, such distance cannot be used as the fixing speed converting area, so that there is executed the "fixing (N+1) rotation control" (step S2006). On the other hand, if the size PX is smaller (S2004), there is executed the "fixing (N) rotation control" (S2006).

The present embodiment compares the distance LTC with the size of the recording material in the feeding direction, but, if the speed change requires a time for example because of the performance of the drum motor, the discrimination steps (S2003, S2004) may be so improved as to take the time, required for such speed change, into consideration. Also in the fixing (N) rotation control, if the transfer sheet 5f is cleaned substantially simultaneously with the sheet separating operation, the cleaning operation of the transfer sheet 5f may detrimentally affect the recording material in the course of image transfer. Consequently, the control may have to be changed, depending on the size of the recording material in the feeding direction thereof and the distance from the transfer position to the cleaning position of the transfer sheet. In the present embodiment, the distance LTC and the distance LTCLN from the transfer position to the cleaning position of the transfer sheet are both selected as 250 mm.

(Fixing (N) rotation control in the thick paper mode)

In the following there will be explained the fixing (N) rotation control in the thick paper mode, with reference to a timing chart in FIG. 12, wherein C, Y and K respectively correspond to the cyan, yellow and black images. The reference signal of the transfer drum is given at an interval corresponding to the rotation speed thereof, and the speed of the photosensitive drum varies in the same manner as that of the transfer drum.

The fixing (N) rotation control (step S2005) is initiated after the start of transfer of the last color (S2001). The separating operation is conducted in the same manner as in the ordinary paper mode. More specifically, the sequence waits until a start timing t1, at which the separating finger 8a and the separating push-up roller 8b are activated to start the separating operation.

Then the sequence waits until a transfer end timing t2, determined from the size PX of the recording material in the feeding direction thereof. At the transfer end timing t2, the transfer charger is turned off, and the photosensitive drum motor driver 760 is so set that the peripheral speed of the transfer drum 5a becomes equal to the fixing speed VFT for the thick paper. Subsequently the sequence waits until a separation end timing t3, at which the separating finger 8a is turned off to terminate the separating operation.

However, if such transfer is conducted on the second side in the two-side mode on the thick paper, the fixing oil present on the first side of the recording material is deposited onto the transfer sheet 5f after the separating operation, as explained before. Consequently a step S2008 in FIG. 11B judges the necessity for the oil cleaning, and the oil cleaning control is executed before the area of the transfer sheet 5f, bearing such deposited oil, reaches again the transfer position (S2009). This oil cleaning is executed, as in the steps S1502 and S1503 in FIG. 10, by activating the oil cleaning backup brush 17 and driving the oil cleaning roller 16, thereby bringing into contact with the transfer sheet 5f. In this manner the oil cleaning control is executed after the separation of each recording material.

Thus, prior to the arrival of the front end of the recording material at the recording material feeding unit 9g, driven with the fixing speed VFT for the thick paper, the peripheral speed of the transfer drum 5a becomes equal to the fixing speed VFT, whereby the recording material is separated and transported in proper manner and is fixed with the fixing speed VFT for the thick paper. Then, after waiting until the ejection of the recording material (S2010), the speed of the transfer drum 5a, determined by the speed of the drum motor, is set at the image forming speed VP (S2011).

After the above-explained process is repeated for a predetermined number of sheets (S2012), the image forming operation is terminated.

(Fixing (N+1) rotation control in the thick paper mode)

In the following there will be explained the fixing (N+1) rotation control in the thick paper mode, with reference to a timing chart in FIG. 13, which shows an example of two-sheet attraction mode, wherein K1 corresponds to the black image for the first recording material, and Y2 and K2 correspond to the yellow and black images for the second recording material.

As explained in the foregoing, the fixing (N+1) rotation control is to rotate the transfer drum 5a by a turn, after the transfer operation and prior to the separating operation, in case the distance LTC (=250 mm) from the transfer position to the front end of the recording material feeding unit is smaller than the size of the recording material in the feeding direction and cannot therefore be used as the converting area for the fixing speed.

Therefore, the sequence waits until a timing t11 of the end of transfer of the last color for the second sheet in the two-sheet application mode, and, at such timing t11, the transfer charger is turned off to terminate the transfer operation. Then the peripheral speed of the transfer drum 5a is set at the fixing speed VFT for the thick paper, and the sequence waits, at this fixing speed VFT, until a separation start timing t12. The separation is conducted at the separation start timing t12, and the separating finger 8a is turned off after the separating operation.

However, if such transfer is conducted on the second side in the two-side mode on the thick paper, the fixing oil present on the first side of the recording material is deposited onto the transfer sheet 5f after the separating operation, as explained before. Consequently a step S2008 in FIG. 11B judges the necessity for the oil cleaning, and the oil cleaning control is executed before the area of the transfer sheet 5f, bearing such deposited oil, reaches again the transfer position (S2009). In this manner, the oil cleaning control is executed after the separation of each recording material, for the second side in the two-side mode, in the fixing (N+1) rotation control in the thick paper mode.

In this manner the additional turn of the transfer drum 5a constitutes a speed converting area, thereby enabling the fixing operation in the thick paper mode up to the maximum image forming size in the ordinary operation. Also the thick paper mode can be realized in the two-sheet attraction mode.

After a wait until the ejection of the recording material (S2010), the speed of the transfer drum 5*a* is set to at the image forming speed VP (S2011), for the next image formation.

After the above-explained process is repeated for a predetermined number of sheets (S2012), the image forming operation is terminated.

(Fixing normal rotation control in the ordinary paper mode)

Figure 11:
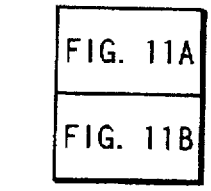
FIG. 11 is comprised of FIGS. 11A and 11B showing flow charts illustrating fixing control in the color image forming apparatus shown in FIG. 1.
Figure 11A:
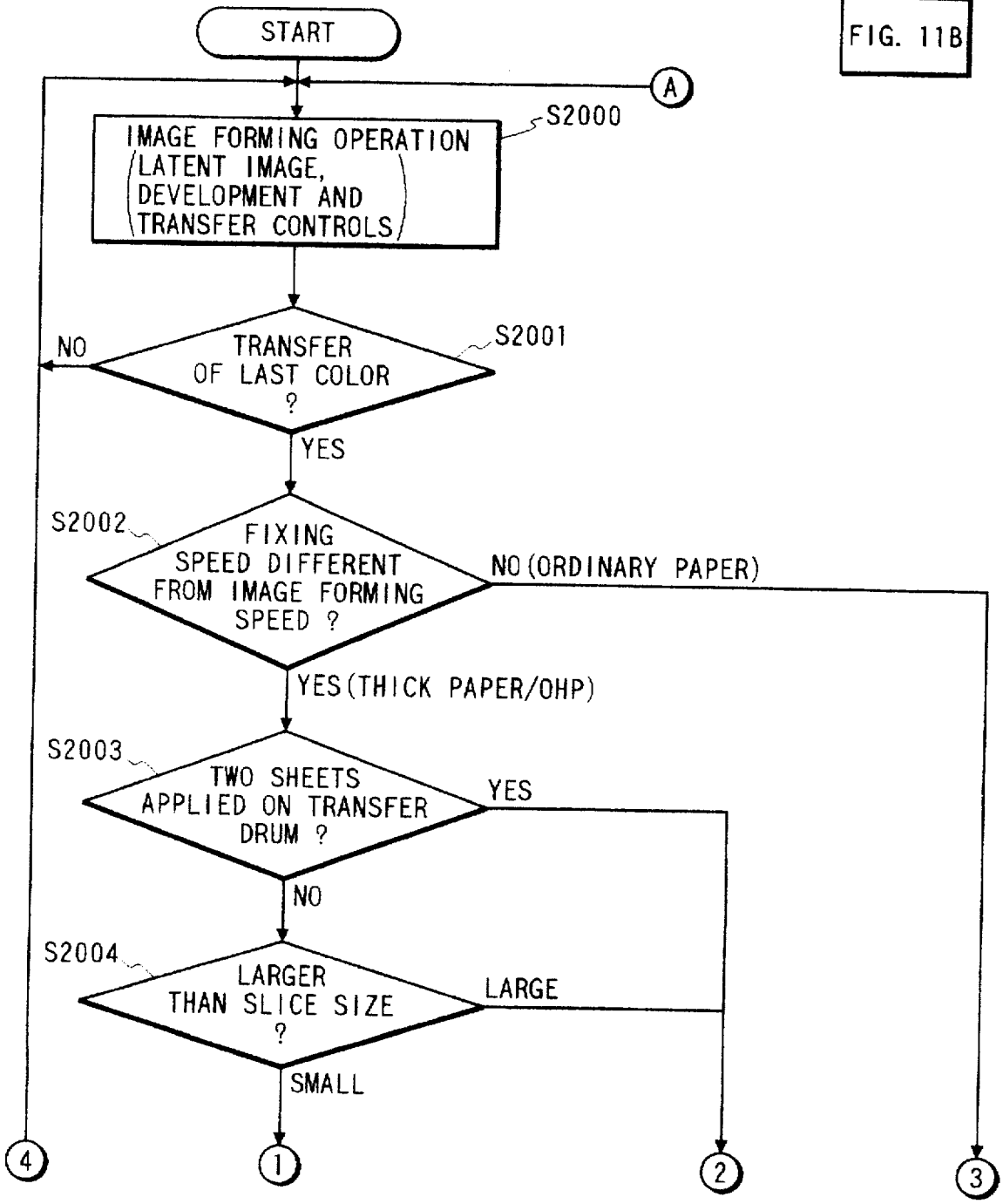
Figure 11B:
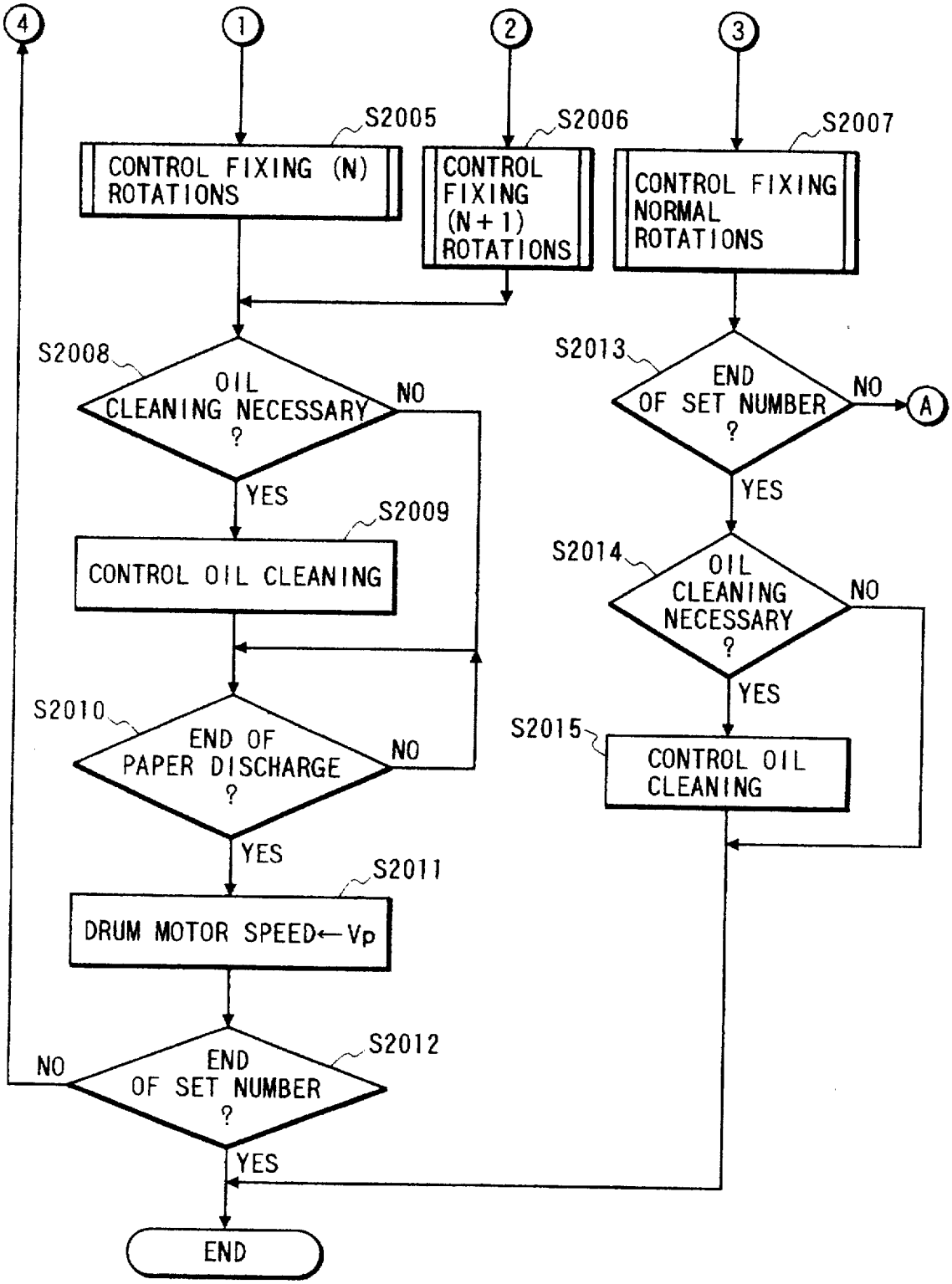

In contrast to the thick paper mode explained in the foregoing, in the ordinary paper mode where the image forming speed is equal to the fixing speed, the sequence proceeds from the step S2002 in FIGS. 11A and 11B to a step S2007 for executing "a fixing ordinary rotation control". In this control, since the fixing speed is equal to the image forming speed VP, the image formation is conducted continuously on the transfer sheet 5*f*, and the oil cleaning control is executed after the image formation on the predetermined number of sheets, even if there is included the image formation for the second side in the two-side mode (steps S2013 to S2015).

Figure 12:
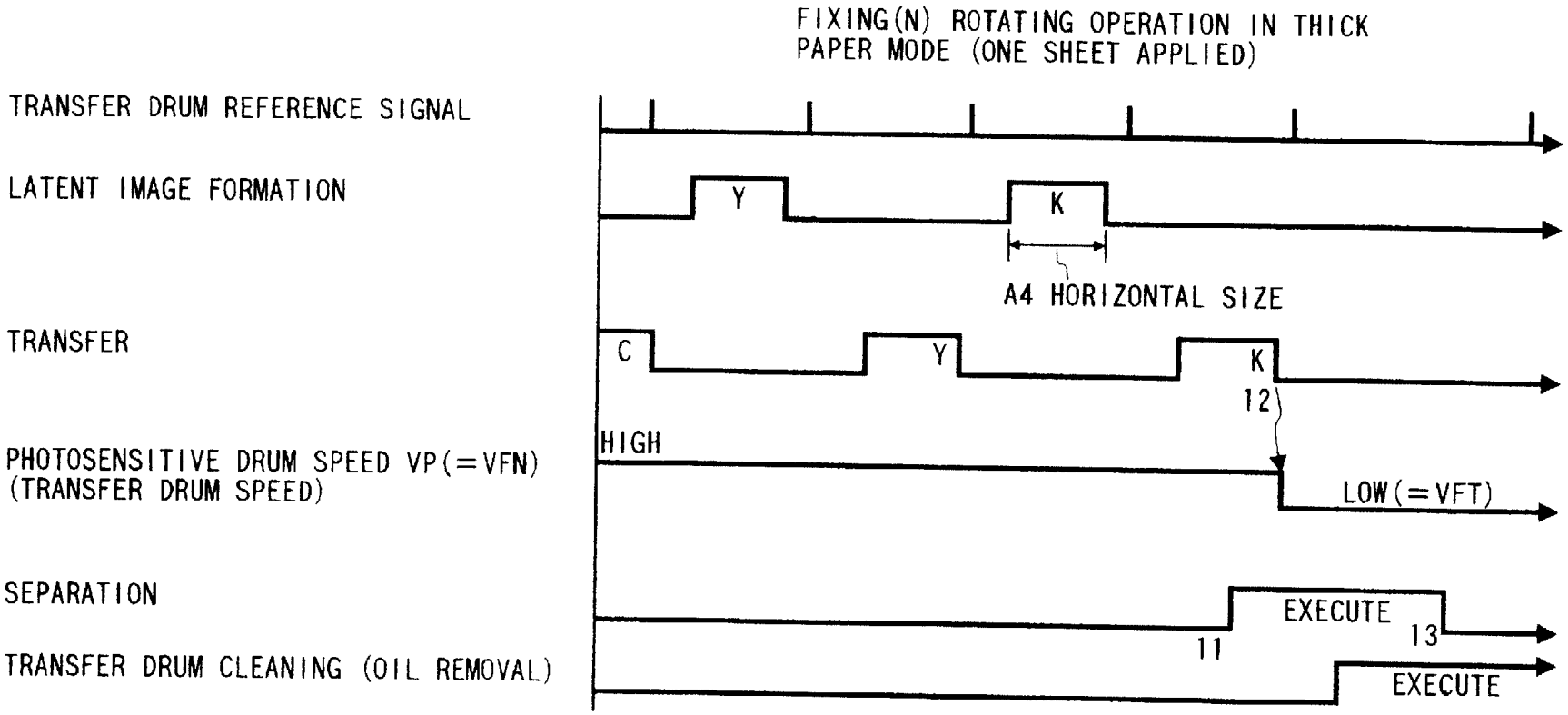
FIG. 12 is a timing chart showing a fixing (N) rotation operation in the thick paper mode in the flow chart shown in FIG. 11.
Figure 13:
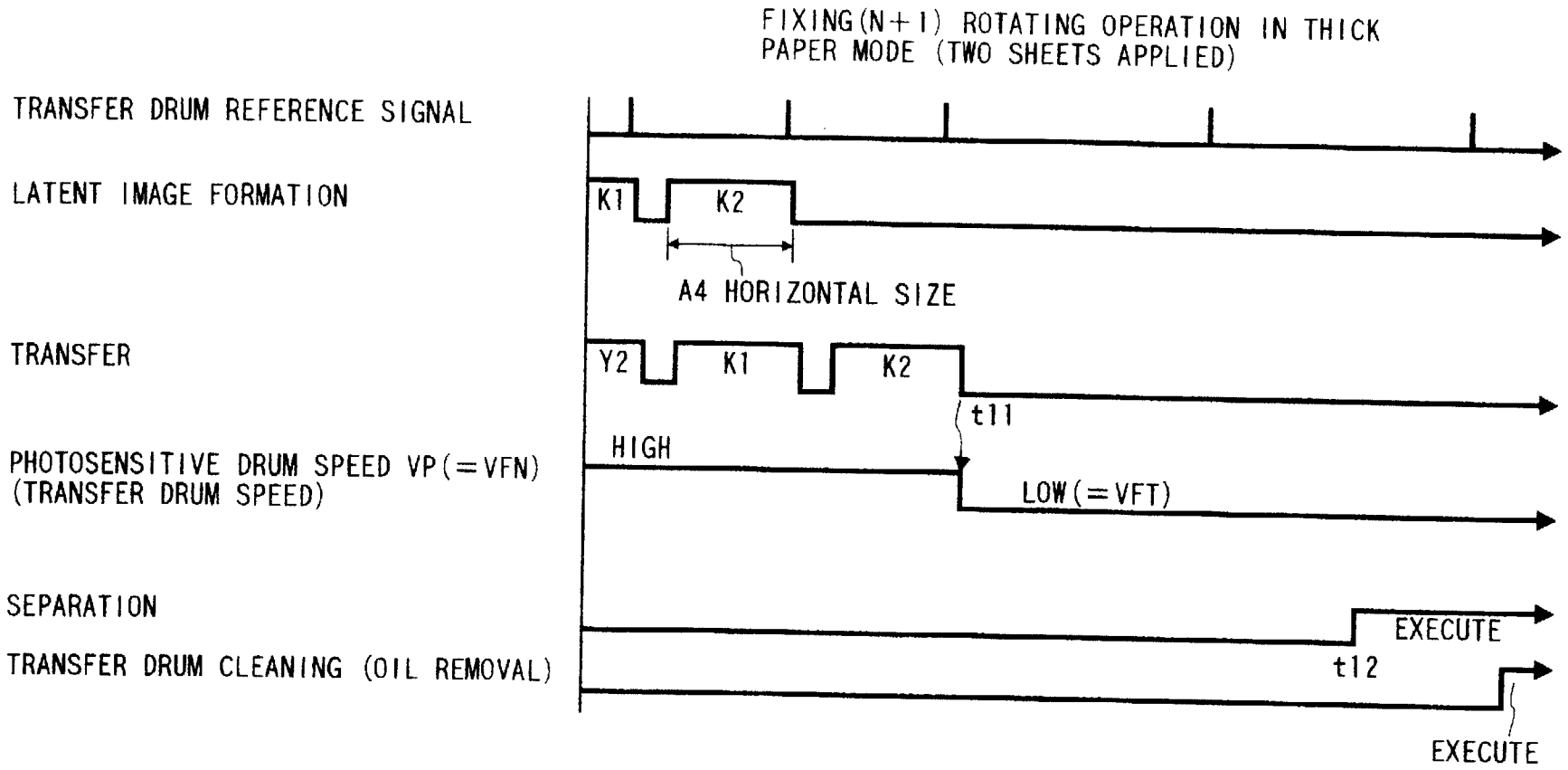
FIG. 13 is a timing chart showing a fixing (N+1) rotation operation in the thick paper mode in the flow chart shown in FIG. 11.
Figure 14:
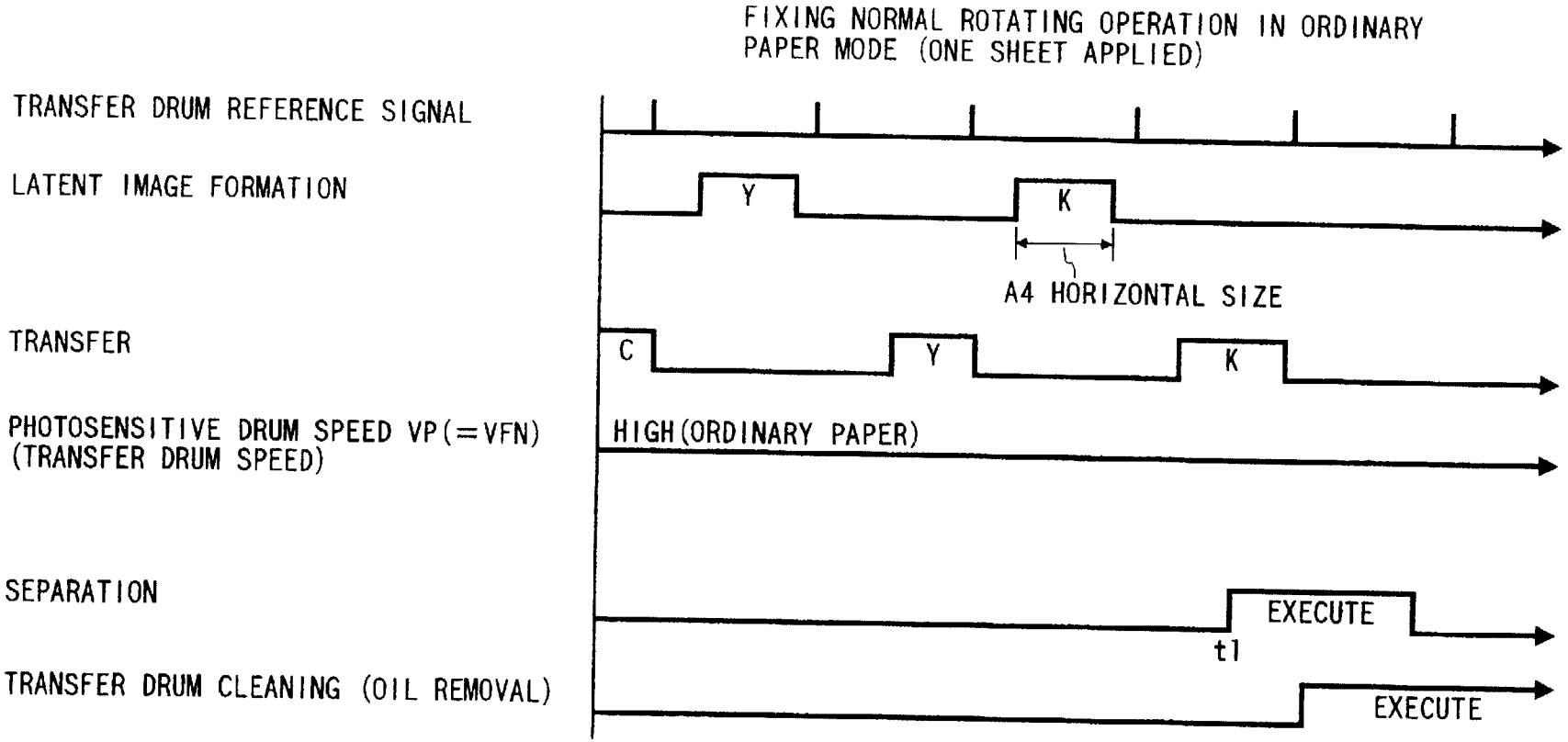
FIG. 14 is a timing chart showing a fixing (N) rotation operation in the ordinary paper mode in the flow chart shown in FIG. 11.
Figure 15:
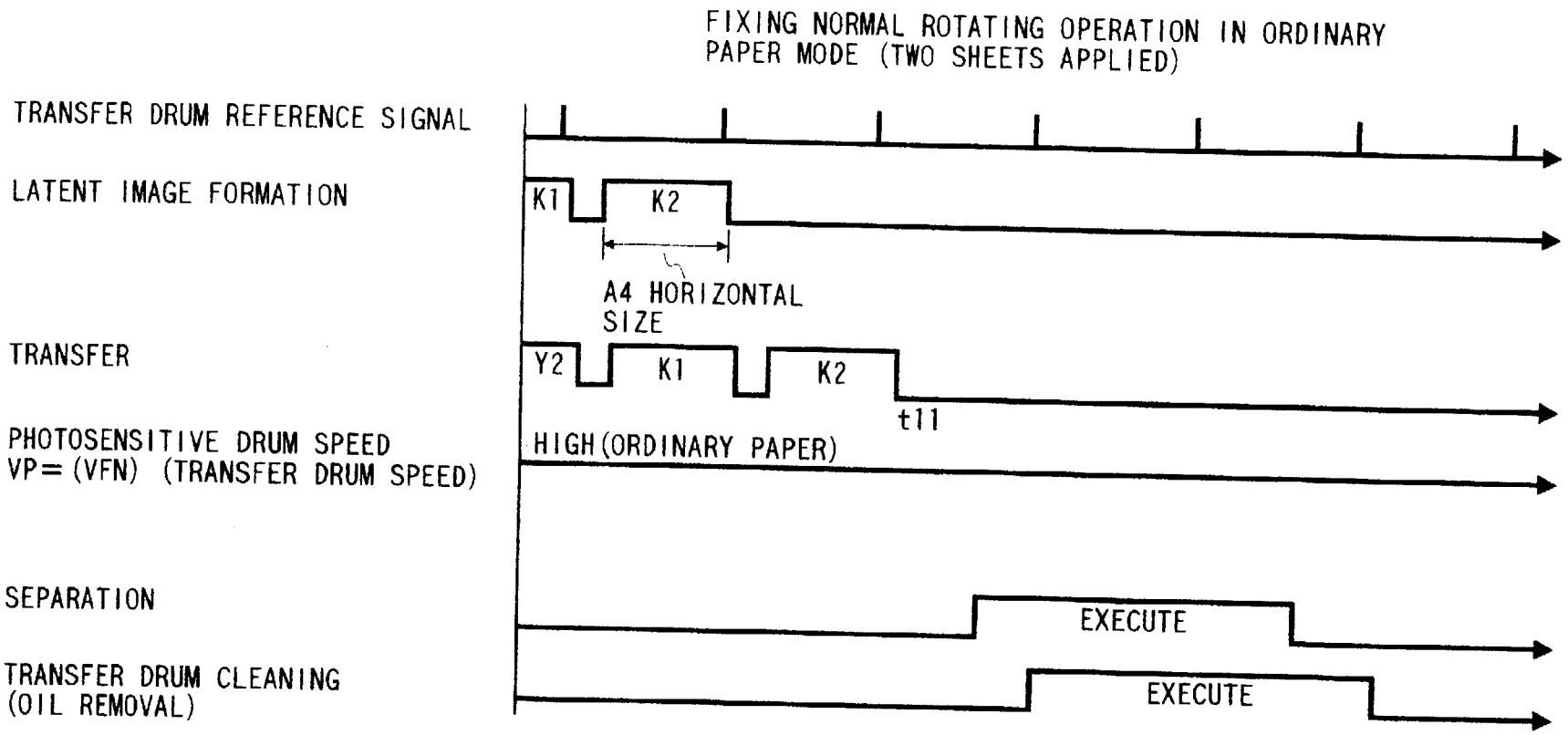
FIG. 15 is a timing chart showing a fixing (N+1) rotation operation in the ordinary paper mode in the flow chart shown in FIG. 11.

Timing charts in FIGS. 14 and 15 show such control, in contrast to the control in the aforementioned thick paper mode shown in FIGS. 12 and 13. FIG. 14 shows the case of one-sheet attraction mode as in the thick paper mode shown in FIG. 12, and FIG. 15 shows the case of two-sheet attraction mode as in the thick paper mode shown in FIG. 13.

In the ordinary paper mode, if a step S2014 after the image formation for a predetermined number of sheets judges the necessity for the oil cleaning, a step S2015 executes the oil cleaning control before the control is terminated. The oil cleaning is identified necessary, as already explained before, for the second side in the two-side mode on the recording material supplied from the intermediate tray 22 or from the recording material tray 7*m*.

In the recording on the OHP sheet requiring a fixing speed different from that for the thick paper, the thick paper mode is likewise applicable to the OHP sheet by setting the fixing speed at VFO. Also in case the monochromatic mode is not selected for the second side in the two-side mode, the fixing speed VFD is different from the process speed VP, so that the oil cleaning control can be executed as in the second side in the two-side mode for the thick paper.

Also the fixing side for the second side in the two-side mode may be made lower than that for the first side in the two-side mode, in consideration of the influence of the toner, deposited on the first side of the recording material, on the fixing operation for the second side. Such control may be realized in any of the ordinary paper mode, thick paper mode and OHP mode.

(Recovery control)

Figure 16:
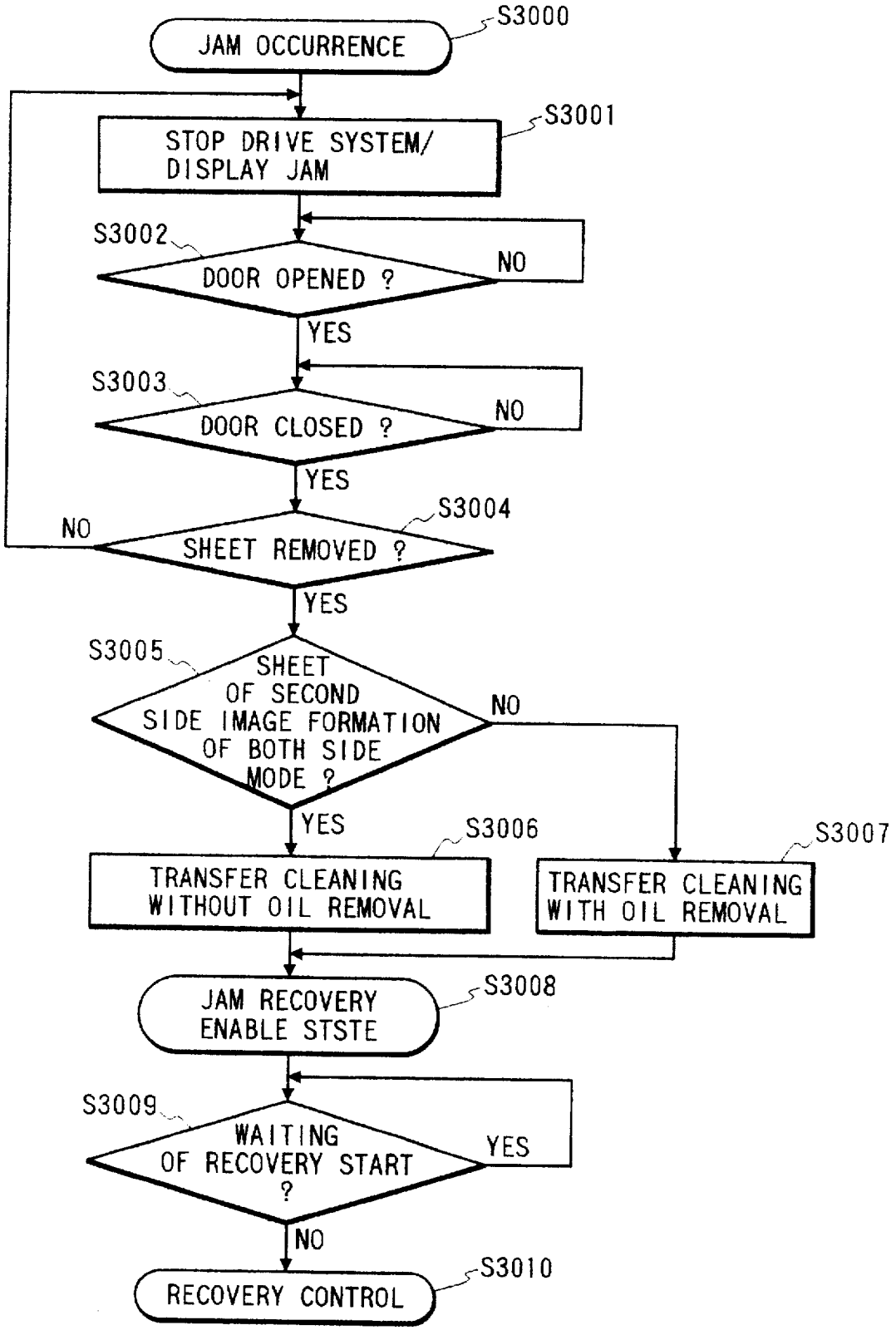
FIG. 16 is a flow chart showing a jam process in the color image forming apparatus shown in FIG. 1.

In the following there will be explained, with reference to a flow chart in FIG. 16, the recovery control after detection of sheet jamming (hereinafter written as "jam detection") in the above-explained image forming apparatus. As already known, in case of a jamming (step S3000), the feeding of the recording material is terminated, and a jam status is displayed on the operation unit (S3001).

Then, when a door is opened and closed for removing the jammed recording material (S3002, S3003), there is confirmed, by an unrepresented sheet feed sensor, whether the recording material has been removed from the sheet feed path or from the transfer drum (S3004). If the removed recording material includes a sheet for the image formation for the second side in the two-side mode, the fixing oil present on the first side of the recording material may have deposited onto the stopped transfer sheet 5*f*. Consequently, in such case, the sequence proceeds from a step S3005 to S3006 to execute the oil cleaning control and the cleaning operation of the transfer sheet 5*f*. On the other hand, if such sheet for the image formation for the second side in the two-side mode is not included, the oil cleaning control is not executed but there is only conducted the cleaning of the transfer sheet 5*f* by the fur brush 14 and the fur backup brush 15 (S3007). Then the recovery operation is executed (S3008, S3009, S3010).

The step S3005 may also judge whether the oil cleaning control is necessary. In case of a jam detection requiring the oil cleaning control, the deposition of the fixing oil onto the photosensitive drum 1 in the recovery control can be prevented by executing the oil cleaning control before the recovery control. As the present embodiment judges the necessity of the oil cleaning control according to the fixing speed and the paper feed position, the conditions for such judgment may be so expanded as to realize the oil cleaning control before the recovery control in all cases.

(Control of grinding roller 18)

Figure 17:
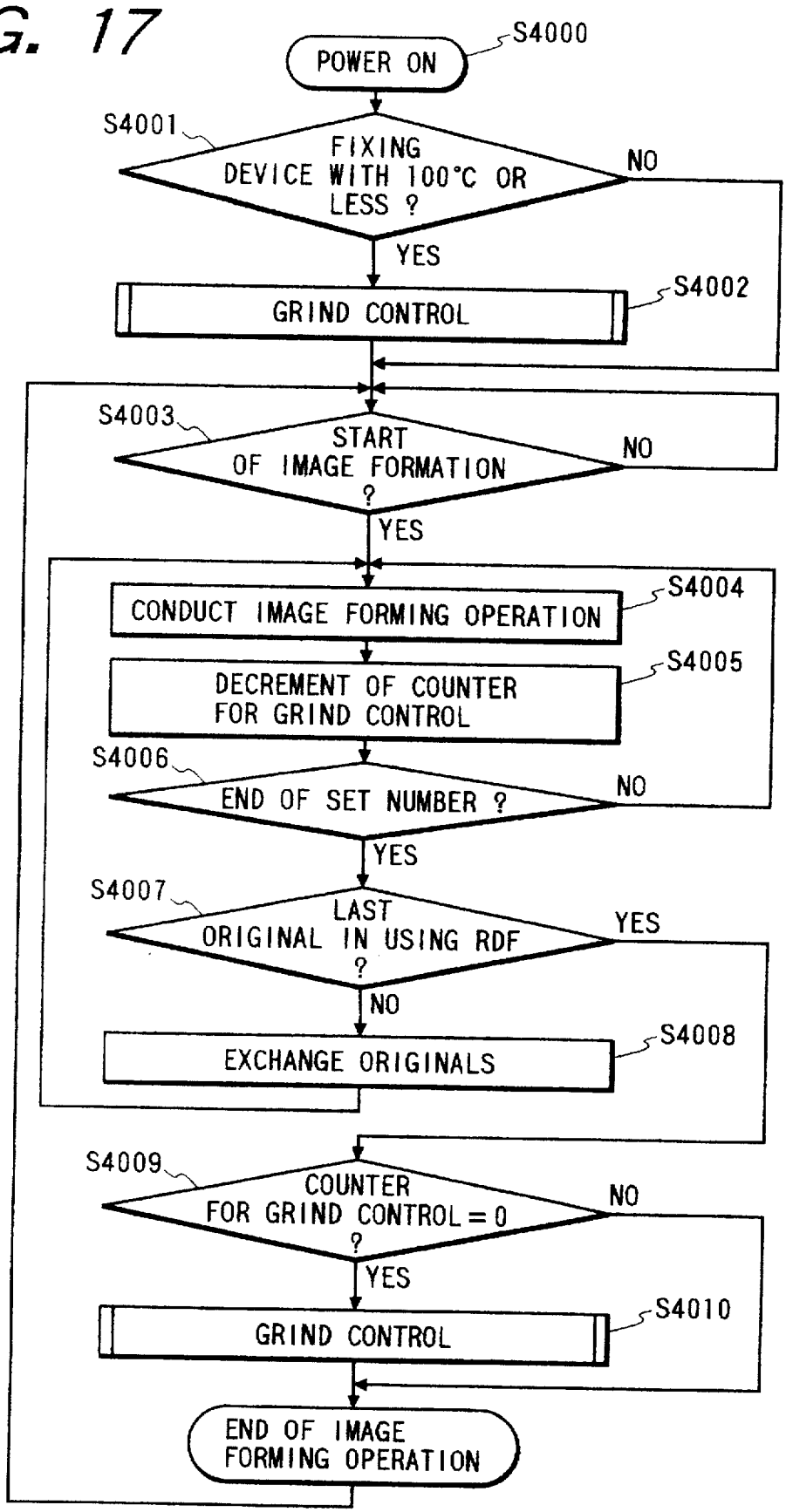
FIG. 17 is a flow chart showing a grinding control process in the color image forming apparatus shown in FIG. 1.

In the following there will be explained the control of the grinding roller 18, with reference to a flow chart in FIG. 17.

The grinding roller 18 cooperates with the opposed grinding roller backup brush 19, and is used for grinding off the toner and the deposits from the paper, not removable with the fur brush 14. For this purpose, the grinding roller 18 is provided, on the external periphery thereof, with a member functioning like a sand-paper, which grinds off the deposits that cannot be removed with the fur brush 14. The grinding roller 18, affecting the service life of the transfer sheet 5*f*, is so controlled as to effect the grinding operation for example after every 2000 image formations.

The grinding control in the present embodiment is realized by driving the grinding roller 18 and the grinding roller backup brush 19 and rotating the transfer drum 5*a* by 20 turns. This control requires several minutes, during which the image forming operation cannot be executed. Therefore, in order not to increase the time of inhibiting the image forming operation, the grinding control is executed while the fixing rollers are still cold immediately after the start of power supply (step S4000). Stated differently, the start of power supply (step S4000). Stated differently, the grinding control is executed during the time required by the fixing rollers to reach the temperature necessary for the image formation, thereby shortening the period in which the image forming operation is inhibited.

More specifically, the aforementioned grinding control is executed when the temperatures of the fixing rollers 9*a*, 9*b*, detected by the upper and lower fixing thermistors 781, 782, are both lower than 100° C. (S4001, S4002). However, the method of discrimination whether or not to execute the grinding control at the start of power supply is not limited to the method mentioned above, the execution of the grinding control may be determined in consideration of the detected temperatures of the fixing rollers, the number of copies made after the preceding grinding control.

After the image forming operation is enabled by the heating of the fixing rollers, when a desired mode is set in the operation unit and the start key 354 is actuated (S4003), there is initiated the aforementioned image forming operation (S4004). At the end of the image forming operation for each sheet, there is executed a decrement of a grinding control counter (S4005). These operations are repeated for the preset number of copies (S4006), and, if the automatic original feeding RDF is used, the image forming operation for the last original is repeated for the preset number of copies (S4007, S4008). As all the image forming operations have been completed at this point, there is checked the count of the grinding control counter, decreased in the course of the image forming operations (S4006). A count 0 indicates that the image forming operations of a predetermined number have been conducted after the preceding grinding operation so that a new grinding operation is necessary. Thus, in case of the count 0, there is executed the grinding control for effecting the grinding operation (S4009, S4010). As the image forming operation is inhibited during the grinding control, a message of that effect is displayed on the display unit. In this manner the grinding control can be provided, as a part of the image forming operation, to the user.

In the following there will be explained the content of the grinding control in the step S4010, with reference to a flow chart in FIG. 18. When the grinding control is started (S4100), the transfer drum 5*a* is cleaned for a turn with the fur brush 14 only, for removing the toner from the transfer sheet 5*f* (S4101). Subsequently the grinding roller 18 and the grinding backup brush 19 are activated (S4102) to effect the grinding operation for a predetermined number of turns (20 turns in the present embodiment) of the transfer sheet 5*f* (S4103). After such grinding operation for the predetermined number of turns, the grinding brush 18 and the grinding backup brush 19 are deactivated (S4104), then the transfer drum 5*a* is cleaned again for a turn with the fur brush 14 alone (S4105), for removing the dust generated by the grinding operation. Subsequently an initial value (2000 in the present embodiment) is set in the grinding control counter for managing the number of copies (S4106), and the grinding control is thus terminated (S4107).

The present embodiment effects management by the number of recording materials used since the preceding grinding control, as explained in the foregoing. It is also rendered possible, by providing an independent counter for managing the sheet number also for the fur brush cleaning and the oil cleaning explained in the foregoing, to prevent detrimental effect on the apparatus such as by an erroneous setting of the user in the selection of the kind of sheet or by an erroneous operation, such as oil deposition, caused by the insertion of the used sheets in the cassette.

(Cleaning operation for the transfer drum)

In the following there will be explained the execution, from the operation unit, of the cleaning operation for the transfer drum. The present embodiment provides an environment enabling such cleaning operation not by the user but only by the servicing personnel, but such cleaning operation may be made realizable also by the user.

According to predetermined operation on the operation unit 704, the display panel 369 displays an input image of the service mode to be used by the service personnel only. FIG. 19 shows the display of a service mode, relating to the cleaning operation for the transfer drum. In this state, the cleaning mode is selected and executed by the cursor keys (365, 366, 367, 368) and the OK key 364. In FIG. 19, the oil removing mode is selected, and this mode is executed by the depression of the OK key 364 in this state.

Figure 20:
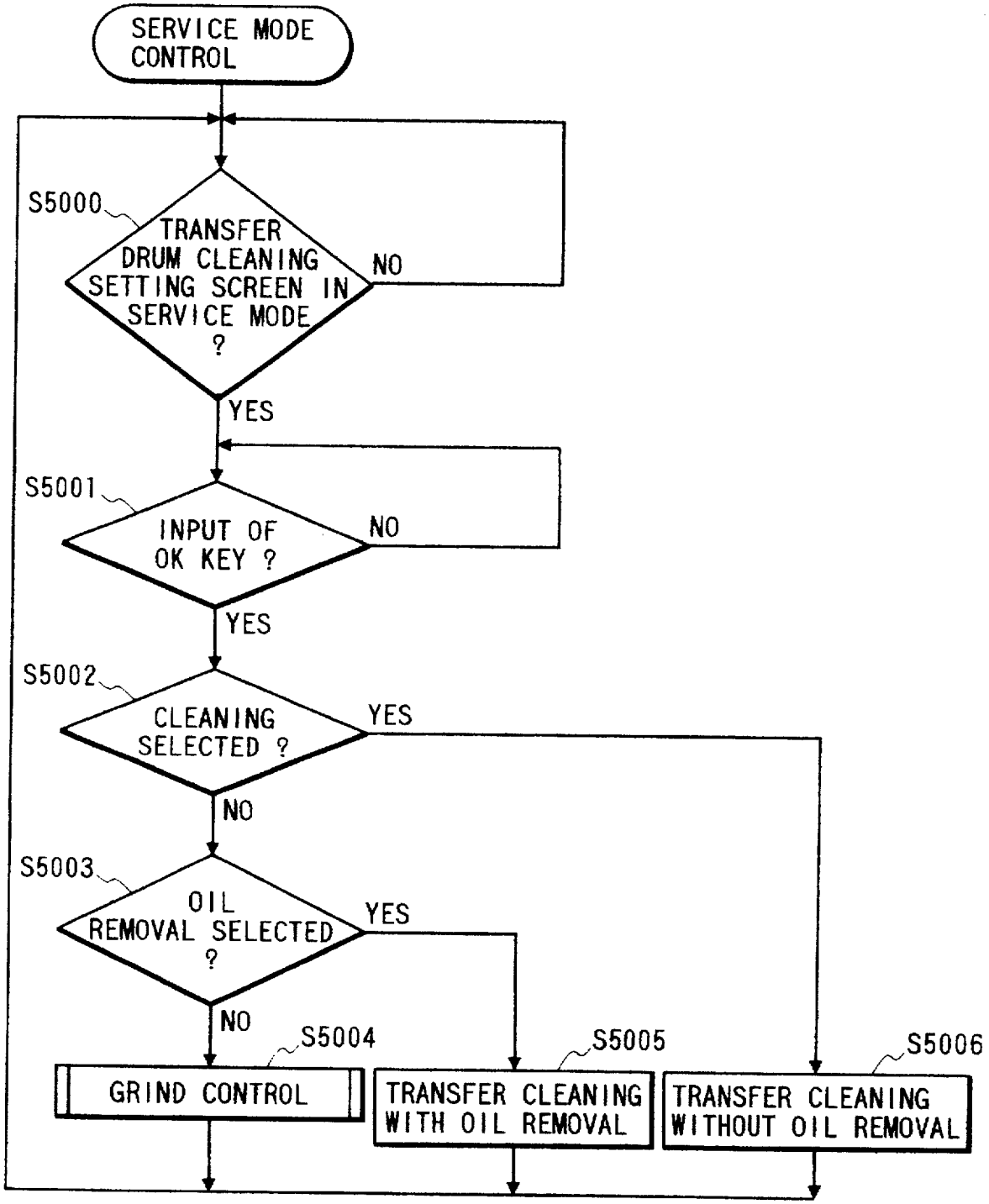
FIG. 20 is a flow chart showing a process in the transfer drum cleaning mode in the color image forming apparatus shown in FIG. 1.

In the following there will be explained, with reference to a flow chart shown in FIG. 20, the service relating to the cleaning operation for the transfer drum. At first there is discriminated whether the service mode is selected and is a mode relating to the cleaning operation for the transfer drum (step S5000). If the result is affirmative, there is monitored the input of the OK key 364 (S5001), and the cleaning mode is fixed at such input. Then there is discriminated the kind of the selected cleaning mode (S5002, S5003), and, if the cleaning is selected, the sequence proceeds to a step S5006 to execute the transfer drum cleaning without oil removal. This is same as the control of the step S5007 in FIG. 16, for cleaning the transfer sheet 5*f* with the fur brush 14 and the fur backup brush 15 only. On the other hand, if the oil removal is selected, the sequence proceeds from the step S5003 to S5005 to effect the transfer drum cleaning with oil removal. This is same as the control of the step S3006 in FIG. 16, for cleaning the transfer sheet 5f by activating the oil cleaning backup brush 17 and the oil cleaning roller 16, in addition to the fur brush 14 and the fur backup brush 15.

Figure 18:
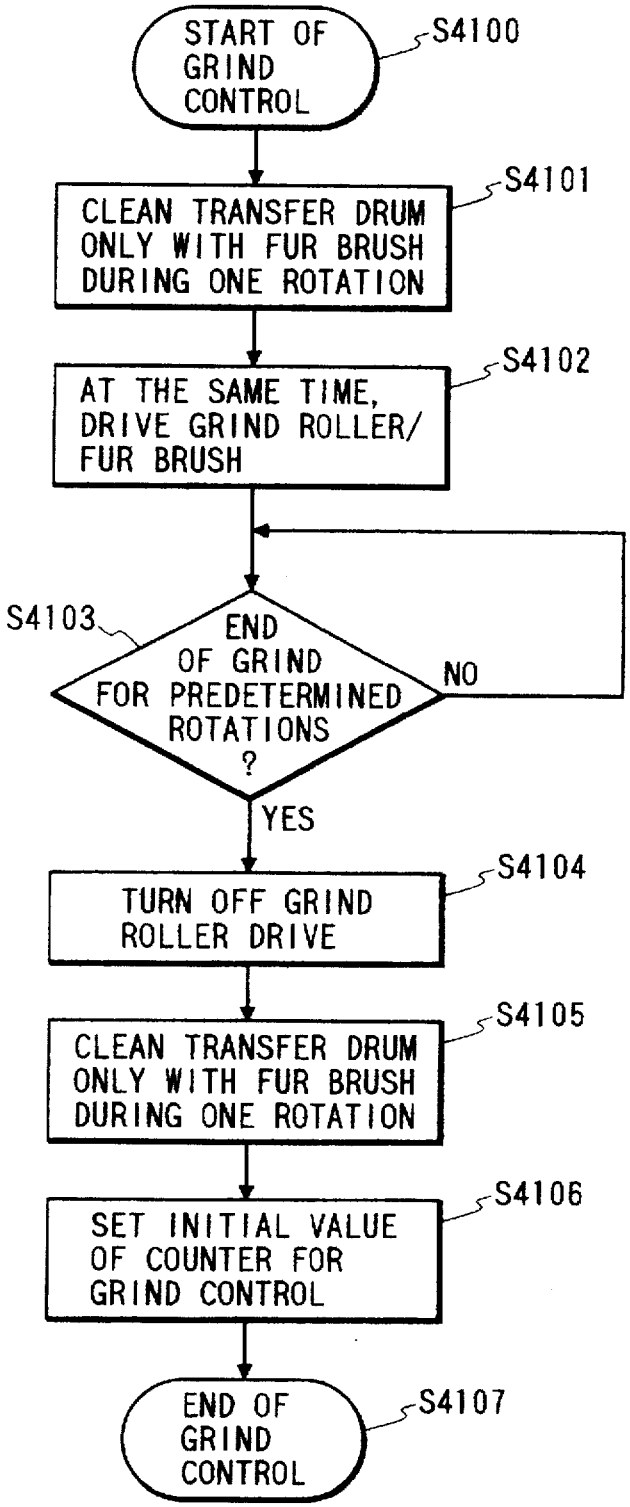
FIG. 18 is a flow chart showing grinding control in the color image forming apparatus shown in FIG. 1.

In case any cleaning mode other than the foregoing two modes is selected, there is executed the grinding control (S5004), which is identical with the oil removing control shown in FIG. 18.

Such selective cleaning operation for the transfer drum according to the service mode allows to achieve reduction of the servicing time, improvement in the efficiency of servicing works and image formation of higher quality.

As explained in the foregoing, in response to the end or interruption of the image forming operation in the image forming apparatus, there is executed control in such a manner as to widen the gap between a tray not currently subjected to sheet storage and an adjacent tray and to reduce the gap between a tray currently subjected to sheet storage and an adjacent tray. It is thus rendered possible to prevent increase of the curl in the sheets, caused by a widened space between a tray containing sheets and an adjacent tray when the sheets are not ejected from the image forming apparatus.

What is claimed is:

1. A sheet storage apparatus comprising:

transporting means for transporting sheets ejected from an image forming apparatus;

plural trays for storing the sheets transported by said transporting means;

tray moving means for moving a position of said plural trays with respect to said feeding means in order to store the sheets respectively in said plural trays, and increasing space between a tray subjected to sheet storage and an adjacent tray; and control means for controlling said tray moving means, in response to the end or interruption of an image forming operation of said image forming apparatus, so as to increase space of trays not subjected to sheet storage operation and to decrease space of a tray subjected to a sheet storage operation, thereby pressing the sheets present on each tray.

2. A sheet storage apparatus according to claim 1, wherein said control means restores the original tray positions, in response to start of an image forming operation of said image forming apparatus.

3. A sheet storage apparatus according to claim 1, wherein said image forming apparatus effects image formation by an electrophotographic process.

4. A sheet storage apparatus according to claim 3, wherein said image forming apparatus effects color image formation.

5. A sheet storage apparatus according to claim 1, wherein said image forming apparatus is a copying apparatus.

6. A sheet storage method comprising steps of:

transporting sheets ejected from an image forming apparatus;

moving the position of plural trays for storing said sheets transported in said transporting step in order to store the sheets respectively in said plural trays;

increasing space between a tray subjected to sheet storage and an adjacent tray; and effecting control, in response to end or interruption of an image forming operation of said image forming apparatus, so as to increase space of trays not subjected to a sheet storage operation and to decrease space of a tray subjected to a sheet storage operation, thereby pressing the sheets present on each tray.

7. A sheet storage method according to claim 6, wherein said control step restores the original tray positions, in response to start of an image forming operation in said image forming apparatus.

8. A sheet storage method according to claim 6, wherein said image forming apparatus effects image formation by an electrophotographic process.

9. A sheet storage method according to claim 8, wherein said image forming apparatus effects color image formation.

10. A sheet storage method according to claim 6, wherein said image forming apparatus is a copying apparatus.

11. A sheet storage apparatus comprising:

transporting means for transporting sheets ejected from an image forming apparatus;

plural trays for storing the sheets transported by said transporting means;

tray moving means for moving a position of said plural trays with respect to said transporting means in order to store the sheets respectively in said plural trays, and increasing space between a tray subjected to sheet storage and an adjacent tray; and control means for controlling said tray moving means, in response to an end or interruption of an image forming operation of said image forming apparatus, so as to decrease space of a tray subjected to a sheet storage operation, thereby pressing the sheets present on each tray.

12. A sheet storage apparatus according to claim 11, wherein said control means restores the original tray positions, in response to start of an image forming operation of said image forming apparatus.

13. A sheet storage apparatus according to claim 11, wherein said image forming apparatus effects image formation by an electrophotographic process.

14. A sheet storage apparatus according to claim 13, wherein said image forming apparatus effects color image formation.

15. A sheet storage apparatus according to claim 11, wherein said image forming apparatus is a copying apparatus.

16. A sheet storage method comprising steps of:

transporting sheets ejected from an image forming apparatus;

moving the position of plural trays for storing said sheets transported in said transporting step in order to store the sheets respectively is said plural trays;

increasing space between a tray subjected to sheet storage and an adjacent tray; and effecting control, in response to end or interruption of an image forming operation of said image forming apparatus, so as to decrease space of a tray subjected to a sheet storage operation, thereby pressing the sheets present on each tray.

17. A sheet storage method according to claim 16, wherein said control step restores the original tray positions, in response to start of an image forming operation in said image forming apparatus.

18. A sheet storage method according to claim 16, wherein said image forming apparatus effects image formation by an electrophotographic process.

19. A sheet storage method according to claim 18, wherein said image forming apparatus effects color image formation.

20. A sheet storage method according to claim 16, wherein said image forming apparatus is a copying apparatus.

* * * * *

UNITED STATES PATENT AND TRADEMARK OFFICE

CERTIFICATE OF CORRECTION

PATENT NO. : 5,761,600
DATED : June 2, 1998
INVENTOR(S) : Murata

It is certified that error appears in the above-identified patent and that said Letters Patent is hereby corrected as shown below:

COLUMN 3

Line 64, "called" should read --be called--.

COLUMN 7

Line 21, "nor-sort" should read --non-sort--.

COLUMN 8

Line 67, "apparats" should read --apparatus--.

COLUMN 10

Line 51, "overstocking" should read --overstacking--.

COLUMN 11

Line 38, "overstocking" should read --overstacking--.
Line 66, "overstocking" should read --overstacking--.

Column 13

Line 4, "overstocking" should read --overstacking--.
Line 8, "overstocking" should read --overstacking--.

UNITED STATES PATENT AND TRADEMARK OFFICE

CERTIFICATE OF CORRECTION

PATENT NO. : 5,761,600
DATED : June 2, 1998
INVENTOR(S) : Murata

It is certified that error appears in the above-identified patent and that said Letters Patent is hereby corrected as shown below:

COLUMN 18

Line 25, "motor" (second occurrence) should read --motors--.
Line 57, "remain" should read --remaining--.

Column 21

Line 3, "not" should read --neither--.
Line 41, "to made" should read --to be made--.

COLUMN 22

Line 47, "covers" should read --cover--.
Line 50, "corresponding" should read --corresponding to--.

COLUMN 25

Line 5, "set to at" should read --set to--.

COLUMN 26

Line 35, "2000" should not be bold.

UNITED STATES PATENT AND TRADEMARK OFFICE

CERTIFICATE OF CORRECTION

PATENT NO. : 5,761,600
DATED : June 2, 1998
INVENTOR(S) : Murata

It is certified that error appears in the above-identified patent and that said Letters Patent is hereby corrected as shown below:

Line 44, "Stated differently, the start of" should be deleted.
Line 45, "Power supply (step S4000)." should be deleted.

COLUMN 30

Line 15, "is said" should read --in said--.

Signed and Sealed this

Nineteenth Day of January, 1999

*Attest:*

*Attesting Officer*

*Acting Commissioner of Patents and Trademarks*